US012312912B2

(12) United States Patent
Storie et al.

(10) Patent No.: US 12,312,912 B2
(45) Date of Patent: May 27, 2025

(54) DOWNHOLE METHOD AND ASSOCIATED APPARATUS

(71) Applicant: Hydropulsion Limited, Aberdeen (GB)

(72) Inventors: Brian Storie, Aberdeen (GB); Barry Reid, Sauchen (GB)

(73) Assignee: Hydropulsion Limited (GB)

( * ) Notice: Subject to any disclaimer, the term of this patent is extended or adjusted under 35 U.S.C. 154(b) by 81 days.

(21) Appl. No.: 17/641,340

(22) PCT Filed: Sep. 8, 2020

(86) PCT No.: PCT/GB2020/052154
§ 371 (c)(1),
(2) Date: Mar. 8, 2022

(87) PCT Pub. No.: WO2021/048533
PCT Pub. Date: Mar. 18, 2021

(65) Prior Publication Data

US 2022/0341288 A1 Oct. 27, 2022

(30) Foreign Application Priority Data

Sep. 9, 2019 (GB) ..... 1912956
Feb. 17, 2020 (GB) ..... 2002154

(51) Int. Cl.

| | |
|---|---|
| ***E21B 34/10*** | (2006.01) |
| ***E21B 21/00*** | (2006.01) |
| ***E21B 21/08*** | (2006.01) |
| ***E21B 21/10*** | (2006.01) |
| ***E21B 21/16*** | (2006.01) |
| ***E21B 23/00*** | (2006.01) |
| ***E21B 37/00*** | (2006.01) |

(52) U.S. Cl.
CPC ..... *E21B 34/10* (2013.01); *E21B 21/003* (2013.01); *E21B 21/08* (2013.01); *E21B 21/103* (2013.01); *E21B 21/16* (2013.01); *E21B 23/006* (2013.01); *E21B 37/00* (2013.01)

(58) Field of Classification Search
CPC ..... E21B 34/16; E21B 21/16; E21B 23/006
See application file for complete search history.

(56) References Cited

U.S. PATENT DOCUMENTS 4,046,191 A * 9/1977 Neath ..... E21B 21/001 175/25
2004/0104030 A1* 6/2004 Livingstone ..... E21B 21/10 166/77.2

(Continued)

*Primary Examiner* — Yanick A Akaragwe
(74) *Attorney, Agent, or Firm* — Dickinson Wright PLLC

(57) ABSTRACT

A circulating downhole tool utilising a variable fluid pressure regulated cycle valve device that can be attached to the borehole assembly BHA of a coiled tubing and used down an offshore or onshore wellbore is disclosed. The circulating downhole tool utilising a variable fluid pressure regulated cycle valve device can be remotely operated by an operator on the surface as many times as required in either the through-flow, intermediary or circulatory modes-of-operation, by simply varying the drilling fluid flow rate and pressure being supplied from the pump located on the surface and interconnected to the coiled tubing and the BHA that will include the circulating downhole tool utilising a variable fluid pressure regulated cycle valve device.

12 Claims, 10 Drawing Sheets

(56) References Cited

U.S. PATENT DOCUMENTS

| | | | | |
|---|---|---|---|---|
| 2011/0266071 | A1* | 11/2011 | Lind | E21B 10/42<br>175/428 |
| 2013/0062124 | A1* | 3/2013 | Roders | E21B 21/103<br>700/282 |
| 2014/0124195 | A1* | 5/2014 | Tahoun | E21B 34/12<br>166/250.01 |
| 2016/0281449 | A1* | 9/2016 | Lorenson | E21B 21/10 |
| 2017/0241232 | A1* | 8/2017 | Williamson | E21B 34/10 |

* cited by examiner

DOWNHOLE METHOD AND ASSOCIATED APPARATUS

CROSS-REFERENCE TO RELATED APPLICATIONS

The present application is a national phase application of International Application No. PCT/GB2020/052154 filed Sep. 8, 2020, which claims priority to British Application No. 1912956.8 filed Sep. 9, 2019 and British Application No. 2002154.9 filed Feb. 17, 2020, the disclosures of which are hereby incorporated by reference herein.

BACKGROUND

Circulating downhole tool utilising a variable fluid pressure regulated cycle valve device.

This invention relates to a circulating downhole tool utilising a variable fluid pressure regulated cycle valve device that can be attached to the borehole assembly BHA of a coiled tubing and is able to divert drilling fluid to the BHA tools below it or into the annulus between the BHA and the wellbore and back to the surface when required for diverse spotting remediation fluid operations, for drilling operations, for wellbore clean-up operations, for blowout preventer BOP stack jetting operations for surge pressure reduction, and for unloading a wellbore with Nitrogen gas.

SUMMARY

In the oil and gas industry an offshore or onshore drilling rig uses an assembly of interconnected drill pipes and sophisticated instruments called the bottom hole assembly BHA that constitutes the lower end of the drilling rig. The BHA is normally interconnected to the bottom of a long string of pipes that each have threaded end connections and can be up to 10 metres long and which are interconnected to form the drill string. Drill collars can also be interconnected to drill pipes when necessary to increase the resultant drill string weight as the drill collars have thicker walls than drill pipes. The drill string can combine hundreds of drill pipe and drill collar lengths which can total up to 10 km and can be fitted with diverse BHA tools that can be operated omni-directionally underground.

In the oil and gas industry coiled tubing is used which is a very long metal pipe normally 1 to 3.25 inches in outer diameter that is supplied spooled on a large reel. Coiled tubing was developed for the D-Day landings by the British as the Pipeline Under The Ocean PLUTO operation where coiled tubing was used to transfer fuel from the UK to mainland Europe across the English channel. Today, coiled tubing is widely used in the oil and gas industry for interventions in oil and gas wells and sometimes as production tubing in depleted gas wells. Coiled tubing has the benefit of being able to transfer chemicals and gases through the coiled tubing and the ability to push the coiled tubing into the wellbore instead of relying on gravity that is required for drill strings that use multiple interconnected drill pipes and drill collars. Another advantage of coiled tubing is that the pumping systems required can be an almost closed system and fairly self-contained, as the coiled tubing is continuous instead of jointed multiple drill pipes and drill collars used for drill strings.

In the oil and gas industry drilling operations are usually performed through a drilling derrick located offshore or onshore on the oil platform, although on oil platforms that do not have drilling facilities a self-supporting tower can be used. For onshore operations, coiled tubing has the operational advantage that they can be operated using small service rigs and even mobile self-contained coiled tubing rigs mounted on large trucks are used globally.

There are some important differences between coiled tubing drilling operations and traditional rotary drilling operations that use a drill string of interconnected drill pipes and drill collars. An important difference is that coiled tubing operations require the drilling fluid to be pumped and travels through the entire length of the coiled tubing regardless of the current tubing depth. Another difference is that the drilling fluid frictional pressure loss for coiled tubing from a coiled tubing reel is considerably higher than for a straight drill string. It is therefore important to note that in order to achieve the optimum hydraulic performance from the drilling fluid using coiled tubing, the drilling fluid must ideally behave as a low viscosity fluid whilst inside the coiled tubing, and ideally as a high viscosity fluid in the annulus between the coiled tubing and the wellbore in order to maximise drilled cutting removal efficiency back to the surface.

Another important difference between coiled tubing drilling and drill string operations is the absence of coiled tube rotation while drilling inside a wellbore. Drill stings that use jointed multiple drill pipes and drill collars used for drill strings are rotated during drilling operations and their rotational movement ensures that the drilled cuttings are suspended in the drilling fluid so that they can be transported to the surface. However, coiled tubing is not rotated for coiled tubing drilling applications which means that wellbore cleaning and the transport of drilled cuttings can be more challenging, especially in horizontal and highly deviated drilling applications underground. This effect is partially compensated automatically for by the fact that smaller sized drilled cuttings are produced with coiled tube drilling compared to drill string drilling, as coiled tubing drilling uses hydraulic motors that rotates the BHA drill bit at much higher rotational speeds, and there is a much lower weight on the drill bit, compared to drill string drilling. Additionally, special visco-elastic drilling fluids have been developed specifically for coiled tubing drilling whose rheological properties change naturally dependent on their local shear rate, meaning that the special visco-elastic drilling fluids become more viscous in the annulus where there is lower drilling fluid shear rate which substantially assists in drilling cuttings suspension and transport to the surface.

The tool string located at the lower end of the coiled tubing that is being deployed down a wellbore offshore or onshore is called the bottom hole assembly BHA and a diverse array of BHA tools have been developed including jetting nozzles for pumping cement and diverse chemicals through the coiled tubing to larger tools strings that incorporate diverse logging tools. The oil and gas industry of today and in the future will face increased pressure-related challenges globally while they develop unconventional and mature oil fields offshore and onshore. The oil and gas industry is having to concentrate more and allocate more resources on improving the feasibility of marginal oil wells whilst increasing operational safety standards and efficiency. Oil and gas industry companies try to unlock the full potential of their offshore and onshore operations in two primary ways, firstly by being increasingly operationally flexible by adjusting operations to unanticipated challenges, and secondly by completing oil field operations in as few trips as possible which maximises drilling efficiency.

Companies globally are responding to these oil and gas industry challenges and requirements by offering an increasingly diverse array of circulating downhole tools that are being used world-wide by the oil and gas industry for diverse operations, including: spotting remediation fluid operations, for drilling operations, for wellbore clean-up operations, for blowout preventer BOP stack jetting operations for surge pressure reduction, and for unloading a wellbore with Nitrogen gas known as unloading a well operation, and which are designed to be interconnected to the BHA of the coiled tubing.

A circulating tool, also called a circulating sub, is a downhole BHA tool that can be actuated to control the flow of drilling fluid between the coiled tubing interior and the annulus, created between the coiled tubing, the BHA and the wellbore. Circulating tools or circulating subs are specifically designed to increase the mud circulation, and mud is the name commonly use to describe drilling fluid that contains suspended drill cuttings in it, by being placed in the BHA either above the drill bit or the downhole motor, in order to pump materials in case of lost circulation. Diverse circulating tool designs use different methods to actuated in order to be opened in order to divert the downward drilling fluid flow through the BHA to the annulus. Circulating tools have a plurality of side mounted ports containing nozzles that can eject diverted drilling fluid out into the annulus either downwards or upwards dependent on the drilling operations being undertaken underground, which can be used to increase the velocity and flow rate of suspended drill cuttings such as debris and swarf to the surface for wellbore clean-up operations. The percentage amount of drilling fluid that is ejected by the circulating tool nozzles into the annulus instead of travelling down to the drill bit of the BHA depends on several factors including the size of the circulating tool nozzles, the rheological properties of the drilling fluid, the drilling fluid flow rate being delivered to the circulating tool and the circulating tools position on the BHA coiled tubing.

Circulating tools are therefore very useful to compensate for motor or other BHA tools that restrict the allowable drilling fluid circulation rates to the surface, especially when operating in small internal diameter wellbores, as the drilling fluid ejected from its nozzles into the annulus increases the velocity and flow rate of suspended drill cuttings such as debris and swarf to the surface provided by the circulating tool.

Circulating tools are also used for the efficient spotting of lost-circulation material LCM, also known as kill-weight fluids which is the name given to substances added to drilling fluids when drilling fluids are lost to wellbore formations instead of flowing back to surface. Lost-circulation materials such as hair, mineral fibres, shredded cane stalks and cedar bark, mica flakes or granular wood, marble or limestone can be added to the drilling fluid and transported down the circulating tool in order to give the operators an effective method to counteract partial or complete lost circulation in the wellbore resulting from hydrostatic or annulus pressure loss from natural or induced reasons.

The drilling fluid with added lost-circulation material LCM is called kill-weight fluid, and can be injected by the circulating tool into the wellbore, as the kill-weight fluid has a high enough density to produce a hydrostatic pressure at the circulating tool location of influx in a wellbore to shut off formation fluid flow into the wellbore. Close monitoring by the operator of associated drilling fluid tanks and drilling fluid flow rate and pressure are always encouraged.

Unfortunately, existing circulating downhole tools have diverse design and operational limitations, which limits their real-world capabilities. A disadvantage of the Schlumberger® M-I SWACO Multifunction clutch-type circulating tool technology circulating tools are that they require mechanically complicated ball-drop valves with sliding sleeves that open and close the circulating ports of the circulating tool which results in a large length to width ratio.

A disadvantage of the Schlumberger® M-I SWACO Commander one-ball open-close functionality drilling circulating valve is that it only permits open and closing six times, this number can be increased but only on request from Schlumberger® and incorporates a ball catcher, is that when the ball catcher is full with six balls, the entire tool must be returned to the surface for unloading and then when the ball catcher is manually emptied, the tool must be tripped back down the borehole for operation, which is both time consuming and costly operationally.

A disadvantage of the Weatherford International Plc RFID® JetStream Circulating sub is that it requires field specialists to program multiple radio frequency identification tags at the surface that are dropped down the coiled tubing to the circulating sub that communicates commands at it passes the tool.

A disadvantage of the Weatherford International Plc RFID® JetStream Circulating sub is that it requires an internal hydraulic pump that needs to be driven by a battery-powered electric motor that has an internal sleeve can be either opened or closed or can split the drilling fluid flow using a sleeve into one of three configurations, which is all relatively mechanically complicated and expensive to manufacture.

A disadvantage of the DAV MX™ circulating sub is that uses MX™ Smart Darts that need to be pumped down to the circulating sub and catcher, but unfortunately it requires different types of darts for different operations including a standard diverter dart, a well control dart, a split flow dart and a universal closing dart.

A disadvantage of the Halliburton® e-cd circulating device that is used in managed pressure drilling operations to enable continuous circulation and hole cleaning even while drilling or tripping in or out of the hole, is that it needs to be used in conjunction with the e-cd diversion manifold, and the sub has a dual flapper valve configuration that acts as a check valve and has a side flapper entry port connection and a second metal-metal plug seal that are all relatively mechanically complicated and expensive to manufacture.

The activation of the Darron Oil Tools® Circulating Sub requires a chrome steel ball that needs to be dropped down and pumped down the drill string using 3000 PSI of fluid pressure until the ball shears a pin holding the sleeve in its primary position, and the sleeve and pin can be dropped into a secondary position that opens three sub ports and diverts the downhole fluid flow to the circulation ports to allow fluid flow sideways into the annulus. A disadvantage of the drop ball type of circulation sub such as the Darron Oil Tools® Circulating Sub is that it requires a drop ball operated valve that is shifted open when a ball is dropped into the drill string and is pumped downwards. After the ball lands in the pre-designed seat in the sub, pump pressure is applied. A pin will be sheared that consequently allows an internal sleeve to shift and hence open the circulation ports to allow fluid flow sideways into the annulus, which limits the number of times the circulation sub can be actuated in one trop down the wellbore, maybe three time before the circulating sub must be tripped out of the borehole and reset.

A disadvantage of the drop ball type of circulation sub is that it may require the use of a combination of deformable drop balls and smaller hard balls to direct fluid flow through the tool or into the borehole.

A disadvantage of the drop ball type of circulation sub is that as each type of ball passes through the circulating sub, a ball catcher is also required that is positioned at the downhole end of the tool to catch the balls.

A disadvantage of the drop ball type of circulation sub is that the tool may be actuated using dropped balls a limited number of times or until the ball catcher is full.

A disadvantage of circulating tools that use a ball for actuation that is dropped into the drill string is that they usually require a burst disk installed as a redundant back-up in case the ball cannot reach the circulating sub due to an obstruction in the drill string.

To overcome the design and operational limitations of existing circulation downhole tools, it would be beneficial to have a circulating downhole tool that could operate above milling or jetting tools in the BHA and which could be operated remotely as many times as required by an operator on the surface, and be able to divert drilling fluid to the BHA tools below it or into the annulus between the BHA and the wellbore and back to the surface. It would also be beneficial to have a circulating downhole tool that was shorter and more compact in design and mechanically reliable that could combine the operating functions of both and circulating and over pressure downhole tool types. It would also be beneficial to have a circulating downhole tool that utilised a cost effective, highly reliable, rapid and simple to operate method to interchange as many times as required and at any operating angle between the through-flow and circulatory modes-of-operation within the wellbore that does not require circulating downhole tripping from the wellbore, so minimising non-production time NPT and associated operating costs to the operator.

The circulating downhole tool utilising a variable fluid pressure regulated cycle valve described here is designed to overcome the diverse design and operational limitations of existing circulating downhole tool designs, as described previously.

A potential advantage of the circulating downhole tool utilising a variable fluid pressure regulated cycle valve described here that utilises a variable fluid pressure regulated cycle valve is that it does not use bulky mechanically extruded darts, pins and plastically extruded balls for its operation, so allowing its internal diameter to be maximised which maximises drilling fluid velocity and turbulent flow in the annulus for more efficient drilling debris removal to the surface when operating in the circulatory mode-of-operation.

A potential advantage of the circulating downhole tool utilising a variable fluid pressure regulated cycle valve described here is that it can be remotely operated from the surface by an operator, so allowing selective and unlimited activation of the circulating downhole tool utilising a variable fluid pressure regulated cycle valve without having to be tripped or pulled out of the wellbore, so reducing non-productive time and minimising operational costs.

A potential advantage of the circulating downhole tool utilising a variable fluid pressure regulated cycle valve described here is that its remotely operated through-flow, intermediary and circulatory modes-of-operation are designed to be largely immune to variations in temperature, pressure, drilling mud type and density, and operating wellbore angle, so allowing it to operate in virtually any environment without any performance degradation.

A potential advantage of the circulating downhole tool utilising a variable fluid pressure regulated cycle valve described here is that its remotely operated through-flow, intermediary and circulatory modes-of-operation are designed for unlimited cycling by variable drilling fluid pressure and flow rate actuation which alleviates the need for multiple balls and ball catchers used by other circulating downhole tools, so reducing invisible-lost time as there are no wasted trips for an exhausted ball catcher.

A potential advantage of the circulating downhole tool utilising a variable fluid pressure regulated cycle valve described here is that it is designed to be Nitrogen and drilling fluid compatible so that either a Nitrogen kick of Nitrogen gas can be delivered to the circulating downhole tool utilising a variable fluid pressure regulated cycle valve via its interconnected coiled tubing from the surface, to the kill fluid of drilling fluid column that has sufficient hydrostatic pressure that may be inhibiting the flow of formation fluids because of it weight to the surface can be forced out, to regain sustained production.

A potential advantage of the circulating downhole tool utilising a variable fluid pressure regulated cycle valve described here is that the high flow rate and high pressure drilling fluid that will be injected into the annulus could be used for wellbore clean-up operations, as the increased annulus drilling fluid flow rate could be accomplished by opening annulus drilling fluid flow paths above small hole internal diameter flow restricting annular sections or large outer diameter borehole assembly string components, which beneficially would allow the maximum volume flow rate of annulus drilling fluid to be directed along the annulus, so boosting the annulus drilling fluid annular velocity whilst lowering the high flow rate and high pressure drilling fluid pump pressure required on the surface.

A potential advantage of the circulating downhole tool utilising a variable fluid pressure regulated cycle valve described here is that it could be used to circulate the kick out of the wellbore in order to ensure that overbalanced drilling is always occurring, where the pressure exerted on the wellbore formation by the drilling fluid, called the bottom hole pressure, is greater than the opposing pressure of the formation fluids, known as the pore pressure, which are less dense than drilling fluid and which can influx as kick into the wellbore if the formation is porous and permeable, so preventing the displacement of the heavier drilling fluid for lighter kick fluids and so preventing dry drilling around the drill bit, so preventing a major blowout as occurred at the Macondo incident in the Gulf of Mexico.

A potential advantage of the circulatory remotely operated mode-of-operation of the circulating downhole tool utilising a variable fluid pressure regulated cycle valve described here is that the high flow rate and high pressure drilling fluid that will be injected into the annulus could also be used to effectively counter loss of circulation, which occurs when the high flow rate and high pressure drilling fluid flows into the wellbore formation instead of returning along the annulus as annulus drilling fluid to the surface, by deploying or spotting remediation the high flow rate and high pressure drilling fluid, known as lost-circulation material LCM, into the wellbore formation.

A potential advantage of the circulatory remotely operated mode-of-operation of the circulating downhole tool utilising a variable fluid pressure regulated cycle valve described here is that the high flow rate and high pressure drilling fluid that will be injected into the annulus could be used for reducing equivalent circulating density (ECD) window considerations at the bottom of the wellbore formation, as having the circulating downhole tool utilising a variable fluid pressure regulated cycle valve device located above the lower BHA, the lower BHA would be by-passed which would reduce the high flow rate and high pressure drilling fluid pump requirements on the surface, which would beneficially increase the high flow rate and high pressure drilling fluid pumps reliability and operating hours.

A potential advantage of the circulatory remotely operated mode-of-operation of the circulating downhole tool utilising a variable fluid pressure regulated cycle valve described here is that the high flow rate and high pressure drilling fluid that will be injected into the annulus could also be used for blowout preventer BOP stack jetting by being used to hydroblast any BOP cavities or subsea wellheads by dislodging debris in the BOP stack.

A potential advantage of the circulatory remotely operated mode-of-operation of the circulating downhole tool utilising a variable fluid pressure regulated cycle valve described here is that the high flow rate and high pressure drilling fluid that will be injected into the annulus could also be used during liner running by being used with auto fill float equipment and so establishing two avenues of high flow rate and high pressure drilling fluid communication between the BHA pipe interior and the annulus, so reducing the surge pressure in the annulus.

A summary of the proposed circulating downhole tool utilising a variable fluid pressure regulated cycle valve is as follows:

The lower sub-assembly tapered outer threaded section of the lower sub-assembly of the circulating downhole tool utilising a variable fluid pressure regulated cycle valve device will need to be interconnected to a lower borehole assembly tapered inner threaded section. The lower borehole assembly tapered inner threaded section could be a section of the lower borehole assembly that could include a drilling bit that will be initially lowered by a drilling platform located on the surface into the wellbore formation.

The upper sub-assembly tapered inner threaded section of the upper sub-assembly of the circulating downhole tool utilising a variable fluid pressure regulated cycle valve device will need to be interconnected to an upper borehole assembly tapered inner threaded section. The upper borehole assembly tapered inner threaded section could be a section of the upper borehole assembly that could include coiled tubing that will be uncoiled and lowered by a drilling platform located on the surface into the wellbore formation.

The drilling fluid pump on a drilling platform located on the surface will pump high flow rate and high pressure drilling fluid into the section of the upper borehole assembly that could include coiled tubing that will be uncoiled and lowered by a drilling platform into the wellbore formation. The high flow rate and high pressure drilling fluid will then rapidly flow into the interconnected upper-assembly of the circulating downhole tool utilising a variable fluid pressure regulated cycle valve device.

The high flow rate and high pressure drilling fluid will flow through the upper sub-assembly lower hole and through the interconnected upper sub-assembly lower flat face countersunk hole, and then flows onto and presses against the cycle valve upper flat face of the cycle valve that is inserted inside the two-part cycle valve sleeve. The cycle valve is longitudinally displaced along the centre-line axis by the longitudinal force of the high flow rate and high pressure drilling fluid that flows onto and presses against the cycle valve upper flat face of the cycle valve. This occurs as the high flow rate and high pressure drilling fluid that flows onto and presses against the cycle valve upper flat face of the cycle valve exceeds a pre-determined drilling fluid flow rate and pressure that exceeds the compression spring compression force characteristics including the spring force constant of the compression spring. This results in the compression of the compression spring, as the compression spring centralising cap that is located inside the cycle valve lower flat face central hole and is pressed against the cycle valve lower flat face central hole flat face, is also longitudinally displaced along the centre-line axis with the cycle valve, towards the second compression spring centralising cap that is inserted into the lower sub-assembly lower channel flat face central hole and which presses against the lower sub-assembly lower channel flat face central hole flat face.

The longitudinally displaced cycle valve lower flat face will now be in-line with the two-part cycle valve sleeve lower half lower flat face and will be pressing against the lower sub-assembly lower channel flat face. The four cycle valve guide pins will also now be pressed against the two-part cycle valve sleeve lower half curved notches located on the two-part cycle valve sleeve lower half upper patterned face.

The four cycle valve truncated cone stoppers are extensions located on the cycle valve lower flat face, and the four cycle valve truncated cone stoppers are also longitudinally displaced along the centre-line axis past the two-part cycle valve sleeve lower half lower flat face. The two-part cycle valve sleeve lower half lower flat face will now be pressed against the lower sub-assembly lower channel flat face.

The four cycle valve truncated cone stoppers are now pressed against and are seated within the lower sub-assembly lower channel flat face countersunk holes and the interconnected lower sub-assembly lower channel holes which blocks the high flow rate and high pressure drilling fluid from flowing through the lower sub-assembly lower channel flat face countersunk holes and the interconnected lower sub-assembly lower channel holes and the interconnected lower sub-assembly inner holes and the interconnected lower sub-assembly threaded nozzles.

However, the high flow rate and high pressure drilling fluid is able to flow freely through the cycle valve upper flat face countersunk holes and the interconnected four cycle valve through holes, as the four cycle valve through holes and the interconnected cycle valve upper flat face countersunk holes are rotationally separated by 45° about the centre-line axis and to the four cycle valve guide pins and the four cycle valve guide pin holes and the four cycle valve truncated cone stoppers. The high flow rate and high pressure drilling fluid is therefore able to flow freely through the four cycle valve through holes and into the in-line lower sub-assembly lower channel flat face countersunk holes located on the lower sub-assembly lower channel flat face of the lower sub-assembly. The high flow rate and high pressure drilling fluid is then able to flow freely into the interconnected lower sub-assembly lower channel holes. The lower sub-assembly lower channel holes are interconnected to and are drilled through the lower sub-assembly lower flat face inner chamfered edge hole cone and into the lower sub-assembly lower flat face inner chamfered edge hole. The high flow rate and high pressure drilling fluid is then able to flow freely into the lower sub-assembly lower flat face inner chamfered edge hole of the lower sub-assembly of the circulating downhole tool utilising a variable fluid pressure regulated cycle valve device.

The lower sub-assembly tapered outer threaded section of the lower sub-assembly will need to be interconnected to a lower borehole assembly tapered inner threaded section. The lower borehole assembly tapered inner threaded section could be a section of the lower borehole assembly that could include a drilling bit that will be initially lowered by a drilling platform located on the surface into the wellbore formation. The high flow rate and high pressure drilling fluid that is able to flow freely into the lower sub-assembly lower flat face inner chamfered edge hole of the lower sub-assembly could then flow into the section of the lower borehole assembly that could include a drilling bit so that the high flow rate and high pressure drilling fluid could be used to keep the drilling bit well lubricated, for example, when operating in an omni-directional wellbore.

When the circulating downhole tool utilising a variable fluid pressure regulated cycle valve device is lowered down the wellbore formation to a pre-determined depth controlled by the operator of the drilling platform, the operator of the drilling fluid pump on the drilling platform can at any time remotely operate a change in the mode-of-operation of the circulating downhole tool utilising a variable fluid pressure regulated cycle valve device, from the through-flow remotely operated mode-of-operation of the circulating downhole tool utilising a variable fluid pressure regulated cycle valve device described previously, to the intermediary remotely operated mode-of-operation of the circulating downhole tool utilising a variable fluid pressure regulated cycle valve device that will be described below.

This may be required when the operator of the drilling platform wants to transition the circulating downhole tool utilising a variable fluid pressure regulated cycle valve device from having the high flow rate and high pressure drilling fluid flowing into the lower sub-assembly lower flat face inner chamfered edge hole to keep the drilling bit well lubricated, for example, to having the high flow rate and high pressure drilling fluid being used for other useful applications.

The intermediary remotely operated mode-of-operation of the circulating downhole tool utilising a variable fluid pressure regulated cycle valve device can be accomplished by momentarily either switching off the drilling fluid pump or decreasing the drilling fluid pump flow rate and pressure to produce low flow rate and low pressure drilling fluid that is below a pre-determined drilling fluid flow rate and pressure that will not exceed the compression spring compression force characteristics including the spring force constant of the compression spring contained within the circulating downhole tool utilising a variable fluid pressure regulated cycle valve device.

The drilling fluid pump on the drilling platform located on the surface will now be pumping low flow rate and low pressure drilling fluid into the section of the upper borehole assembly that could include coiled tubing that will be uncoiled and lowered by a drilling platform into the wellbore formation. The low flow rate and low pressure drilling fluid will then flow into the interconnected upper-assembly of the circulating downhole tool utilising a variable fluid pressure regulated cycle valve device. The low flow rate and low pressure drilling fluid will then flow through the upper sub-assembly lower hole and will flow through the interconnected upper sub-assembly lower flat face countersunk hole, and will then flow onto and will press against the cycle valve upper flat face of the cycle valve that is inserted inside the two-part cycle valve sleeve contained within the circulating downhole tool utilising a variable fluid pressure regulated cycle valve device. This will result in the cycle valve to be longitudinally displaced along the centre-line axis, which initially results in the four cycle valve guide pins to slide along the two-part cycle valve sleeve lower half short flat-sided teeth. This occurs as the low flow rate and low pressure drilling fluid that flows onto and presses against the cycle valve upper flat face of the cycle valve that is inserted inside the two-part cycle valve sleeve, is below a pre-determined drilling fluid flow rate and pressure that will not exceed the compression spring compression force characteristics including the spring force constant of the compression spring. This causes the compression spring to expand and exert a longitudinal force along the centre-line axis of the cycle valve, and results in the compression spring centralising cap that is located inside the cycle valve lower flat face central hole and is pressed against the cycle valve lower flat face central hole flat face, to be longitudinally displaced along the centre-line axis with the cycle valve and away from the second compression spring centralising cap that is inserted into the lower sub-assembly lower channel flat face central hole and which presses against the lower sub-assembly lower channel flat face central hole flat face of the lower sub-assembly.

The four cycle valve guide pins are always constrained to travel within the two-part cycle valve sleeve separation gap between the two-part cycle valve sleeve lower half upper patterned face and the two-part cycle valve sleeve upper half lower patterned face. In-effect, the two-part cycle valve sleeve separation gap acts as a patterned cam groove in which the four cycle valve guide pins are always constrained to travel uni-directionally within when the cycle valve has a longitudinal force applied to it by the expanding compression spring, that results in the cycle valve to be longitudinally displaced and rotated 22.5° in an uni-directional clockwise direction about the centre-line axis of and inside the two-part cycle valve sleeve.

As the cycle valve continues to have a longitudinal force applied to it by the expanding compression spring along the centre-line axis, the four cycle valve guide pins are forced to press against and then slide along the two-part cycle valve sleeve upper half long diagonal flat-sided teeth and towards the two-part cycle valve sleeve upper half curved notches. The sliding action of the four cycle valve guide pins along the two-part cycle valve sleeve upper half long diagonal flat-sided teeth results in the uni-directional 22.5° rotational clock-wise motion of the interconnected cycle valve about the centre-line axis, until the four cycle valve guide pins are stopped by and are pressed against the two-part cycle valve sleeve upper half curved notches. The cycle valve is now longitudinally displaced along the centre-line axis so that the cycle valve lower flat face is longitudinally off-set to the two-part cycle valve sleeve lower half lower flat face, and the cycle valve upper flat face will be resting and pressed against the upper sub-assembly lower flat face of the upper sub-assembly.

The cycle valve and its four cycle valve guide pins and its four cycle valve guide pin holes and its four cycle valve truncated cone stoppers and its four cycle valve through holes and its interconnected cycle valve upper flat face countersunk holes have all been rotationally orientated 22.5° clockwise about the centre-line axis, from the cycle valve and its four cycle valve guide pins and its four cycle valve guide pin holes and its four cycle valve truncated cone stoppers and its four cycle valve through holes and its interconnected cycle valve upper flat face countersunk holes for the through-flow remotely operated mode-of-operation of the circulating downhole tool utilising a variable fluid pressure regulated cycle valve device described previously.

The low flow rate and low pressure drilling fluid is now able to flow freely through the cycle valve upper flat face countersunk holes and the interconnected four cycle valve through holes. The low flow rate and low pressure drilling fluid is also now able to flow freely through the lower sub-assembly lower channel flat face countersunk holes and the interconnected lower sub-assembly lower channel holes and the interconnected lower sub-assembly inner holes and the interconnected lower sub-assembly threaded nozzles. The low flow rate and low pressure drilling fluid is not only radially sprayed out of the lower sub-assembly threaded nozzles and into the annulus but is also able to flow freely through the in-line lower sub-assembly lower channel flat face countersunk holes on the lower sub-assembly lower channel flat face of the lower sub-assembly. The low flow rate and low pressure drilling fluid is then able to flow freely into the interconnected lower sub-assembly lower channel holes and into the lower sub-assembly lower flat face inner chamfered edge hole of the lower sub-assembly.

The lower sub-assembly tapered outer threaded section of the lower sub-assembly of the circulating downhole tool utilising a variable fluid pressure regulated cycle valve device will need to be interconnected to a lower borehole assembly tapered inner threaded section that could include a drilling bit, that will be initially lowered by a drilling platform into the wellbore formation. The low flow rate and low pressure drilling fluid that is able to flow freely into the lower sub-assembly lower flat face inner chamfered edge hole of the lower sub-assembly could then flow into the section of the lower borehole assembly that could include a drilling bit so that the low flow rate and low pressure drilling fluid keeps the drilling bit lubricated, for example.

The circulating downhole tool utilising a variable fluid pressure regulated cycle valve device described previously could be called the intermediary remotely operated mode-of-operation of the circulating downhole tool utilising a variable fluid pressure regulated cycle valve device, where the low flow rate and low pressure drilling fluid is below a pre-determined drilling fluid flow rate and pressure that will not exceed the compression spring compression force characteristics including the spring force constant of the compression spring located within the circulating downhole tool utilising a variable fluid pressure regulated cycle valve device.

When the circulating downhole tool utilising a variable fluid pressure regulated cycle valve device is lowered down the wellbore formation to a pre-determined depth controlled by the operator of the drilling platform, the operator of the drilling fluid pump on the drilling platform can at any time remotely operate and change the mode-of-operation of the circulating downhole tool utilising a variable fluid pressure regulated cycle valve device, from the intermediary remotely operated mode-of-operation of the circulating downhole tool utilising a variable fluid pressure regulated cycle valve device described previously, to the circulatory remotely operated mode-of-operation of the circulating downhole tool utilising a variable fluid pressure regulated cycle valve device, which will be described below.

The circulatory remotely operated mode-of-operation of the circulating downhole tool utilising a variable fluid pressure regulated cycle valve device can be accomplished when the drill fluid pump is switched back on or the drilling fluid pump flow rate and pressure are increased again to produce high flow rate and high pressure drilling fluid that is above a pre-determined drilling fluid flow rate and pressure that will exceed the compression spring compression force characteristics including the spring force constant of the compression spring. The resultant circulatory remotely operated mode-of-operation of the circulating downhole tool utilising a variable fluid pressure regulated cycle valve device can then be used for the other useful applications, which will be described below.

The upper sub-assembly tapered inner threaded section of the upper sub-assembly of the circulating downhole tool utilising a variable fluid pressure regulated cycle valve device will need to be interconnected to an upper borehole assembly tapered inner threaded section. The upper borehole assembly tapered inner threaded section could be a section of the upper borehole assembly that could include coiled tubing, that will be uncoiled and lowered by a drilling platform into the wellbore formation.

The drilling fluid pump on the drilling platform will then be used to pump high flow rate and high pressure drilling fluid into the section of the upper borehole assembly that could include coiled tubing, that will be uncoiled and lowered by a drilling platform into the wellbore formation. The high flow rate and high pressure drilling fluid will then flow rapidly into the interconnected upper-assembly of the circulating downhole tool utilising a variable fluid pressure regulated cycle valve device.

The high flow rate and high pressure drilling fluid will then flow through the upper sub-assembly lower hole and through the interconnected upper sub-assembly lower flat face countersunk hole, and will then flow onto and will press against the cycle valve upper flat face of the cycle valve that is inserted longitudinally inside the two-part cycle valve sleeve. The cycle valve will then be longitudinally displaced along the centre-line axis, which initially results in the four cycle valve guide pins to initially slide along the two-part cycle valve sleeve upper half short flat-sided teeth. This occurs as the high flow rate and high pressure drilling fluid that flows onto and presses against the cycle valve upper flat face of the cycle valve that is inserted longitudinally inside the two-part cycle valve sleeve, exceeds a pre-determined drilling fluid flow rate and pressure that will exceed the compression spring compression force characteristics including the spring force constant of the compression spring. This results in the compression of the compression spring as the compression spring centralising cap that is located inside the cycle valve lower flat face central hole and is pressed against the cycle valve lower flat face central hole flat face, is longitudinally displaced along the centre-line axis with the cycle valve and towards the second compression spring centralising cap, that is inserted into the lower sub-assembly lower channel flat face central hole and which presses against the lower sub-assembly lower channel flat face central hole flat face.

The four cycle valve guide pins are always constrained to travel within the two-part cycle valve sleeve separation gap between the two-part cycle valve sleeve lower half upper patterned face and the two-part cycle valve sleeve upper half lower patterned face. In-effect, the two-part cycle valve sleeve separation gap acts as a patterned cam groove in which the four cycle valve guide pins are always constrained to travel uni-directionally within when the cycle valve has a longitudinal force applied to it by the high flow rate and high pressure drilling fluid, that results in the cycle valve to be longitudinally displaced and rotated 22.5° in an uni-directional clock-wise direction about the centre-line axis of and inside the two-part cycle valve sleeve. As the cycle valve continues to be longitudinally displaced by the longitudinal force applied to it by the high flow rate and high pressure drilling fluid along the centre-line axis, the four cycle valve guide pins are forced to press against and then slide along the two-part cycle valve sleeve lower half long diagonal flat-sided teeth, and towards the two-part cycle valve sleeve lower half curved notches.

The sliding action of the four cycle valve guide pins along the two-part cycle valve sleeve lower half long diagonal flat-sided teeth results in the uni-directional 22.5° rotational clock-wise motion of the interconnected cycle valve about the centre-line axis, until the four cycle valve guide pins are stopped by and are pressed against the two-part cycle valve sleeve lower half curved notches.

It should be noted that the cycle valve is longitudinally displaced along the centre-line axis so that the cycle valve lower flat face is now in-line with the two-part cycle valve sleeve lower half lower flat face. The cycle valve is therefore now in the same longitudinal position along the centre-line axis inside the two-part cycle valve sleeve as the cycle valve described for the through-flow remotely operated mode-of-operation of the circulating downhole tool utilising a variable fluid pressure regulated cycle valve device described previously.

However, the cycle valve and its four cycle valve guide pins and its four cycle valve guide pin holes and its four cycle valve truncated cone stoppers and its four cycle valve through holes and its interconnected cycle valve upper flat face countersunk holes are rotationally orientated 45° clockwise about the centre-line axis, from the cycle valve and its four cycle valve guide pins and its four cycle valve guide pin holes and its four cycle valve truncated cone stoppers and its four cycle valve through holes and its interconnected cycle valve upper flat face countersunk holes described previously for the through-flow remotely operated mode-of-operation of the circulating downhole tool utilising a variable fluid pressure regulated cycle valve device.

The four cycle valve truncated cone stoppers are extensions located on the cycle valve lower flat face which are longitudinally displaced along the centre-line axis and past the two-part cycle valve sleeve lower half lower flat face. The two-part cycle valve sleeve lower half lower flat face is now pressed against the lower sub-assembly lower channel flat face. The four cycle valve truncated cone stoppers are now pressed against and are now seated within the lower sub-assembly lower channel flat face countersunk holes and the interconnected lower sub-assembly lower channel holes, which blocks the high flow rate and high pressure drilling fluid from flowing through the lower sub-assembly lower channel flat face countersunk holes and the interconnected lower sub-assembly lower channel holes. The lower sub-assembly lower channel holes are interconnected to and are drilled through the lower sub-assembly lower flat face inner chamfered edge hole cone and into the lower sub-assembly lower flat face inner chamfered edge hole.

However, the high flow rate and high pressure drilling fluid is now able to flow freely through the cycle valve upper flat face countersunk holes and the interconnected four cycle valve through holes, as the four cycle valve through holes and the interconnected cycle valve upper flat face countersunk holes are rotationally separated by 45° about the centre-line axis and from the four cycle valve guide pins and the four cycle valve guide pin holes and the four cycle valve truncated cone stoppers. The high flow rate and high pressure drilling fluid is then able to flow freely through the four cycle valve through holes and into the in-line lower sub-assembly lower channel flat face countersunk holes on the lower sub-assembly lower channel flat face of the lower sub-assembly and into the interconnected lower sub-assembly lower channel holes and into the interconnected lower sub-assembly inner holes and into the interconnected lower sub-assembly threaded nozzles that are releaseably and securely threaded to the lower sub-assembly tapped intermediary holes. The high flow rate and high pressure drilling fluid is then radially injected from the lower sub-assembly threaded nozzles that are located equidistantly and are rotationally separated by 90° about the centre-line axis to one another around the lower sub-assembly upper outer surface. The high flow rate and high pressure drilling fluid will be radially injected into the annulus and will have the effect of increasing the annular velocity of the annulus drilling fluid, so enhancing the effective cuttings transport removal from the drill bit and returning along the annulus to the surface.

The high flow rate and high pressure drilling fluid that will be radially injected into the annulus could also be used to effectively counter loss of circulation, which occurs when the high flow rate and high pressure drilling fluid flows into the wellbore formation instead of returning along the annulus as annulus drilling fluid to the surface, by deploying or spotting remediation the high flow rate and high pressure drilling fluid, known as lost-circulation material LCM, into the wellbore formation.

The high flow rate and high pressure drilling fluid that will be radially injected into the annulus could also be used for wellbore clean-up operations, as the increased annulus drilling fluid flow rate could be accomplished by opening annulus drilling fluid flow paths above small hole internal diameter flow restricting annular sections or large outer diameter borehole assembly string components, and by bypassing smaller annular sections, which beneficially would allow the maximum volume flow rate of annulus drilling fluid to be directed along the annulus, which would boost the annulus drilling fluid annular velocity for more effective wellbore clean-up above the circulating downhole tool utilising a variable fluid pressure regulated cycle valve device location, whilst beneficially lowering the high flow rate and high pressure drilling fluid pump pressure.

The high flow rate and high pressure drilling fluid that will be injected into the annulus could also be used for reducing equivalent circulating density (ECD) window considerations at the bottom of the wellbore formation, and this could be achieved by using the circulatory remotely operated mode-of-operation of the circulating downhole tool utilising a variable fluid pressure regulated cycle valve device. By having the circulating downhole tool utilising a variable fluid pressure regulated cycle valve device above the lower borehole assembly BHA, the lower BHA would be bypassed which would reduce the high flow rate and high pressure drilling fluid pump requirements, which would beneficially increase the high flow rate and high pressure drilling fluid pumps reliability and operating hours.

The high flow rate and high pressure drilling fluid that will be radially injected into the annulus could also be used for blowout preventer BOP stack jetting, as the circulatory remotely operated mode-of-operation of the circulating downhole tool utilising a variable fluid pressure regulated cycle valve device, would also be beneficial by being used to hydroblast any BOP cavities or subsea wellheads by dislodging debris in the BOP stack.

The high flow rate and high pressure drilling fluid that will be radially injected into the annulus could also be used during liner running, where the circulatory remotely operated mode-of-operation of the circulating downhole tool utilising a variable fluid pressure regulated cycle valve device, would also be beneficial by being used with auto fill float equipment, by establishing two avenues of high flow rate and high pressure drilling fluid communication between the BHA pipe interior and the annulus, so reducing the surge pressure in the annulus.

When the circulating downhole tool utilising a variable fluid pressure regulated cycle valve device is lowered down the wellbore formation to a pre-determined depth controlled by the operator of the drilling platform, the operator of the drilling fluid pump on the drilling platform can at any time remotely operate a change in the mode-of-operation of the circulating downhole tool utilising a variable fluid pressure regulated cycle valve device as frequently as is required.

The bi-directional longitudinal movement and uni-directional 22.5° rotational clock-wise cyclical movement of the cycle valve along the centre-line axis inside the two-part cycle valve sleeve, when a bi-directional longitudinal force produced by either the high flow rate and high pressure drilling fluid or by the expanding compression spring being applied along the centre-line axis of the cycle valve, is designed to be reliably and consistently repeatable for many thousands of cyclical movements of the cycle valve over the life-time of the circulating downhole tool utilising a variable fluid pressure regulated cycle valve device.

In at least one example, there is provided: a circulating downhole tool for selectively diverting fluid to one of: below the circulating downhole tool; or into an annulus between the circulating downhole tool and a wellbore; wherein the tool comprises a cycle valve device that is cyclable utilising a change in pressure above and/or below a pre-determined fluid pressure to trigger the cycle valve device to vary fluid flow diversion cyclically between below the tool or the annulus; and wherein the tool is configured to be remotely operated from surface by an operator to allow selective and unlimited activation of the tool without having to be tripped or pulled out of the wellbore. The tool may be configured to selectively open and close one or more side ports by a rotational movement, the rotational movement being responsive to a longitudinal movement of at least a portion of the tool, the longitudinal movement being associated with or triggered by a change in fluid flow or pressure, such as by turning on or off a pump.

The cycle valve device may comprise a variable fluid pressure regulated cycle valve device with a continuous circumferential patterned cam groove for cyclical relativerotation in response to cyclical longitudinal movement, the cyclical relative rotation configured to cause a cyclic opening and closing of one or more side ports thereby allowing the tool to be endlessly cyclable between configurations for diverting fluid respectively into either below the circulating tool or the annulus.

The patterned cam groove may be unidirectional such that the relative rotation is in a single direction, such as a clock-wise direction. The rotational movement may be configured to divert fluid through either the one or more side ports or through a throughbore to below the circulating tool according to a rotational position of the portion of the tool.

The tool may be configured to be cycled between three modes of operation: a through-flow mode of operation whereby all fluid is diverted to below the circulating tool; a circulatory mode of operation whereby all fluid is diverted to the annulus; and an intermediary mode of operation whereby a portion of fluid flow is diverted to below the circulating tool and a portion of fluid flow is simultaneously diverted to the annulus. The tool may comprise a longitudinal length of less than 50 cm; optionally 30 cm or less; optionally 25 cm or less; optionally 20 cm or less. In at least some examples, a range or array of tools of different lengths may be provided; such as of 20 cm and/or 24 cm and/or 30 cm. The outer diameter may vary, such as directly, with the length. For example, a 20 cm tool may comprise an outer diameter of 4.3 cm; and/or a 30 cm tool may comprise an outer diameter of 7.3 cm.

The tool may be configured to operate above milling or jetting tools in a Bottom Hole Assembly.

The tool may be configured to be cycled to a configuration whereby fluid flow is prevented, both to the annulus and to below the circulating tool.

The tool may comprise a maximised internal diameter to enable maximum drilling fluid velocity and/or turbulent flow in the annulus for more efficient drilling debris removal to the surface when operating in the circulatory mode-of-operation. The maximum flow area may comprise 0.71 cm2 or more; optionally 1.23 cm2 or more; optionally 2.84 cm2 or more. The maximum flow area may be related, such as directly, to the outer diameter and/or the length.

The tool may be configured to be immune to variations in temperature, pressure, drilling mud type and density, and operating wellbore angle.

The tool may be configured to be operable and/or activatable by a fluid selected from one or more of: a drilling fluid; nitrogen; an injection fluid; a stimulation fluid; and an acid.

The tool may be designed to be Nitrogen and drilling fluid compatible so that either can be delivered to the circulating downhole tool.

There is also disclosed a downhole assembly comprising the tool of any example, embodiment, claim, aspect.

The downhole assembly may comprise a toolstring with the tool and at least a portion of coiled tubing and/or at least a portion of jointed pipe, such as in a drill-string.

In at least one example, there is disclosed a method of selectively circulating fluid downhole, the method comprising:

- diverting fluid to one of: below the circulating downhole tool; or into an annulus between the circulating downhole tool and a wellbore;
- remotely operating a downhole circulating tool from surface by an operator without the tool having to be tripped or pulled out of the wellbore;
- changing a fluid pressure to above and/or below a predetermined fluid pressure to remotely operate a cycle valve device of the tool to selectively divert fluid to the other of below the circulating downhole or into the annulus;
- varying fluid flow diversion cyclically between below the tool and the annulus;
- wherein the method comprises the unlimited activation of the tool.

The method may comprise a coiled tubing operation and/or an operation with jointed pipe, such as a drill string.

The method may comprise rotational moving at least a portion of the tool in response to a longitudinal movement, the longitudinal movement being associated with or triggered by the changing of the fluid pressure.

The method may comprise one or more of: diverse spotting remediation fluid operations; drilling operations; wellbore clean-up operations; blowout preventer (BOP) stack jetting operations; surge pressure reduction, and/or unloading a wellbore with Nitrogen gas.

The method may comprise a kick out of the wellbore in order to ensure that overbalanced drilling is always occurring.

The method may comprise countering loss of circulation.

The method may comprise reducing equivalent circulating density (ECD) window considerations at a bottom of the wellbore formation.

The method may comprise hydroblasting a BOP cavity and/or or a subsea wellhead.

The method may comprise liner running and/or use with auto fill float equipment; and optionally establishing two avenues of high flow rate and high pressure drilling fluid communication between a BHA pipe interior and the annulus; such as to reduce surge pressure in the annulus.

The method may comprise delivering Nitrogen gas to the circulating downhole tool.

In at least one example, there is provided a circulating downhole tool utilising a variable fluid pressure regulated cycle valve device that can be attached to the borehole assembly BHA of a coiled tubing and used down an offshore or onshore wellbore.

The circulating downhole tool utilising a variable fluid pressure regulated cycle valve device may be remotely operated by an operator on the surface as many times as required in either the through-flow, intermediary or circulatory modes-of-operation, by simply varying the drilling fluid flow rate and pressure being supplied from the pump located on the surface and interconnected to the coiled tubing and the BHA that will include the circulating downhole tool utilising a variable fluid pressure regulated cycle valve device.

The circulating downhole tool utilising a variable fluid pressure regulated cycle valve device may be short and compact in design, and may be designed to be rapid and simple to operate at any operating angle design, and operate in either the through-flow or intermediary or circulatory modes-of-operation within the wellbore that does not require circulating downhole tripping from the wellbore, so minimising non-production time NPT and associated operating costs to the operator, whilst being able to divert drilling fluid to the BHA tools below it or into the annulus between the BHA and the wellbore and back to the surface when required for diverse operations including: spotting remediation fluid operations, for drilling operations, for wellbore clean-up operations, for blowout preventer BOP stack jetting operations for surge pressure reduction, and for unloading a wellbore with Nitrogen gas known as unloading a well operation.

Non-limiting examples of the present disclosure are described in the clauses below, noting that the scope of protection is not hereby limited; reference therefor being made to the claims appended to the end of this document:

CLAUSES

1. A circulating downhole tool utilising a variable fluid pressure regulated cycle valve device comprising a lower sub-assembly that has an internal keyway slot, a compression spring that interconnects the lower sub-assembly to the cycle valve, a cycle valve that has four cycle valve guide pins that are equi-distantly and rotationally separated by 90° and are inserted around the cycle valve outer surface and are constrained to travel within the two-part cycle valve sleeve, a two-part cycle valve sleeve whose two-part cycle valve sleeve separation gap between the two-part cycle valve sleeve lower half upper patterned face and the two-part cycle valve sleeve upper half lower patterned face acts as a patterned cam groove in which the four cycle valve guide pins are constrained to travel uni-directionally within when the cycle valve has a longitudinal force applied to it either by the expanding compression spring or by variable pressure and variable flow rate fluid injected onto the cycle valve, a variable pressure and variable flow rate fluid supply whose variation above and below a pre-determined pressure set by the compression spring results in the cycle valve to be longitudinally displaced bi-directionally and rotated 22.5° in cyclical steps in an uni-directional clock-wise direction about the centre-line axis of and inside the two-part cycle valve sleeve, a cycle valve whose cyclical stepped 22.5° rotational orientation within the lower sub-assembly results in either a through-flow or an intermediary or a circulatory remotely operated mode-of-operation, a two-part cycle valve sleeve that has a keyway that is fitted into the internal keyway slot of the lower sub-assembly, an upper sub-assembly that is interconnected to the lower sub-assembly.
2. The circulating downhole tool utilising a variable fluid pressure regulated cycle valve device according to clause 1, wherein the lower sub-assembly has a lower sub-assembly tapered outer threaded section that can be interconnected to a lower borehole assembly tapered inner threaded section that could include a drilling bit that will be initially lowered by a drilling platform into the wellbore formation, a lower sub-assembly stepped upper outer surface that has a lower sub-assembly O-ring channel that houses the lower sub-assembly O-ring that provides a fluid-tight seal when the lower sub-assembly is interconnected to other borehole assembly equipment, four lower sub-assembly threaded nozzles that are located equidistantly and are rotationally separated by 90° about the centre-line axis to one another around the lower sub-assembly upper outer surface, a lower sub-assembly upper flat face inner chamfered edge tapped hole, a lower sub-assembly upper hole, a lower sub-assembly middle hole, a lower sub-assembly lower hole, a lower sub-assembly lower channel that has a lower sub-assembly lower channel flat face and a lower sub-assembly keyway slot that extends from the lower sub-assembly upper hole to the lower sub-assembly lower channel, a lower sub-assembly lower channel flat face that has eight equidistantly rotationally separated by 45° lower sub-assembly lower channel holes that are off-set from the centre-line axis, and where four of the lower sub-assembly lower channel holes are interconnected to lower sub-assembly inner holes and to the four lower sub-assembly threaded nozzles, and where four of the lower sub-assembly lower channel holes are interconnected to the lower sub-assembly lower flat face inner chamfered edge hole cone and the lower sub-assembly lower flat face inner chamfered edge hole, and located centrally on the lower sub-assembly lower channel flat face and located on the centre-line axis of the lower sub-assembly is the lower sub-assembly lower channel flat face central hole that has a lower sub-assembly lower channel flat face central hole flat face, a lower sub-assembly tapered outer threaded section of the lower sub-assembly that can be interconnected to a lower borehole assembly tapered inner threaded section of a section of the lower borehole assembly that could include a drilling bit.
3. The circulating downhole tool utilising a variable fluid pressure regulated cycle valve device according to clause 1, wherein the two-part cycle valve sleeve has a hollow cylindrical two-part cycle valve sleeve lower half that has a two-part cycle valve sleeve lower half keyway on the two-part cycle valve sleeve lower half outer surface that is designed to slide tightly and smoothly along the lower sub-assembly keyway slot until the two-part cycle valve sleeve lower half makes contact with the lower sub-assembly lower channel flat face of the lower sub-assembly, and a two-part cycle valve sleeve lower half upper patterned face that has an eight curved notches and eight three-flat-sided teeth pattern, and a hollow cylindrical two-part cycle valve sleeve upper half that is stepped and has a two-part cycle valve sleeve upper half keyway on the two-part cycle valve sleeve upper half stepped outer surface that is designed to slide tightly and smoothly along the lower sub-assembly keyway slot until the step of the two-part cycle valve sleeve upper half makes contact with the lower flat face of the lower sub-assembly middle hole, and a two-part cycle valve sleeve upper half lower patterned face that has an eight curved notches and eight three-flat-sided teeth pattern.

4. The circulating downhole tool utilising a variable fluid pressure regulated cycle valve device according to clause 3, wherein the eight curved notches and eight three-flat-sided teeth pattern on the two-part cycle valve sleeve upper half lower patterned face are the mirror-image of and are circumferentially rotationally clock-wise off-set by 22.5° to the eight curved notches and eight three-flat-sided teeth pattern on the two-part cycle valve sleeve lower half upper patterned face.

5. The circulating downhole tool utilising a variable fluid pressure regulated cycle valve device according to clause 4, wherein the eight curved notches and eight three-flat-sided teeth pattern on the two-part cycle valve sleeve upper half lower patterned face have two-part cycle valve sleeve upper half curved notches, and two-part cycle valve sleeve upper half short flat-sided teeth, and two-part cycle valve sleeve upper half long diagonal flat-sided teeth, and two-part cycle valve sleeve upper half apex of the flat-sided teeth, and two-part cycle valve sleeve upper half short diagonal flat-sided teeth.

6. The circulating downhole tool utilising a variable fluid pressure regulated cycle valve device according to clause 4, wherein the eight curved notches and eight three-flat-sided teeth pattern on the two-part cycle valve sleeve lower half upper patterned face have two-part cycle valve sleeve lower half curved notches, and two-part cycle valve sleeve lower half short flat-sided teeth, and two-part cycle valve sleeve lower half short diagonal flat-sided teeth, and two-part cycle valve sleeve lower half apex of the flat-sided teeth, and two-part cycle valve sleeve lower half long diagonal flat-sided teeth.

7. The circulating downhole tool utilising a variable fluid pressure regulated cycle valve device according to clause 3, wherein the two-part cycle valve sleeve lower half keyway and the two-part cycle valve sleeve upper half keyway are both designed to ensure that the two-part cycle valve sleeve are accurately aligned with one another and will not rotate when being operated and supplied with variable pressure and variable flow rate drilling fluid.

8. The circulating downhole tool utilising a variable fluid pressure regulated cycle valve device according to any of the preceding clauses, wherein the cycle valve outer surface outer diameter is slightly less than the internal diameter of the two-part cycle valve sleeve lower half inner surface and the two-part cycle valve sleeve upper half inner surface, to ensure that the cycle valve will be able to smoothly rotate and move longitudinally within and along the centre-line axis of the two-part cycle valve sleeve when when being operated and supplied with variable pressure and variable flow rate drilling fluid.

9. The circulating downhole tool utilising a variable fluid pressure regulated cycle valve device according to any of the preceding clauses, wherein the two-part cycle valve sleeve separation gap between the two-part cycle valve sleeve lower half upper patterned face and the two-part cycle valve sleeve upper half lower patterned face is slightly wider than the outer diameter of the four cycle valve guide pins to allow the free movement of the four cycle valve guide pins that are constrained to travel uni-directionally within the two-part cycle valve sleeve separation gap.

10. The circulating downhole tool utilising a variable fluid pressure regulated cycle valve device according to any of the preceding clauses, wherein the cylindrical cycle valve has a cycle valve upper flat surface, and a smooth cycle valve outer surface and a cycle valve lower flat face that has a cycle valve lower flat face central hole located centrally about the centre-line axis of the cycle valve lower flat face, and four cycle valve truncated cone stoppers are extensions located on the on the cycle valve lower flat face and which are rotationally separated by 90° to one another and which are located on a pitch circle diameter that is equi-distant between the cycle valve lower flat face central hole and the smooth cycle valve outer surface, and four cycle valve holes and four cycle valve through holes interconnect the cycle valve lower flat face to the cycle valve upper flat face and are rotationally separated by 90° to one another and are rotationally separated by 45° to the four cycle valve truncated cone stoppers and are located on the same pitch circle diameter as the four cycle valve truncated cone stoppers, and four cycle valve guide pin holes are drilled into the cycle valve outer surface until the pointed ends of the four cycle valve guide pin holes are close to but do not penetrate through to the cycle valve lower flat face central hole, and the four cycle valve guide pin holes are drilled into the cycle valve outer surface at a distance that is closer to the cycle valve lower flat face than to the cycle valve upper flat face and are rotationally separated by 90° to one another and are orientated in-line with the four cycle valve truncated cone stoppers, and four cycle valve guide pins are securely press-fitted into the four cycle valve guide pin holes.

11. The circulating downhole tool utilising a variable fluid pressure regulated cycle valve device according to any of the preceding clauses, wherein when the circulating downhole tool utilising a variable fluid pressure regulated cycle valve device is lowered down a wellbore formation to a pre-determined depth controlled by the operator of the drilling platform, and the operator of the drilling fluid pump on the drilling platform can at any time remotely operate a change in the mode-of-operation of the circulating downhole tool utilising a variable fluid pressure regulated cycle valve device when the drilling fluid pressure being supplied to the circulating downhole tool utilising a variable fluid pressure regulated cycle valve device is varied.

12. The circulating downhole tool utilising a variable fluid pressure regulated cycle valve device according to any of the preceding clauses, wherein the through-flow remotely operated mode-of-operation of the circulating downhole tool utilising a variable fluid pressure regulated cycle valve device can be accomplished by switching on the drilling fluid pump or increasing the drilling fluid pump flow rate and pressure to produce the high flow rate and high pressure drilling fluid that exceeds a pre-determined drilling fluid flow rate and pressure that compresses the compression spring and results in the cycle valve being longitudinally displaced and rotated 22.5° in a uni-directional clock-wise direction until the four cycle valve guide pins are stopped by and are pressed against the two-part cycle valve sleeve lower half curved notches, and the cycle valve and its four cycle valve truncated cone stoppers are longitudinally displaced along the centre-line axis and are pressed against and are seated within the lower sub-assembly lower channel flat face countersunk holes and the lower sub-assembly lower channel holes which blocks the high flow rate and high pressure drilling fluid from flowing through into lower sub-assembly threaded nozzles, but the high flow rate and high pressure drilling fluid is able to flow through into the lower sub-assembly that could be interconnected to a lower borehole assembly that could include a drilling bit that would be kept well lubricated, for example.

13. The circulating downhole tool utilising a variable fluid pressure regulated cycle valve device according to any of the preceding clauses, wherein the intermediary remotely operated mode-of-operation of the circulating downhole tool utilising a variable fluid pressure regulated cycle valve device can be accomplished by the operator by momentarily either switching off the drilling fluid pump or decreasing the drilling fluid pump flow rate and pressure to produce low flow rate and low pressure drilling fluid that does not exceed a predetermined drilling fluid flow rate and pressure that results in the compression spring to expand and results in the cycle valve being longitudinally displaced and rotated 22.5° in a uni-directional clock-wise direction until the four cycle valve guide pins are stopped by and are pressed against the two-part cycle valve sleeve upper half curved notches, and the low flow rate and low pressure drilling fluid is radially sprayed out of the lower sub-assembly threaded nozzles and into the annulus as well as flowing into the lower sub-assembly and could then flow into the section of the lower borehole assembly that could include a drilling bit so that the low flow rate and low pressure drilling fluid keeps the drilling bit lubricated for example.

14. The circulating downhole tool utilising a variable fluid pressure regulated cycle valve device according to any of the preceding clauses, wherein the circulatory remotely operated mode-of-operation of the circulating downhole tool utilising a variable fluid pressure regulated cycle valve device can be accomplished by switching on again the drilling fluid pump or increasing the drilling fluid pump flow rate and pressure to produce the high flow rate and high pressure drilling fluid, that exceeds a pre-determined drilling fluid flow rate and pressure that results in the compression of the compression spring and results in the cycle valve being longitudinally displaced and rotated 22.5° in a uni-directional clock-wise direction until the four cycle valve guide pins are stopped by and are pressed against the two-part cycle valve sleeve lower half curved notches, and the four cycle valve truncated cone stoppers are pressed against and are seated within the lower sub-assembly lower channel flat face countersunk holes and the interconnected lower sub-assembly lower channel holes which blocks the high flow rate and high pressure drilling fluid from flowing through into the lower sub-assembly lower flat face inner chamfered edge hole, but the high flow rate and high pressure drilling fluid is able to flow freely through into the lower sub-assembly threaded nozzles.

15. The circulating downhole tool utilising a variable fluid pressure regulated cycle valve device according to clause 14, wherein the circulatory remotely operated mode-of-operation of the circulating downhole tool utilising a variable fluid pressure regulated cycle valve device that produces a high flow rate and high pressure drilling fluid to be ejected radially from the lower sub-assembly threaded nozzles that are located equidistantly and are rotationally separated by 90° about the centre-line axis to one another around the lower sub-assembly upper outer surface, and injected into the annulus will have the effect of increasing the annular velocity of the annulus drilling fluid so enhancing the effective cuttings transport removal from the drill bit and returning along the annulus to the surface, and be used to effectively counter loss of circulation by deploying or spotting remediation the high flow rate and high pressure drilling fluid known as lost-circulation material LCM into the wellbore formation, and be used to boost the annulus drilling fluid annular velocity for more effective wellbore clean-up, and could also be used for reducing equivalent circulating density (ECD) window considerations at the bottom of the wellbore formation, and be used for blowout preventer BOP stack jetting, and could also be used during liner running by establishing two avenues of high flow rate and high pressure drilling fluid communication between the BHA pipe interior and the annulus so reducing the surge pressure in the annulus.

16. The circulating downhole tool utilising a variable fluid pressure regulated cycle valve device according to any of the preceding clauses, wherein the bi-directional longitudinal movement and uni-directional 22.5° rotational clock-wise cyclical movement of the cycle valve along the centre-line axis and inside the two-part cycle valve sleeve is produced when a bi-directional longitudinal force produced by either the high flow rate and high pressure drilling fluid for the through-flow remotely operated mode-of-operation, or by either the expanding compression spring for the intermediary remotely operated mode-of-operation, or by the high flow rate and high pressure drilling fluid for the circulatory remotely operated mode-of-operation, is applied along the centre-line axis of the cycle valve, and is designed to be repeatable for as many times as required by the operator.

17. The circulating downhole tool utilising a variable fluid pressure regulated cycle valve device according to any of the preceding clauses, wherein the bi-directional longitudinal movement and uni-directional 22.5° rotational clock-wise cyclical movement inside the two-part cycle valve sleeve will occur due to the eight curved notches and eight three-flat-sided teeth pattern on the two-part cycle valve sleeve upper half lower patterned face, which are the mirror-image of and are circumferentially rotationally clock-wise off-set by 22.5° to the elongated circumferential side view of the eight curved notches and eight three-flat-sided teeth pattern on the two-part cycle valve sleeve lower half upper patterned face, and the four cycle valve guide pins are constrained to travel within the two-part cycle valve sleeve separation gap between the two-part cycle valve sleeve lower half upper patterned face and the two-part cycle valve sleeve upper half lower patterned face.

18. The circulating downhole tool utilising a variable fluid pressure regulated cycle valve device according to any of the preceding clauses, wherein the two-part cycle valve sleeve separation gap acts as a patterned cam groove in which the four cycle valve guide pins are constrained to travel uni-directionally within, when a bi-directional longitudinal force produced by either the high flow rate and high pressure drilling fluid for the through-flow remotely operated mode-of-operation, or by the expanding compression spring for the intermediary remotely operated mode-of-operation, or by the high flow rate and high pressure drilling fluid for the circulatory remotely operated mode-of-operation, is applied along the centre-line axis of the cycle valve.

19. The circulating downhole tool utilising a variable fluid pressure regulated cycle valve device according to any of the preceding clauses, wherein the hollow cylindrical upper sub-assembly has an upper sub-assembly lower flat face that is interconnected to the upper sub-assembly lower outer surface that has an upper sub-assembly O-ring channel that houses an upper sub-assembly O-ring that provides a fluid-tight seal when the upper sub-assembly is interconnected to the lower sub-assembly by screwing the upper sub-assembly parallel outer threaded section into the lower sub-assembly upper flat face inner chamfered edge tapped hole, and the upper sub-assembly parallel outer threaded section is interconnected to the upper sub-assembly upper outer surface that is interconnected to the upper sub-assembly upper flat face that is interconnected to the upper sub-assembly upper hole that is located centrally about the centre-line axis of the upper sub-assembly and is interconnected to the upper sub-assembly tapered inner threaded section that is interconnected to the upper sub-assembly intermediary hole that is interconnected to the upper sub-assembly intermediary countersunk hole that is interconnected to the upper sub-assembly lower hole that is interconnected to the upper sub-assembly lower flat face countersunk hole that is located centrally about the centre-line axis of the upper sub-assembly.

20. The circulating downhole tool utilising a variable fluid pressure regulated cycle valve device device according to any of the preceding clauses, wherein the upper sub-assembly tapered inner threaded section of the upper sub-assembly can be interconnected to an upper borehole assembly tapered inner threaded section that could be a section of the upper borehole assembly that could include coiled tubing that will be uncoiled and lowered by a drilling platform into the wellbore formation that will have variable flow rate and variable pressure drilling fluid pumped into it by an interconnected drilling fluid pump on the onshore or offshore drilling platform.

BRIEF DESCRIPTION OF THE DRAWINGS

The proposed invention will now be described in greater detail with reference to the accompanying drawings.

DETAILED DESCRIPTION

Figure 1:
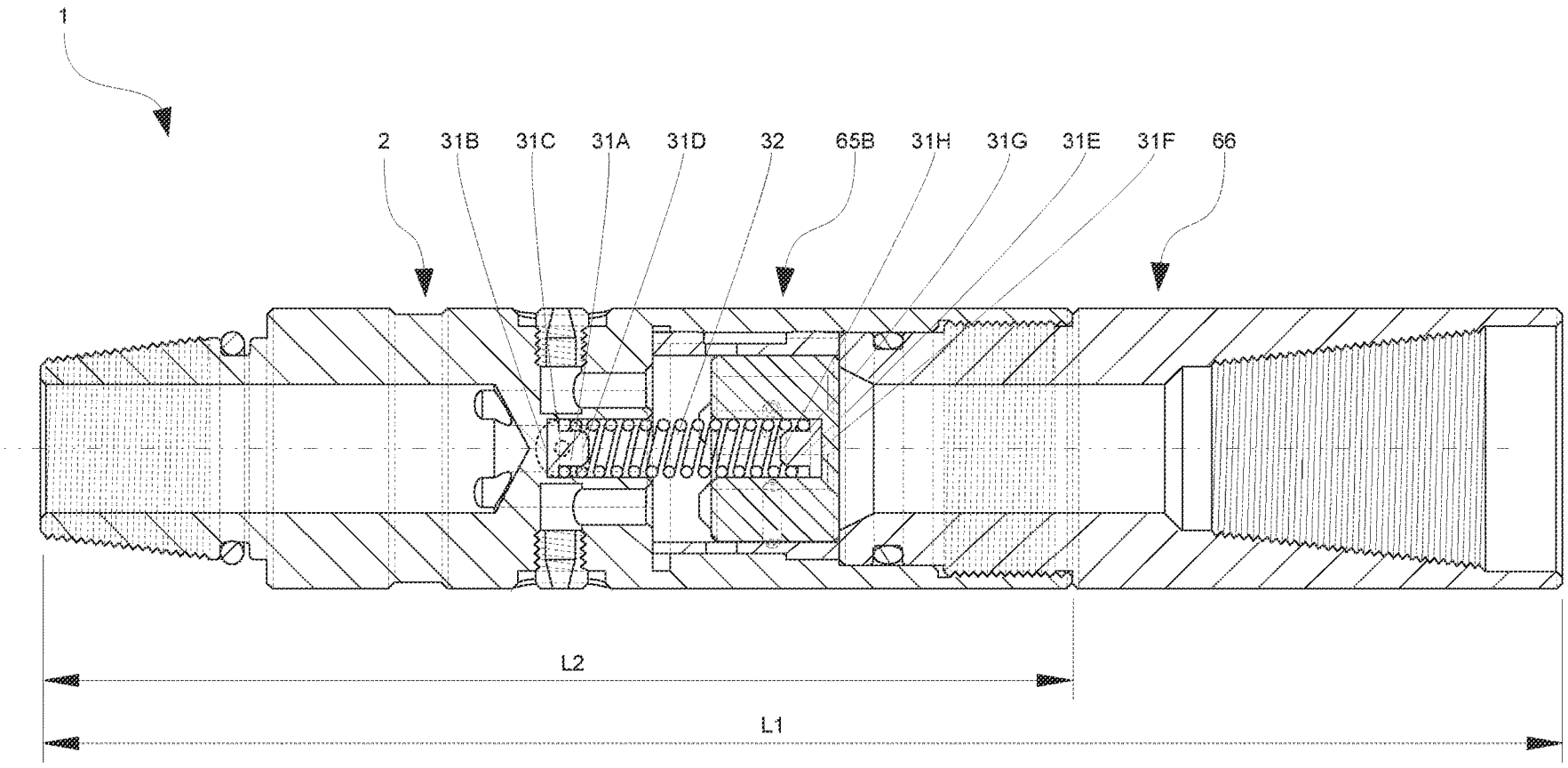
FIG. 1—Cross-sectional side view of the circulating downhole tool utilising a variable fluid pressure regulated cycle valve device.

The cross-sectional side view of the circulating downhole tool utilising a variable fluid pressure regulated cycle valve device 1 is shown in FIG. 1.

Figure 2:
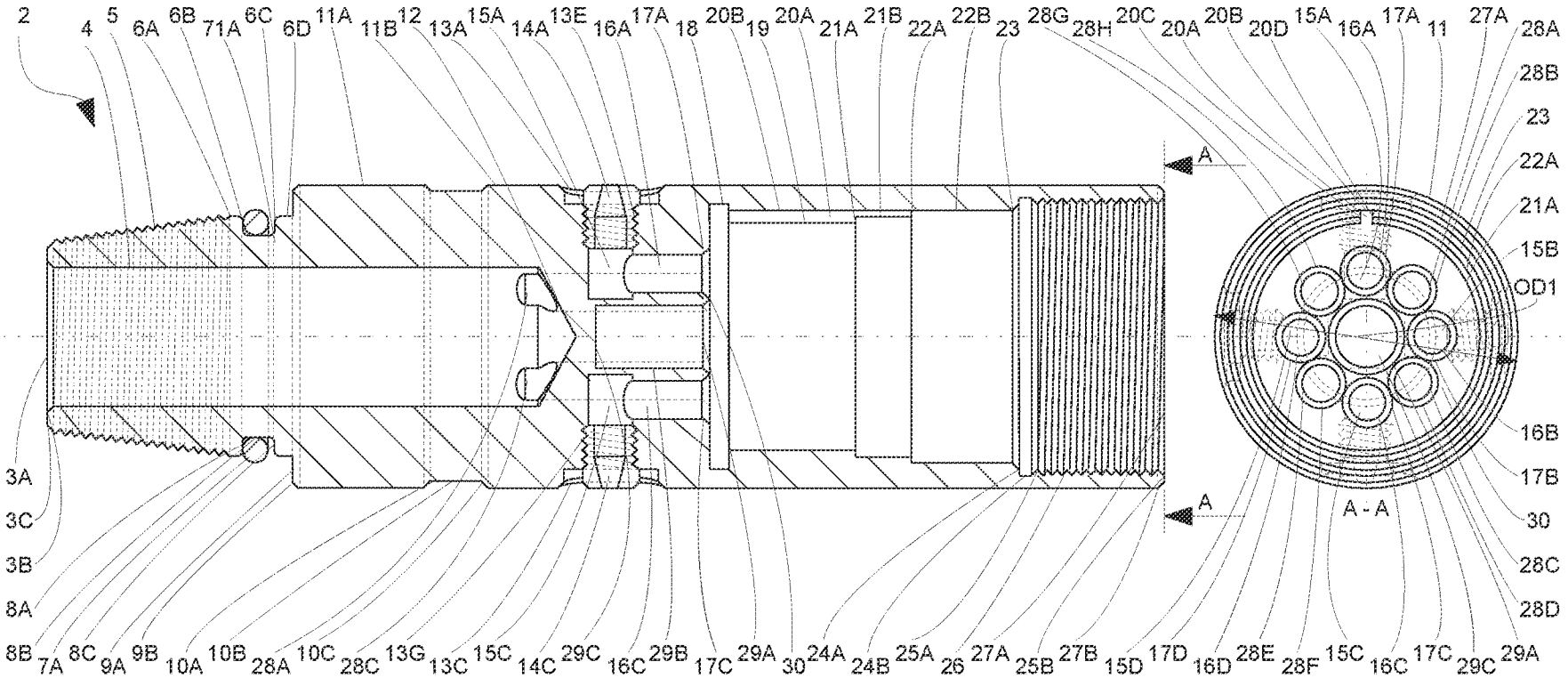
FIG. 2—Cross-sectional side view and lower end view A-A of the lower sub-assembly of the circulating downhole tool utilising a variable fluid pressure regulated cycle valve device shown in FIG. 1.

The cross-sectional side view and lower end view A-A of the lower sub-assembly 2 of the circulating downhole tool utilising a variable fluid pressure regulated cycle valve device 1 is shown in FIG. 2.

The lower sub-assembly 2 of the circulating downhole tool utilising a variable fluid pressure regulated cycle valve device 1, has a lower sub-assembly lower flat face 3A. The lower sub-assembly lower flat face 3A has a lower sub-assembly lower flat face inner chamfered edge 3B and a lower sub-assembly lower flat face outer chamfered edge 3C.

The lower sub-assembly 2 of the circulating downhole tool utilising a variable fluid pressure regulated cycle valve device 1 has a lower sub-assembly lower flat face inner chamfered edge hole 4 that is located centrally about the centre-line axis of the lower sub-assembly 2 of the circulating downhole tool utilising a variable fluid pressure regulated cycle valve device 1. The lower sub-assembly lower flat face inner chamfered edge hole 4 interconnects the lower sub-assembly lower flat face inner chamfered edge 3B to the lower sub-assembly lower flat face inner chamfered edge hole cone 12.

The lower sub-assembly tapered outer threaded section 5 interconnects the lower sub-assembly lower flat face outer chamfered edge 3C to the lower sub-assembly stepped lower outer surface 6A. The lower sub-assembly stepped lower outer surface 6A has a lower sub-assembly stepped lower outer surface radiused upper edge 6B. The lower sub-assembly stepped lower outer surface radiused upper edge 6B is interconnected to the lower sub-assembly O-ring channel radiused lower edge 8A. The lower sub-assembly O-ring channel radiused lower edge 8A is interconnected to the lower sub-assembly O-ring channel 8B. The lower sub-assembly O-ring channel 8B is interconnected to the lower sub-assembly O-ring channel radiused upper edge 8C. The lower sub-assembly O-ring channel radiused upper edge 8C is interconnected to the lower sub-assembly stepped upper outer surface radiused upper edge 6C. The lower sub-assembly stepped upper outer surface radiused upper edge 6C is interconnected to the lower sub-assembly stepped upper outer surface 6D. A lower sub-assembly O-ring 7A is located within the lower sub assembly O-ring channel 8B, as shown in FIG. 2. A lower sub-assembly O-ring gap 71A exists between the lower sub-assembly O-ring 7A and the lower sub-assembly O-ring channel radiused upper edge 8C to allow for the deformation of the lower sub-assembly O-ring 7A when the lower sub-assembly 2 is interconnected to other borehole assembly equipment, not shown in FIG. 2.

The lower sub-assembly stepped flat face 9A is perpendicular to the lower sub-assembly stepped upper outer surface 6D. The lower sub-assembly stepped flat face outer chamfered edge 9B interconnects the lower sub-assembly stepped flat face 9A to the lower sub-assembly lower outer surface 11A. The lower sub-assembly lower outer surface 11A is shown in FIG. 2 to be connected to the lower sub-assembly intermediary outer surface lower chamfered edge 10A. The lower sub-assembly intermediary outer surface 10B interconnects the lower sub-assembly intermediary outer surface lower chamfered edge 10A and the lower sub-assembly intermediary outer surface upper chamfered edge 10C. The lower sub-assembly intermediary outer surface upper chamfered edge 10C is interconnected to the lower sub-assembly upper flat face outer chamfered edge 27B by the lower sub-assembly upper outer surface 11B, as shown in FIG. 2.

The lower sub-assembly circular stepped outer holes 13A, 13B, 13C, 13D are located equidistantly and are rotationally separated by 90° about the centre-line axis to one another around the lower sub-assembly upper outer surface 11B, as shown in FIG. 2. The lower sub-assembly circular stepped holes 13A, 13B, 13C, 13D are interconnected to lower sub-assembly tapped intermediary holes 13E, 13F, 13G, 13H, respectively.

The lower sub-assembly tapped intermediary holes 13E, 13F, 13G, 13H are interconnected to lower sub-assembly inner holes 15A, 15B, 15C, 15D, respectively, as shown in FIG. 2. Lower sub-assembly threaded nozzles 14A, 14B, 14C, 14D are releaseably and securely threaded to the lower sub-assembly tapped intermediary holes 13E, 13F, 13G, 13H, respectively.

The lower sub-assembly lower flat face inner chamfered edge hole 4, and the lower sub-assembly stepped lower outer surface 6A, and the lower sub-assembly stepped upper outer surface 6D, and the lower sub-assembly O-ring channel 8B, and the lower sub-assembly intermediary outer surface 10B, and the lower sub-assembly lower outer surface 11A, and the lower sub-assembly upper outer surface 11B, are all parallel to one another and to the centre-line axis of the lower sub-assembly 2, as shown in FIG. 2.

The lower sub-assembly upper flat face 27A has a lower sub-assembly upper flat face outer chamfered edge 27B and a lower sub-assembly upper flat face inner chamfered edge 25B. The lower sub-assembly upper flat face inner chamfered edge tapped hole 26 interconnects the lower sub-assembly upper flat face inner chamfered edge 25B and the lower sub-assembly upper channel inner chamfered edge 25A. The lower sub-assembly upper flat face inner chamfered edge tapped hole 26 is located centrally about the centre-line axis of the lower sub-assembly 2, as shown in FIG. 2. The lower sub-assembly 2 has a lower sub-assembly upper channel 24B that is interconnected to the lower sub-assembly upper channel inner chamfered edge 25A. The lower sub-assembly upper channel 24B has a lower sub-assembly upper channel lower flat face 24A that is interconnected to the lower sub-assembly upper channel lower flat face inner chamfered edge 23, as shown in FIG. 2. The lower sub-assembly upper channel lower flat face inner chamfered edge 23 is interconnected to the lower sub-assembly upper hole 22B. The lower sub-assembly upper hole 22B is located centrally about the centre-line axis of the lower sub-assembly 2, as shown in FIG. 2. The lower sub-assembly upper hole 22B has a lower sub-assembly upper hole lower flat face 22A. The lower sub-assembly upper hole lower flat face 22A is interconnected to the lower sub-assembly middle hole 21B. The lower sub-assembly middle hole 21B is located centrally about the centre-line axis of the lower sub-assembly 2, as shown in FIG. 2. The lower sub-assembly middle hole 21B has a lower sub-assembly middle hole lower flat face 21A. The lower sub-assembly middle hole lower flat face 21A is interconnected to the lower sub-assembly lower hole 19. The lower sub-assembly lower hole 19 is located centrally about the centre-line axis of the lower sub-assembly 2, as shown in FIG. 2. The lower sub-assembly lower hole 19 is interconnected to the lower sub-assembly lower channel 18. The lower sub-assembly lower channel 18 is located centrally about the centre-line axis of the lower sub-assembly 2, as shown in FIG. 2. The lower sub-assembly lower channel 18 has a lower sub-assembly lower channel flat face 30.

The lower sub-assembly keyway slot 20A is shown in FIG. 2 to have a lower sub-assembly keyway slot outer flat face 20B that is offset from the centre-line axis of the lower sub-assembly 2, as shown in FIG. 2, equal to the radius of the lower sub-assembly upper hole 22B. The lower sub-assembly keyway slot 20A extends from the lower sub-assembly upper hole lower flat face 22A to the lower sub-assembly lower channel 18. The lower sub-assembly keyway slot 20A has lower sub-assembly keyway slot flat side walls 20C, 20D, as shown in the end view A-A of the lower sub-assembly 2, in FIG. 2.

The end view A-A of the lower sub-assembly 2, as shown in FIG. 2, also shows that the lower sub-assembly lower channel flat face countersunk holes 17A, 17B, 17C, 17D, 28B, 28D, 28F, 28H have been drilled in the lower sub-assembly lower channel flat face 30. The lower sub-assembly lower channel flat face countersunk holes 17A, 17B, 17C, 17D are equidistantly rotationally separated by 45° to the lower sub-assembly lower channel flat face countersunk holes 28B, 28D, 28F, 28H, respectively, on the lower sub-assembly lower channel flat face 30. The lower sub-assembly lower channel flat face countersunk holes 17A, 17B, 17C, 17D, 28B, 28D, 28F, 28H are also all at the same pitch circle diameter on the lower sub-assembly lower channel flat face 30. The lower sub-assembly lower channel flat face countersunk holes 17A, 17B, 17C, 17D, are interconnected to the lower sub-assembly lower channel holes 16A, 16B, 16C, 16D, respectively.

The lower sub-assembly lower channel flat face countersunk holes 28B, 28D, 28F, 28H are interconnected to the lower sub-assembly lower channel holes 28A, 28C, 28E, 28G, respectively.

The lower sub-assembly lower channel flat face countersunk holes 17A, 17B, 17C, 17D, 28B, 28D, 28F, 28H and the lower sub-assembly lower channel holes 16A, 16B, 16C, 16D, 28A, 28C, 28E, 28G are offset from and are parallel to the centre-line axis of the lower sub-assembly 2, as shown in FIG. 2.

The lower sub-assembly lower channel holes 16A, 16B, 16C, 16D are interconnected to and are drilled through into the lower sub-assembly inner holes 15A, 15B, 15C, 15D, respectively, as shown in FIG. 2.

The lower sub-assembly lower channel holes 28A, 28C, 28E, 28G are interconnected to and are drilled through the lower sub-assembly lower flat face inner chamfered edge hole cone 12 and into the lower sub-assembly lower flat face inner chamfered edge hole 4, as shown in FIG. 2.

Located centrally on the lower sub-assembly lower channel flat face 30 and located on the centre-line axis of the lower sub-assembly 2, as shown in FIG. 2, is the lower sub-assembly lower channel flat face central countersunk hole 29A. Interconnected to the lower sub-assembly lower channel flat face central countersunk hole 29A is the lower sub-assembly lower channel flat face central hole 29B. The lower sub-assembly lower channel flat face central hole 29B has a lower sub-assembly lower channel flat face central hole flat face 29C.

The compression spring centralising caps 31A, 31E are shown in the cross-sectional side view of the circulating downhole tool utilising a variable fluid pressure regulated cycle valve device 1, as shown in FIG. 1, to be located at either end of the compression spring 32. The compression spring centralising caps 31A, 31E each have a compression spring centralising cap rear flat face 31B, 31F, respectively. The compression spring centralising caps 31A, 31E also each have a compression spring centralising cap forward stepped face 31C, 31G, respectively. The compression spring centralising caps 31A, 31E also each have a compression spring centralising cap forward chamfered pin 31D, 31H, respectively, as shown in FIG. 1.

The compression spring centralising cap 31A can be inserted into the lower sub-assembly lower channel flat face central hole 29B until the compression spring centralising cap rear flat face 31B is pressed against the lower sub-assembly lower channel flat face central hole flat face 29C. The outer diameter of the compression spring centralising cap rear flat face 31B and the compression spring centralising cap forward stepped face 31C should be equal to each other. The outer diameter of the compression spring centralising cap rear flat face 31B and the compression spring centralising cap forward stepped face 31C should be smaller in outer diameter than the internal diameter of the lower sub-assembly lower channel flat face central hole 29B and the lower sub-assembly lower channel flat face central hole flat face 29C, to ensure that the compression spring centralising cap 31A can be releaseably pressed into the lower sub-assembly lower channel flat face central hole 29B.

The outer diameter of the compression spring 32 should be smaller than the internal diameter of the lower sub-assembly lower channel flat face central hole 29B and the outer diameter of the lower sub-assembly lower channel flat face central hole flat face 29C, to ensure that the compression spring 32 can freely extend and contract and be releaseably pressed into the lower sub-assembly lower channel flat face central hole 29B. One end of the compression spring 32 can be inserted into the lower sub-assembly lower channel flat face central hole 29B until one end of the compression spring 32 is pressed along and around the compression spring centralising cap forward chamfered pin 31D, and until one end of the compression spring 32 is pressed against the compression spring centralising cap forward stepped face 31C, as shown in FIG. 1. The internal diameter of the compression spring 32 should be larger than the outer diameter of the compression spring centralising cap forward chamfered pin 31D to ensure that the compression spring 32 can be releaseably pressed around and can freely extend and contract along and around the compression spring centralising cap forward chamfered pin 31D.

The compression spring centralising caps 31A, 31E are shown in the cross-sectional side view of the circulating downhole tool utilising a variable fluid pressure regulated cycle valve device 1, as shown in FIG. 1, to be located at either end of the compression spring 32. The compression spring centralising caps 31A, 31E each have a compression spring centralising cap rear flat face 31B, 31F, respectively. The compression spring centralising caps 31A, 31E also each have a compression spring centralising cap forward stepped face 31C, 31G, respectively. The compression spring centralising caps 31A, 31E also each have a compression spring centralising cap forward chamfered pin 31D, 31H, respectively, as shown in FIG. 1.

The compression spring centralising cap 31E can be inserted into the cycle valve lower flat face central hole 56B until the compression spring centralising cap rear flat face 31F is pressed against the cycle valve lower flat face central hole flat face 56C.

The outer diameter of the compression spring centralising cap rear flat face 31F and the compression spring centralising cap forward stepped face 31G should be equal to each other. The outer diameter of the compression spring centralising cap rear flat face 31F and the compression spring centralising cap forward stepped face 31G should be smaller in outer diameter than the internal diameter of the cycle valve lower flat face central hole 56B and the cycle valve lower flat face central hole flat face 56C to ensure that the compression spring centralising cap 31E can be releaseably pressed into the cycle valve lower flat face central hole 56B.

The outer diameter of the compression spring 32 should be smaller than the internal diameter of the cycle valve lower flat face central hole 56B and the outer diameter of the cycle valve lower flat face central hole flat face 56C to ensure that the compression spring 32 can freely extend and contract and be releaseably pressed into the cycle valve lower flat face central hole 56B. One end of the compression spring 32 can be inserted into the cycle valve lower flat face central hole 56B until one end of the compression spring 32 is pressed along and around the compression spring centralising cap forward chamfered pin 31H, and until one end of the compression spring 32 is pressed against the compression spring centralising cap forward stepped face 31G, as shown in FIG. 1. The internal diameter of the compression spring 32 should be larger than the outer diameter of the compression spring centralising cap forward chamfered pin 31H to ensure that the compression spring 32 can be releaseably pressed around and can freely extend and contract along and around the compression spring centralising cap forward chamfered pin 31H.

Figure 3B:
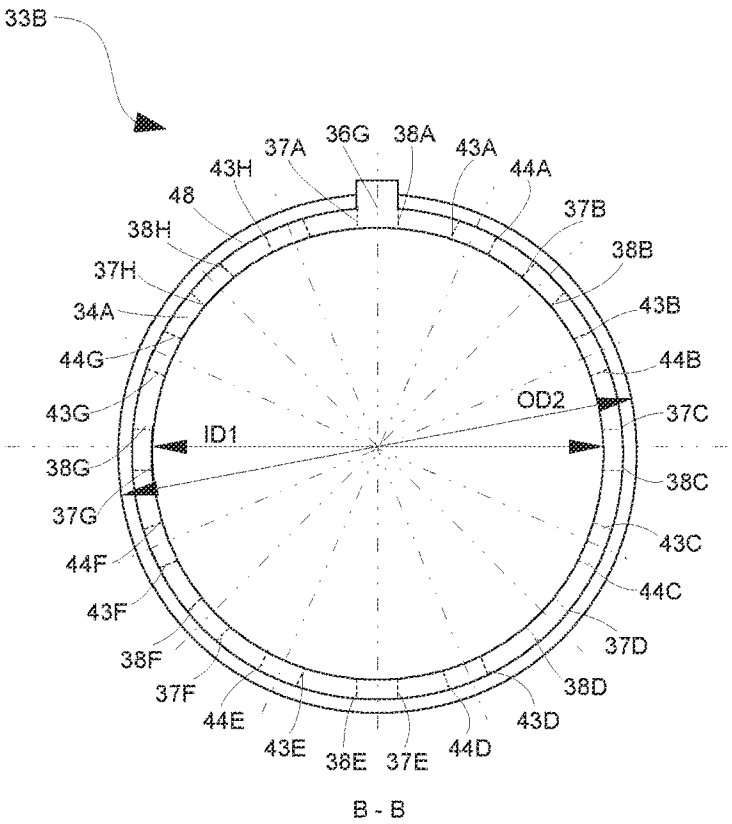
FIG. 3B—The horizontal orientation lower end view B-B of the two-part cycle valve sleeve with curved notches and short flat-sided teeth only hidden details of the two-part cycle valve sleeve shown in FIG. 3A, of the circulating downhole tool utilising a variable fluid pressure regulated cycle valve device shown in FIG. 1.
Figure 3A:
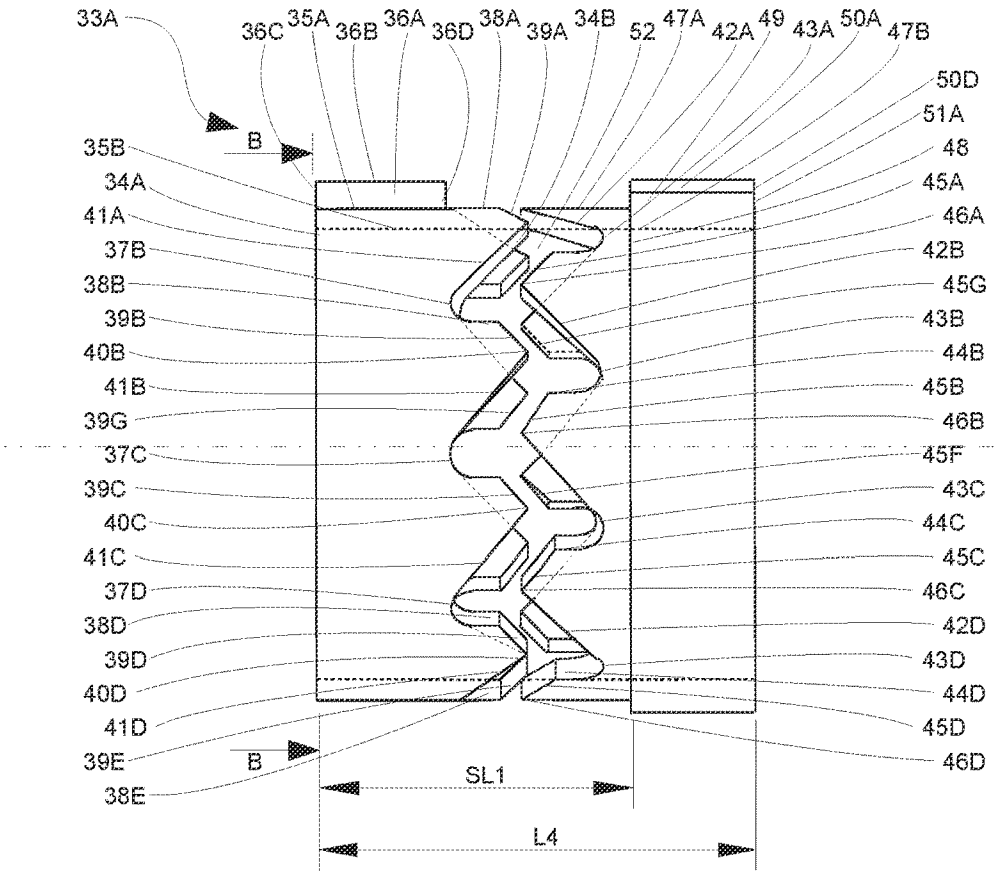
FIG. 3A—The horizontal orientation side view with hidden details of the two-part cycle valve sleeve of the circulating downhole tool utilising a variable fluid pressure regulated cycle valve device shown in FIG. 1.

The horizontal orientation side view with hidden details of the two-part cycle valve sleeve 33A of the circulating downhole tool utilising a variable fluid pressure regulated cycle valve device 1, is shown in FIG. 3A.

FIG. 3B shows the horizontal orientation lower end view B-B of the two-part cycle valve sleeve 33B with two-part cycle valve sleeve lower half curved notches 37A, 37B, 37C, 37D, 37E, 37F, 37G, 37H, and two-part cycle valve sleeve upper half curved notches 43A, 43B, 43C, 43D, 43E, 43F, 43G, 43H, and two-part cycle valve sleeve lower half short flat-sided teeth 38A, 38B, 38C, 38D, 38E, 38F, 38G, 38H, and two-part cycle valve sleeve upper half short flat-sided teeth 44A, 44B, 44C, 44D, 44E, 44F, 44G, 44H only hidden details of the two-part cycle valve sleeve 33A of the circulating downhole tool utilising a variable fluid pressure regulated cycle valve device 1 shown in FIG. 3A.

FIG. 3A shows that the two-part cycle valve sleeve 33A has a two-part cycle valve sleeve lower half lower flat face 34A that is perpendicular to the two-part cycle valve sleeve lower half outer surface 35A and the two-part cycle valve sleeve lower half inner surface 35B.

FIG. 3A and FIG. 3B show that the two-part cycle valve sleeve 33A and 33B, respectively, has a two-part cycle valve sleeve lower half keyway 36A that is located on the two-part cycle valve sleeve lower half outer surface 35A. The two-part cycle valve sleeve lower half keyway 36A is designed to slide tightly and smoothly along the lower sub-assembly keyway slot 20A, as shown in FIG. 1 and FIG. 2, until the two-part cycle valve sleeve lower half lower flat face 34A makes contact with the lower sub-assembly lower channel flat face 30 of the lower sub-assembly 2, as shown in FIG. 1.

The two-part cycle valve sleeve lower half keyway 36A has a two-part cycle valve sleeve lower half keyway outer flat surface 36B that is designed to be parallel to the lower sub-assembly keyway slot outer flat face 20B, and be offset from the centre-line axis of the circulating downhole tool utilising a variable fluid pressure regulated cycle valve device 1, that is slightly less than the radius of the lower sub-assembly upper hole 22B, as shown in FIG. 1.

The two-part cycle valve sleeve lower half keyway 36A has a two-part cycle valve sleeve lower half keyway lower flat face 36C that is in-line with the two-part cycle valve sleeve lower half lower flat face 34A. The two-part cycle valve sleeve lower half keyway 36A extends from the two-part cycle valve sleeve lower half keyway lower flat face 36C to the two-part cycle valve sleeve lower half keyway upper flat face 36D, as shown in FIG. 1 and FIG. 3A. FIG. 3A also shows that the distance from the two-part cycle valve sleeve lower half lower flat face 34A to the two-part cycle valve sleeve lower half keyway upper flat face 36D is slightly less than the distance from the two-part cycle valve sleeve lower half lower flat face 34A to the lower edges of the two-part cycle valve sleeve lower curved notches 37A, 37B, 37C, 37D, 37E, 37F, 37G, 37H.

The two-part cycle valve sleeve lower half keyway 36A has two-part cycle valve sleeve lower half keyway flat side walls 36E, 36F that are parallel to one another and are equidistantly offset from the two-part cycle valve sleeve centreline 36G, as shown in FIG. 3B. The width of the two-part cycle valve sleeve lower half keyway 36A, represented by the distance between the two-part cycle valve sleeve lower half keyway flat side walls 36E, 36F, should be slightly less than the width of the lower sub-assembly keyway slot 20A, represented by the distance between the lower sub-assembly keyway slot flat side walls 20C, 20D, as shown in the end view A-A of the lower sub-assembly 2, as shown in FIG. 2. This will ensure that the two-part cycle valve sleeve lower half keyway 36A will slide releaseably and tightly and smoothly along the lower sub-assembly keyway slot 20A, as shown in FIG. 1 and FIG. 2, and will not rotate when the circulating downhole tool utilising a variable fluid pressure regulated cycle valve device 1 is being operated.

Figure 4:
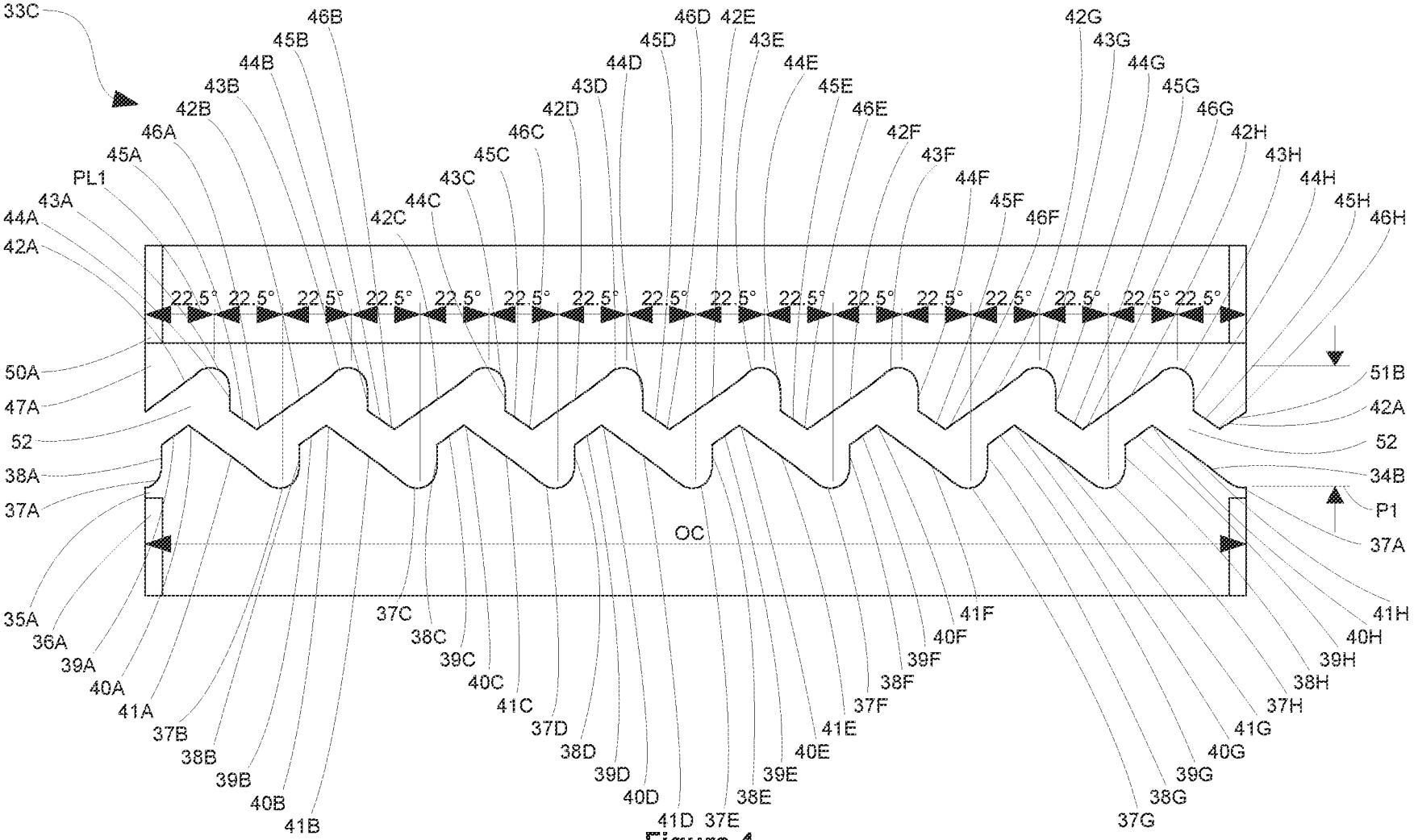
FIG. 4—The elongated circumferential side view of the two-part cycle valve sleeve with their two-part cycle valve sleeve lower half keyway and their eight curved notches and eight three-flat-sided teeth patterns on the two-part cycle valve sleeve lower half upper patterned face, and their two-part cycle valve sleeve upper half keyway and their eight curved notches and eight three-flat-sided teeth patterns, of the circulating downhole tool utilising a variable fluid pressure regulated cycle valve device shown in FIG. 1.

In order to ensure that the circulating downhole tool utilising a variable fluid pressure regulated cycle valve device 1 functions correctly when the fluid pressure, not shown in FIG. 3A and FIG. 3B, is varied, the two-part cycle valve sleeve lower half upper patterned face 34B needs to be accurately machined in order to produce the eight curved notches and eight three-flat-sided teeth pattern 37A, 38A, 39A, 40A, 41A, 37B, 38B, 39B, 40B, 41B, 37C, 38C, 39C, 40C, 41C, 37D, 38D, 39D, 40D, 41D, 37E, 38E, 39E, 40E, 41E, 37F, 38F, 39F, 40F, 41F, 37G, 38G, 39G, 40G, 41G, 37H, 38H, 39H, 40H, 41H, as shown in FIG. 3A and FIG. 4. FIG. 3A shows that the two-part cycle valve sleeve 33A has a two-part cycle valve sleeve upper half upper flat face 51A that is perpendicular to the two-part cycle valve sleeve upper half outer surface 47A and the two-part cycle valve sleeve upper half stepped outer surface 49 and the two-part cycle valve sleeve upper half inner surface 47B.

The two-part cycle valve sleeve upper half stepped outer surface 49 has a two-part cycle valve sleeve upper half stepped lower flat face 48 that is parallel to the two-part cycle valve sleeve upper half upper flat face 51A, as shown in FIG. 3A.

FIG. 3A and FIG. 3B shows that the two-part cycle valve sleeve 33A and 33B, respectively, has a two-part cycle valve sleeve upper half keyway 50A that is located on the two-part cycle valve sleeve upper half stepped outer surface 49. The two-part cycle valve sleeve upper half keyway 50A is designed to slide tightly and smoothly along the lower sub-assembly keyway slot 20A, as shown in FIG. 1 and FIG. 2, until the two-part cycle valve sleeve upper half stepped lower flat face 48 makes contact with the lower sub-assembly middle hole lower flat face 21A of the lower sub-assembly middle hole 21B, as shown in FIG. 1. The two-part cycle valve sleeve upper half keyway 50A has a two-part cycle valve sleeve upper half keyway outer flat surface 50B that is designed to be parallel to the lower sub-assembly keyway slot outer flat face 20B, and be offset from the centre-line axis of the circulating downhole tool utilising a variable fluid pressure regulated cycle valve device 1, that is slightly less than the radius of the lower sub-assembly upper hole 22B, as shown in FIG. 1.

The two-part cycle valve sleeve upper half keyway 50A has a two-part cycle valve sleeve upper half keyway lower flat face 50C that is in-line with the two-part cycle valve sleeve upper half stepped lower flat face 48. The two-part cycle valve sleeve upper half keyway 50A extends from the two-part cycle valve sleeve upper half keyway lower flat face 50C to the two-part cycle valve sleeve upper half keyway upper flat face 50D that is in-line with the two-part cycle valve sleeve upper half upper flat face 51A, as shown in FIG. 1 and FIG. 3A. FIG. 3A also shows that the distance from the two-part cycle valve sleeve upper half upper flat face 51A to the two-part cycle valve sleeve upper half keyway lower flat face 50C and the two-part cycle valve sleeve upper half stepped lower flat face 48 is less than the distance from the two-part cycle valve sleeve upper half upper flat face 51A to the upper edges of the two-part cycle valve sleeve upper curved notches 43A, 43B, 43C, 43D, 43E, 43F, 43G, 43H.

The two-part cycle valve sleeve upper half keyway 50A has two-part cycle valve sleeve upper half keyway flat side walls 50E, 50F that are parallel to one another and are equidistantly offset from the two-part cycle valve sleeve centreline 36G, as shown in FIG. 3B. The width of the two-part cycle valve sleeve upper half keyway 50A, represented by the distance between the two-part cycle valve sleeve upper half keyway flat side walls 50E, 50F, should be slightly less than the width of the lower sub-assembly keyway slot 20A, represented by the distance between the lower sub-assembly keyway slot flat side walls 20C, 20D, as shown in the end view A-A of the lower sub-assembly 2, as shown in FIG. 2. This will ensure that the two-part cycle valve sleeve upper half keyway 50A will slide releaseably and tightly and smoothly along the lower sub-assembly keyway slot 20A, as shown in FIG. 1 and FIG. 2, and will not rotate when the circulating downhole tool utilising a variable fluid pressure regulated cycle valve device 1 is being operated.

In order to ensure that the circulating downhole tool utilising a variable fluid pressure regulated cycle valve device 1 functions correctly when the fluid pressure, not shown in FIG. 3A and FIG. 3B, is varied, the two-part cycle valve sleeve upper half lower patterned face 51B needs to be accurately machined in order to produce the eight curved notches and eight three-flat-sided teeth pattern 42A, 43A, 44A, 45A, 46A, 42B, 43B, 44B, 45B, 46B, 42C, 43C, 44C, 45C, 46C, 42D, 43D, 44D, 45D, 46D, 42E, 43E, 44E, 45E, 46E, 42F, 43F, 44F, 45F, 46F, 42G, 43G, 44G, 45G, 46G, 42H, 43H, 44H, 45H, 46H, as shown in FIG. 3A and FIG. 4.

FIG. 3B shows the horizontal orientation lower end view B-B of the two-part cycle valve sleeve 33B with two-part cycle valve sleeve lower half curved notches 37A, 37B, 37C, 37D, 37E, 37F, 37G, 37H, and two-part cycle valve sleeve upper half curved notches 43A, 43B, 43C, 43D, 43E, 43F, 43G, 43H, and two-part cycle valve sleeve lower half short flat-sided teeth 38A, 38B, 38C, 38D, 38E, 38F, 38G, 38H, and two-part cycle valve sleeve upper half short flat-sided teeth 44A, 44B, 44C, 44D, 44E, 44F, 44G, 44H only hidden details of the two-part cycle valve sleeve 33A of the circulating downhole tool utilising a variable fluid pressure regulated cycle valve device 1, as shown in FIG. 3A.

FIG. 3B clearly shows that the two-part cycle valve sleeve upper half curved notches 43A, 43B, 43C, 43D, 43E, 43F, 43G, 43H hidden details and the two-part cycle valve sleeve upper half short flat-sided teeth 44A, 44B, 44C, 44D, 44E, 44F, 44G, 44H hidden details of the two-part cycle valve sleeve upper half lower patterned face 51B are circumferentially rotationally clock-wise off-set by 22.5° to the two-part cycle valve sleeve lower half curved notches 37A, 37B, 37C, 37D, 37E, 37F, 37G, 37H hidden details and the and two-part cycle valve sleeve lower half short flat-sided teeth 38A, 38B, 38C, 38D, 38E, 38F, 38G, 38H hidden details of the two-part cycle valve sleeve lower half upper patterned face 34B.

The hidden details of the two-part cycle valve sleeve lower half short diagonal flat-sided teeth 39A, 39B, 39C, 39D, 39E, 39F, 39G, 39H, and the hidden details of the two-part cycle valve sleeve lower half apex of the flat-sided teeth 40A, 40B, 40C, 40D, 40E, 40F, 40G, 40H, and the hidden details of the two-part cycle valve sleeve lower half long diagonal flat-sided teeth 41A, 41B, 41C, 41D, 41E, 41F, 41G, 41H of the two-part cycle valve sleeve lower half upper patterned face 34B, are not shown in FIG. 3B.

The hidden details of the two-part cycle valve sleeve upper half long diagonal flat-sided teeth 42A, 42B, 42C, 42D, 42E, 42F, 42G, 42H, and the hidden details of the two-part cycle valve sleeve upper half apex of the flat-sided teeth 46A, 46B, 46C, 46D, 46E, 46F, 46G, 46H, and the hidden details of the two-part cycle valve sleeve upper half short diagonal flat-sided teeth 45A, 45B, 45C, 45D, 45E, 45F, 45G, 45H of the two-part cycle valve sleeve upper half lower patterned face 51B, are not shown in FIG. 3B.

The elongated circumferential side view of the two-part cycle valve sleeve 33A and 33B with their two-part cycle valve sleeve lower half keyway 36A and their eight curved notches and eight three-flat-sided teeth patterns 37A, 38A, 39A, 40A, 41A, 37B, 38B, 39B, 40B, 41B, 37C, 38C, 39C, 40C, 41C, 37D, 38D, 39D, 40D, 41D, 37E, 38E, 39E, 40E, 41E, 37F, 38F, 39F, 40F, 41F, 37G, 38G, 39G, 40G, 41G, 37H, 38H, 39H, 40H, 41H on the two-part cycle valve sleeve lower half upper patterned face 34B, and their two-part cycle valve sleeve upper half keyway 50A and their eight curved notches and eight three-flat-sided teeth patterns 42A, 43A, 44A, 45A, 46A, 42B, 43B, 44B, 45B, 46B, 42C, 43C, 44C, 45C, 46C, 42D, 43D, 44D, 45D, 46D, 42E, 43E, 44E, 45E, 46E, 42F, 43F, 44F, 45F, 46F, 42G, 43G, 44G, 45G, 46G, 42H, 43H, 44H, 45H, 46H, of the circulating downhole tool utilising a variable fluid pressure regulated cycle valve device 1, are shown in FIG. 4.

FIG. 4 is the equivalent of cutting the two-part cycle valve sleeve 33A through the two-part cycle valve sleeve lower half outer surface 35A and the two-part cycle valve sleeve lower half keyway 36A and the two-part cycle valve sleeve upper half outer surface 47A and the two-part cycle valve sleeve upper half stepped outer surface 49 and the two-part cycle valve sleeve upper half keyway 50A along the two-part cycle valve sleeve centreline 36G, and then laying the cylindrical-shaped two-part cycle valve sleeve 33A out flat, with the outer circumference OC of the two-part cycle valve sleeve lower half outer surface 35A, as shown in FIG. 4.

The two-part cycle valve sleeve lower half keyway 36A and the two-part cycle valve sleeve upper half keyway 50A are both designed to slide releaseably and tightly and smoothly along the lower sub-assembly keyway slot 20A, as shown in FIG. 1 and FIG. 2. The two-part cycle valve sleeve lower half keyway 36A and the two-part cycle valve sleeve upper half keyway 50A are both designed to ensure that the two-part cycle valve sleeve 33A and 33B, shown in FIG. 3A and FIG. 3B, respectively, are accurately aligned with one another and will not rotate when the circulating downhole tool utilising a variable fluid pressure regulated cycle valve device 1 is being operated.

FIG. 4 shows that the elongated circumferential side view of the eight curved notches and eight three-flat-sided teeth pattern 42A, 43A, 44A, 45A, 46A, 42B, 43B, 44B, 45B, 46B, 42C, 43C, 44C, 45C, 46C, 42D, 43D, 44D, 45D, 46D, 42E, 43E, 44E, 45E, 46E, 42F, 43F, 44F, 45F, 46F, 42G, 43G, 44G, 45G, 46G, 42H, 43H, 44H, 45H, 46H on the two-part cycle valve sleeve upper half lower patterned face 51B are the mirror-image of and are circumferentially rotationally clock-wise off-set by 22.5° to the elongated circumferential side view of the eight curved notches and eight three-flat-sided teeth pattern 37A, 38A, 39A, 40A, 41A, 37B, 38B, 39B, 40B, 41B, 37C, 38C, 39C, 40C, 41C, 37D, 38D, 39D, 40D, 41D, 37E, 38E, 39E, 40E, 41E, 37F, 38F, 39F, 40F, 41F, 37G, 38G, 39G, 40G, 41G, 37H, 38H, 39H, 40H, 41H on the two-part cycle valve sleeve lower half upper patterned face 34B. FIG. 3A and FIG. 4 shows that there is a two-part cycle valve sleeve separation gap 52 between the two-part cycle valve sleeve lower half upper patterned face 34B and the two-part cycle valve sleeve upper half lower patterned face 51B. The two-part cycle valve sleeve separation gap 52 needs to be slightly wider than the outer diameter of the four cycle valve guide pins 59A, 60A, 61A, 62A to allow the free movement of the four cycle valve guide pins 59A, 60A, 61A, 62A when required.

Figures 5A, 5B, 5C:
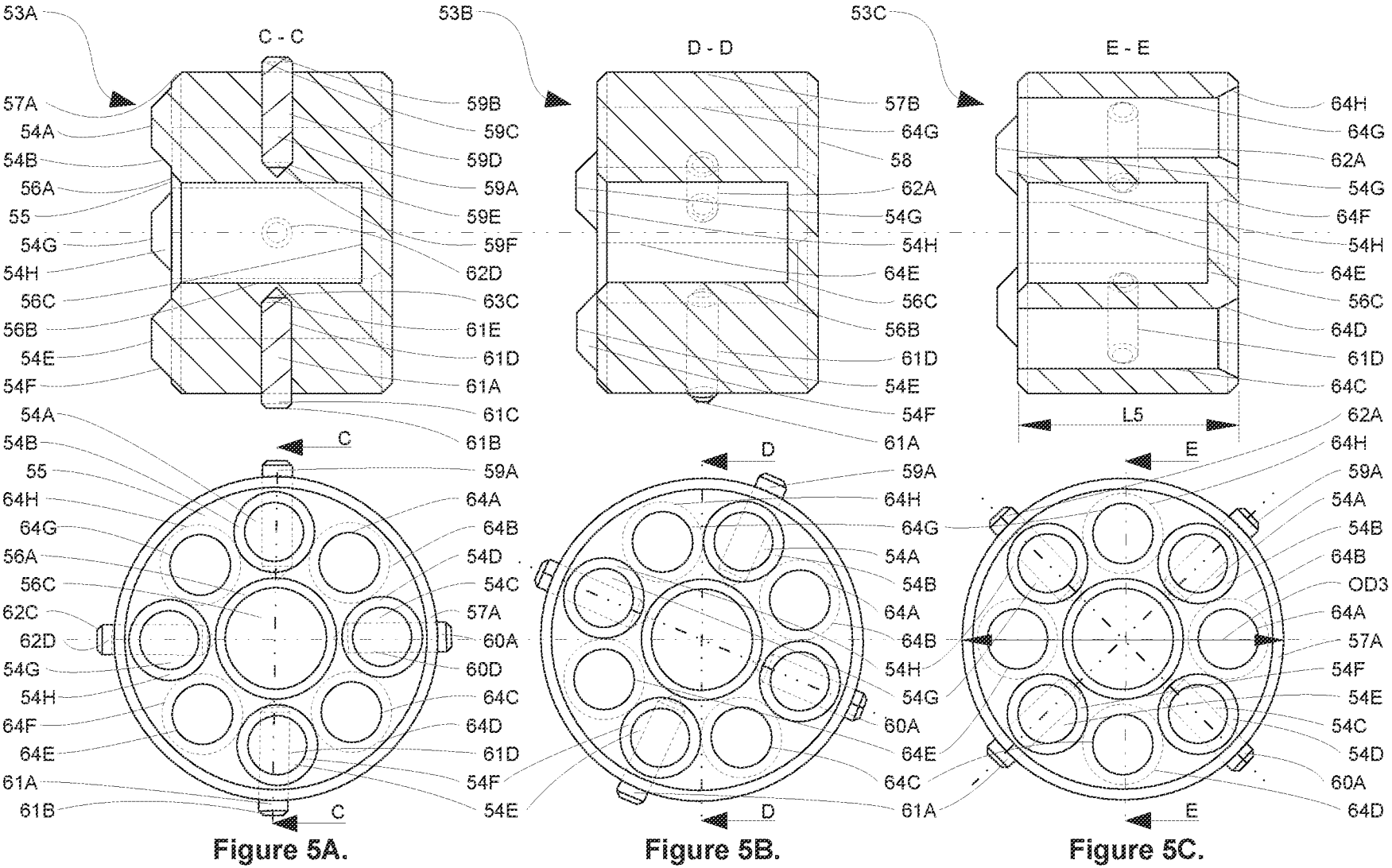
FIG. 5A—Cross-sectional side view C-C and lower end view of the cycle valve of the circulating downhole tool utilising a variable fluid pressure regulated cycle valve device with the cycle valve orientated 0° about the centre-line axis and from the horizontal and vertical axes, of the circulating downhole tool utilising a variable fluid pressure regulated cycle valve device shown in FIG. 1.
FIG. 5B—Cross-sectional side view D-D and lower end view of the cycle valve of the circulating downhole tool utilising a variable fluid pressure regulated cycle valve device with the cycle valve rotated clockwise 22.5° about the centre-line axis and from the horizontal and vertical axes shown in FIG. 5A, of the circulating downhole tool utilising a variable fluid pressure regulated cycle valve device shown in FIG. 1.
FIG. 5C—Cross-sectional side view E-E and lower end view of the cycle valve of the circulating downhole tool utilising a variable fluid pressure regulated cycle valve device with the cycle valve rotated clockwise 45° about the centre-line axis and from the horizontal and vertical axes shown in FIG. 5A, of the circulating downhole tool utilising a variable fluid pressure regulated cycle valve device shown in FIG. 1.

FIG. 5A shows the cross-sectional side view C-C and lower end view of the cycle valve 53A of the circulating downhole tool utilising a variable fluid pressure regulated cycle valve device 1, with the cycle valve 53A orientated 0° about the centre-line axis and from the horizontal and vertical axes.

FIG. 5B shows the cross-sectional side view D-D and lower end view of the cycle valve 53B of the circulating downhole tool utilising a variable fluid pressure regulated cycle valve device 1, with the cycle valve 53B rotated clockwise 22.5° about the centre-line axis and from the horizontal and vertical axes shown in FIG. 5A.

FIG. 5C shows the cross-sectional side view E-E and lower end view of the cycle valve 53C of the circulating downhole tool utilising a variable fluid pressure regulated cycle valve device 1, with the cycle valve 53C rotated clockwise 45° about the centre-line axis and from the horizontal and vertical axes shown in FIG. 5A.

The cycle valve 53A shown in FIG. 5A, and the cycle valve 53B shown in FIG. 5B, and the cycle valve 53C shown in FIG. 5C, have a cycle valve lower flat face 55 that has a cycle valve lower flat face inner chamfered edge 56A, that is located centrally about the centre-line axis of the cycle valves 53A, 53B, 53C of the circulating downhole tool utilising a variable fluid pressure regulated cycle valve device 1. The cycle valve lower flat face inner chamfered edge 56A interconnects the cycle valve lower flat face to the cycle valve lower flat face central hole 56B. The cycle valve lower flat face central hole 56B has a cycle valve lower flat face central hole flat face 56C, as shown in FIG. 5A, FIG. 5B and FIG. 5C.

The cycle valve 53A shown in FIG. 5A, and the cycle valve 53B shown in FIG. 5B, and the cycle valve 53C shown in FIG. 5C, have a cycle valve lower flat face outer chamfered edge 57A. The cycle valve lower flat face outer chamfered edge 57A is interconnected to the cycle valve outer surface 57B. The cycle valve outer surface 57B is interconnected to the cycle valve upper flat face outer chamfered edge 57C. The cycle valve upper flat face outer chamfered edge 57C is interconnected to the cycle valve upper flat face 58.

The four cycle valve truncated cone stoppers 54A, 54B, and 54C, 54D, and 54E, 54F, and 54G, 54H are extensions located on the on the cycle valve lower flat face 55, and are rotationally separated by 90° to one another and are located on a pitch circle diameter that is equi-distant between the cycle valve lower flat face inner chamfered edge 56A and the cycle valve lower flat face outer chamfered edge 57A, as shown in FIG. 5A, FIG. 5B and FIG. 5C.

The cycle valve 53A shown in FIG. 5A, and the cycle valve 53B shown in FIG. 5B, and the cycle valve 53C shown in FIG. 5C, have four cycle valve holes 64A, 64C, 64E, 64G that are interconnected to cycle valve upper flat face countersunk holes 64B, 64D, 64F, 64H, respectively. The cycle valve upper flat face countersunk holes 64B, 64D, 64F, 64H interconnect the four cycle valve holes 64A, 64C, 64E, 64G, respectively, to the cycle valve upper flat face 58, as shown in FIG. 5A, FIG. 5B and FIG. 5C. The four cycle valve through holes 64A, 64C, 64E, 64G and the interconnected cycle valve upper flat face countersunk holes 64B, 64D, 64F, 64H, respectively, interconnect the cycle valve lower flat face 55 to the cycle valve upper flat face 58. The four cycle valve through holes 64A, 64C, 64E, 64G and the interconnected cycle valve upper flat face countersunk holes 64B, 64D, 64F, 64H, respectively, are rotationally separated by 90° to one another and are rotationally separated by 45° to the four cycle valve truncated cone stoppers 54A, 54B, and 54C, 54D, and 54E, 54F, and 54G, 54H, respectively. The four cycle valve through holes 64A, 64C, 64E, 64G and the interconnected cycle valve upper flat face countersunk holes 64B, 64D, 64F, 64H, respectively, are located on a pitch circle diameter that is equi-distant between the cycle valve lower flat face inner chamfered edge 56A and the cycle valve lower flat face outer chamfered edge 57A, as shown in FIG. 5A, FIG. 5B and FIG. 5C.

The four cycle valve guide pin holes 63A, 63B, 63C, 63D are drilled into the cycle valve outer surface 57B until the pointed ends of the four cycle valve guide pin holes 63A, 63B, 63C, 63D are close to but do not penetrate through to the cycle valve lower flat face central hole 56B, as shown in FIG. 5A, FIG. 5B and FIG. 5C. The four cycle valve guide pin holes 63A,63B, 63C, 63D are drilled into the cycle valve outer surface 57B at a distance that is closer to the cycle valve lower flat face 55 than to the cycle valve upper flat face 58, as shown in FIG. 5A, FIG. 5B and FIG. 5C. The four cycle valve guide pin holes 63A, 63B, 63C, 63D are rotationally separated by 90° to one another and are orientated 0° about the centre-line axis and from the horizontal and vertical axes of the lower end view of the cycle valve 53A, as shown in FIG. 5A. Four cycle valve guide pins 59A, 60A, 61A, 62A are securely press-fitted into the four cycle valve guide pin holes 63A, 63B, 63C, 63D, respectively, until the cycle valve guide pin lower face chamfered edge 59E, 60E, 61E, 62E, respectively, are seated in the pointed ends of the four cycle valve guide pin holes 63A,63B, 63C, 63D, respectively. The four cycle valve guide pins 59A, 60A, 61A, 62A have a cycle valve guide pin upper face 59B, 60B, 61B, 62B, respectively, and have a cycle valve guide pin upper face chamfered edge 59C, 60C, 61C, 62C, respectively, and have a cycle valve guide pin outer surface 59D, 60D, 61D, 62D, respectively, and have a cycle valve guide pin lower face chamfered edge 59E, 60E, 61E, 62E, respectively, and have a cycle valve guide pin lower face 59F, 60F, 61F, 62F, respectively. To ensure that the four cycle valve guide pins 59A, 60A, 61A, 62A remain securely attached in the four cycle valve guide pin holes 63A, 63B, 63C, 63D, respectively, when the cycle valve 53A and the cycle valve 53B and the cycle valve 53C are fitted to and are functioning within a circulating downhole tool utilising a variable fluid pressure regulated cycle valve device 1 that is being operated in a wellbore formation 85, not shown in FIG. 5A, FIG. 5B and FIG. 5C, it is recommended that an adhesive such as Loctite® be inserted into the four cycle valve guide pin holes 63A,63B, 63C, 63D before the four cycle valve guide pins 59A, 60A, 61A, 62A are securely press-fitted into the four cycle valve guide pin holes 63A,63B, 63C, 63D, respectively, as shown in FIG. 5A, FIG. 5B and FIG. 5C.

FIG. 5A shows the cross-sectional side view C-C and the lower end view of the cycle valve 53A of the circulating downhole tool utilising a variable fluid pressure regulated cycle valve device 1, with the cycle valve 53A and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H are all orientated 0° about the centre-line axis and from the horizontal and vertical axes of the lower end view of the cycle valve 53A of the circulating downhole tool utilising a variable fluid pressure regulated cycle valve device 1.

The lower end view of the cycle valve 53A shown in FIG. 5A also shows that the four cycle valve through holes 64A, 64C, 64E, 64G and the interconnected cycle valve upper flat face countersunk holes 64B, 64D, 64F, 64H, respectively, are rotationally separated by 45° about the centre-line axis and from the horizontal and vertical axes of the lower end view of the cycle valve 53A of the circulating downhole tool utilising a variable fluid pressure regulated cycle valve device 1, and to the four cycle valve guide pins 59A, 60A, 61A, 62A, and the four cycle valve guide pin holes 63A, 63B, 63C, 63D, and the four cycle valve truncated cone stoppers 54A, 54B, and 54C, 54D, and 54E, 54F, and 54G, 54H.

When the cycle valve 53A shown in FIG. 5A is rotated clockwise 22.5° about the centre-line axis and from the horizontal and vertical axes, the cross-sectional side view D-D and the lower end view of the cycle valve 53B of the circulating downhole tool utilising a variable fluid pressure regulated cycle valve device 1 is produced, as shown in FIG. 5B.

FIG. 5B shows the cross-sectional side view D-D and the lower end view of the cycle valve 53B of the circulating downhole tool utilising a variable fluid pressure regulated cycle valve device 1, with the cycle valve 53B and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H and the four cycle valve through holes 64A, 64C, 64E, 64G and the interconnected cycle valve upper flat face countersunk holes 64B, 64D, 64F, 64H, respectively, are all rotationally orientated 22.5° clockwise about the centre-line axis, relative to the lower end view of the cycle valve 53A of the circulating downhole tool utilising a variable fluid pressure regulated cycle valve device 1 shown in FIG. 5A.

When the cycle valve 53A shown in FIG. 5A is rotated clockwise 45° about the centre-line axis and from the horizontal and vertical axes, or when the cycle valve 53B shown in FIG. 5B is rotated clockwise 22.5° about the centre-line axis and from the horizontal and vertical axes, the cross-sectional side view E-E and the lower end view of the cycle valve 53C of the circulating downhole tool utilising a variable fluid pressure regulated cycle valve device 1 is produced, as shown in FIG. 5C.

FIG. 5C shows the cross-sectional side view E-E and the lower end view of the cycle valve 53C of the circulating downhole tool utilising a variable fluid pressure regulated cycle valve device 1, with the cycle valve 53C and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H and the four cycle valve through holes 64A, 64C, 64E, 64G and the interconnected cycle valve upper flat face countersunk holes 64B, 64D, 64F, 64H, respectively, are all rotationally orientated 45° clockwise about the centre-line axis, relative to the lower end view of the cycle valve 53A of the circulating downhole tool utilising a variable fluid pressure regulated cycle valve device 1 shown in FIG. 5A.

Figures 6A, 6B, 6C:
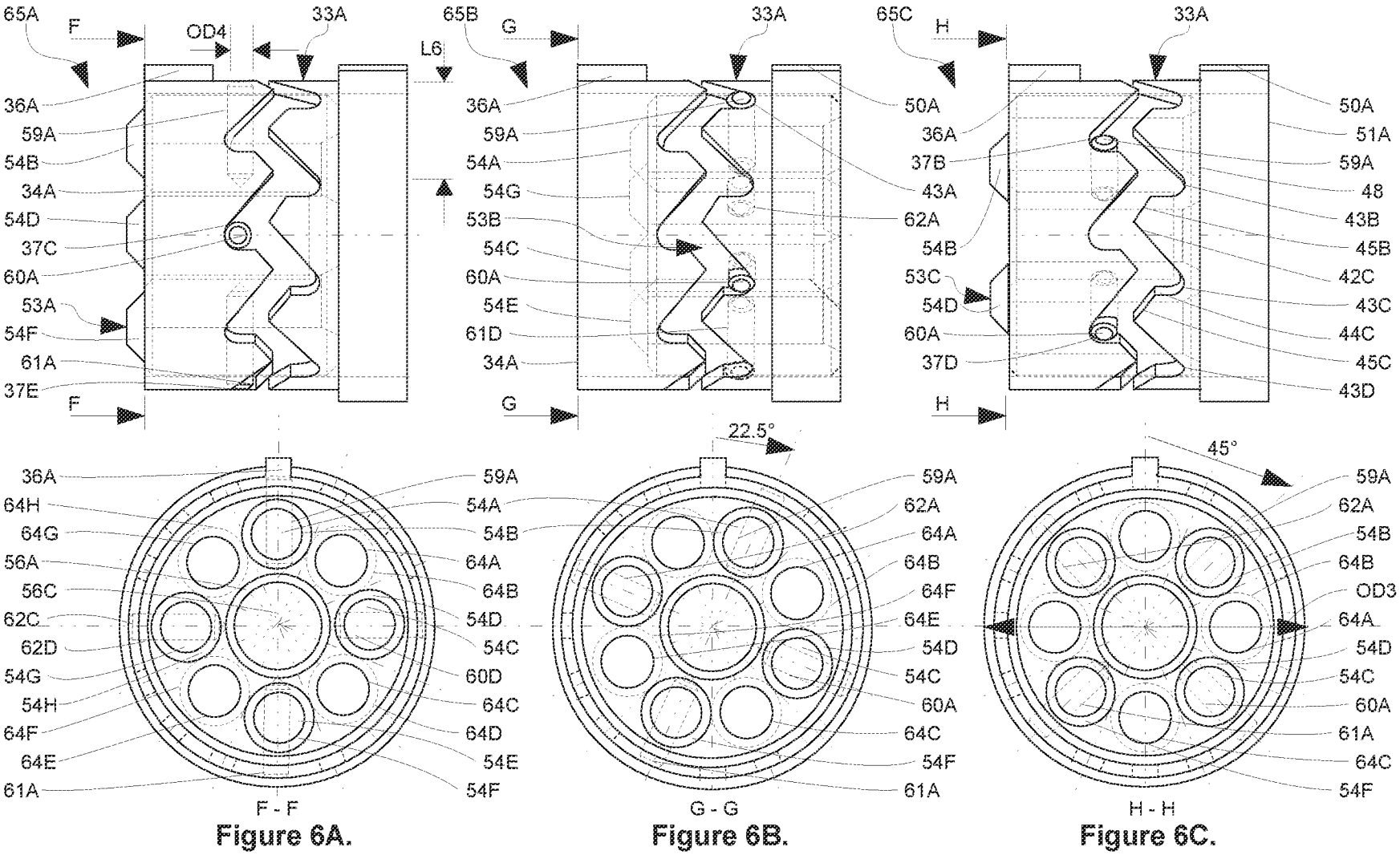
FIG. 6A—External side view and lower end view F-F with some hidden details of the cycle valve inserted inside the two-part cycle valve sleeve with the four cycle valve guide pins pressed against the two-part cycle valve sleeve lower half curved notches, of the circulating downhole tool utilising a variable fluid pressure regulated cycle valve device shown in FIG. 1.
FIG. 6B—External side view and lower end view G-G with some hidden details of the cycle valve inserted inside the two-part cycle valve sleeve with the four cycle valve guide pins pressed against the two-part cycle valve sleeve upper half curved notches, of the circulating downhole tool utilising a variable fluid pressure regulated cycle valve device shown in FIG. 1.
FIG. 6C—External side view and lower end view H-H with some hidden details of the cycle valve inserted inside the two-part cycle valve sleeve with the four cycle valve guide pins pressed against the two-part cycle valve sleeve lower half curved notches, of the circulating downhole tool utilising a variable fluid pressure regulated cycle valve device shown in FIG. 1.

FIG. 6A shows the cycle valve 53A inserted inside the two-part cycle valve sleeve 33A with the four cycle valve guide pins 59A, 60A, 61A, 62A pressed against the two-part cycle valve sleeve lower half curved notches 37A, 37C, 37E, 37G, respectively, external side view and lower end view F-F with some hidden details, of the circulating downhole tool utilising a variable fluid pressure regulated cycle valve device 1.

FIG. 6A shows the cycle valve 53A, as shown in FIG. 5A, is inserted longitudinally inside the two-part cycle valve sleeve 33A, as shown in FIG. 3A. The cycle valve 53A is longitudinally displaced to the left along the centre-line axis by a longitudinal force, not shown in FIG. 6A, so that the cycle valve lower flat face 55 is in-line with the two-part cycle valve sleeve lower half lower flat face 34A, and the four cycle valve guide pins 59A, 60A, 61A, 62A are pressed against the two-part cycle valve sleeve lower half curved notches 37A, 37C, 37E, 37G, respectively, on the two-part cycle valve sleeve lower half upper patterned face 34B. The cycle valve 53A is orientated 0° about the centre-line axis and from the horizontal and vertical axes, as shown in FIG. 5A. It should be noted that the cycle valve 53A should have a cycle valve outer surface 57B outer diameter that is slightly less than the internal diameter of the two-part cycle valve sleeve lower half inner surface 35B and the two-part cycle valve sleeve upper half inner surface 47B. This will ensure that the cycle valve 53A will be able to smoothly rotate and move longitudinally along the centre-line axis when a bi-directional longitudinal force, not shown in FIG. 6A, is applied along the centre-line axis of the cycle valve 53A.

FIG. 6B shows the cycle valve 53B inserted inside the two-part cycle valve sleeve 33A with the four cycle valve guide pins 59A, 60A, 61A, 62A pressed against the two-part cycle valve sleeve upper half curved notches 43A, 43C, 43E, 43G, respectively, external side view and lower end view G-G with some hidden details, of the circulating downhole tool utilising a variable fluid pressure regulated cycle valve device 1.

FIG. 6B shows the cycle valve 53B, as shown in FIG. 5B, is inserted longitudinally inside the two-part cycle valve sleeve 33A, as shown in FIG. 3A. The cycle valve 53B is shown in FIG. 6B to have been longitudinally displaced to the right by a longitudinal force, not shown in FIG. 6B, from the cycle valve 53A position shown in FIG. 6A, along the centre-line axis which results in the four cycle valve guide pins 59A, 60A, 61A, 62A to initially slide along the two-part cycle valve sleeve lower half short flat-sided teeth 38A, 38C, 38E, 38G, respectively.

The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within when the cycle valve 53B has a longitudinal force, not shown in FIG. 6B, applied to it, that results in the cycle valve 53B to be longitudinally displaced and rotated 22.5° in a uni-directional clock-wise direction about the centre-line axis of and inside the two-part cycle valve sleeve 33A.

As the cycle valve 53B continues to be longitudinally displaced to the right by a force, not shown in FIG. 6B, along the centre-line axis, this results in the four cycle valve guide pins 59A, 60A, 61A, 62A to press against and then slide along the two-part cycle valve sleeve upper half long diagonal flat-sided teeth 42A, 42C, 42E, 42G, respectively, and towards the two-part cycle valve sleeve upper half curved notches 43A, 43C, 43E, 43G, respectively. The sliding action of the four cycle valve guide pins 59A, 60A, 61A, 62A along the two-part cycle valve sleeve upper half long diagonal flat-sided teeth 42A, 42C, 42E, 42G, respectively, results in the uni-directional 22.5° rotational clock-wise motion of the interconnected cycle valve 53B about the centre-line axis and from the horizontal and vertical axes, as shown in FIG. 5B, until the four cycle valve guide pins 59A, 60A, 61A, 62A are stopped by and are pressed against the two-part cycle valve sleeve upper half curved notches 43A, 43C, 43E, 43G, respectively, as shown in FIG. 6B.

The cycle valve 53B is longitudinally displaced to the right along the centre-line axis so that the cycle valve lower flat face 55 is longitudinally off-set to the two-part cycle valve sleeve lower half lower flat face 34A. The cycle valve 53B and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5B and FIG. 6B, are rotationally orientated 22.5° clockwise about the centre-line axis and from the horizontal and vertical axes, from the cycle valve 53A and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H and its four cycle valve through holes 64A, 64C, 64E, 64G and its interconnected cycle valve upper flat face countersunk holes 64B, 64D, 64F, 64H, respectively, as shown in FIG. 5A and FIG. 6A.

It should be noted that the cycle valve 53B should have a cycle valve outer surface 57B outer diameter that is slightly less than the internal diameter of the two-part cycle valve sleeve lower half inner surface 35B and the two-part cycle valve sleeve upper half inner surface 47B. This will ensure that the cycle valve 53B will be able to smoothly rotate and move longitudinally along the centre-line axis when a bi-directional longitudinal force, not shown in FIG. 6B, is applied along the centre-line axis of the cycle valve 53B.

FIG. 6C shows the cycle valve 53C inserted inside the two-part cycle valve sleeve 33A with the four cycle valve guide pins 59A, 60A, 61A, 62A pressed against the two-part cycle valve sleeve lower half curved notches 37B, 37D, 37F, 37H, respectively, external side view and lower end view H-H with some hidden details, of the circulating downhole tool utilising a variable fluid pressure regulated cycle valve device 1.

FIG. 6C shows the cycle valve 53C, as shown in FIG. 5C, is inserted longitudinally inside the two-part cycle valve sleeve 33A, as shown in FIG. 3A. The cycle valve 53C is shown in FIG. 6C to have been longitudinally displaced to the left by a longitudinal force, not shown in FIG. 6C, from the cycle valve 53B position shown in FIG. 6B, along the centre-line axis which results in the four cycle valve guide pins 59A, 60A, 61A, 62A to initially slide along the two-part cycle valve sleeve upper half short flat-sided teeth 44A, 44C, 44E, 44G, respectively. The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within when the cycle valve 53C has a longitudinal force, not shown in FIG. 6C, applied to it, that results in the cycle valve 53C to be longitudinally displaced and rotated 22.5° in a uni-directional clock-wise direction about the centre-line axis of and inside the two-part cycle valve sleeve 33A.

As the cycle valve 53C continues to be longitudinally displaced to the left by a force, not shown in FIG. 6C, along the centre-line axis, this results in the four cycle valve guide pins 59A, 60A, 61A, 62A to press against and then slide along the two-part cycle valve sleeve lower half long diagonal flat-sided teeth 41A, 41C, 41E, 41G, respectively, and towards the two-part cycle valve sleeve lower half curved notches 37B, 37D, 37F, 37H, respectively. The sliding action of the four cycle valve guide pins 59A, 60A, 61A, 62A along the two-part cycle valve sleeve lower half long diagonal flat-sided teeth 41A, 41C, 41E, 41G, respectively, results in the uni-directional 22.5° rotational clock-wise motion of the interconnected cycle valve 53C about the centre-line axis and from the horizontal and vertical axes, as shown in FIG. 5C, until the four cycle valve guide pins 59A, 60A, 61A, 62A are stopped by and are pressed against the two-part cycle valve sleeve lower half curved notches 37B, 37D, 37F, 37H, respectively, as shown in FIG. 6C. It should be noted that the cycle valve 53C is longitudinally displaced to the left along the centre-line axis so that the cycle valve lower flat face 55 is in-line with the two-part cycle valve sleeve lower half lower flat face 34A. The cycle valve 53C shown in FIG. 6C is therefore in the same longitudinal position along the centre-line axis inside the two-part cycle valve sleeve 33A, as the cycle valve 53A shown in FIG. 6A.

However, the cycle valve 53C and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5C and FIG. 6C, are rotationally orientated 45° clockwise about the centre-line axis and from the horizontal and vertical axes, from the cycle valve 53A and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5A and FIG. 6A.

It should be noted that the cycle valve 53C should have a cycle valve outer surface 57B outer diameter that is slightly less than the internal diameter of the two-part cycle valve sleeve lower half inner surface 35B and the two-part cycle valve sleeve upper half inner surface 47B. This will ensure that the cycle valve 53C will be able to smoothly rotate and move longitudinally along the centre-line axis when a bi-directional longitudinal force, not shown in FIG. 6C, is applied along the centre-line axis of the cycle valve 53C.

The bi-directional longitudinal movement and uni-directional 22.5° rotational clock-wise cyclical step movement of the cycle valve 53A, 53B, 53C along the centre-line axis inside the two-part cycle valve sleeve 33A, when a bi-directional longitudinal force, not shown in FIG. 6A, FIG. 6B, FIG. 6C, respectively, is applied along the centre-line axis of the cycle valve 53A, 53B, 53C, as described in FIG. 6A, FIG. 6B and FIG. 6C, respectively, is designed to be repeatable for many thousands of cyclical movements of the cycle valve 53A, 53B, 53C over the life-time of the circulating downhole tool utilising a variable fluid pressure regulated cycle valve device 1. This will occur due to the eight curved notches and eight three-flat-sided teeth pattern 42A, 43A, 44A, 45A, 46A, 42B, 43B, 44B, 45B, 46B, 42C, 43C, 44C, 45C, 46C, 42D, 43D, 44D, 45D, 46D, 42E, 43E, 44E, 45E, 46E, 42F, 43F, 44F, 45F, 46F, 42G, 43G, 44G, 45G, 46G, 42H, 43H, 44H, 45H, 46H on the two-part cycle valve sleeve upper half lower patterned face 51B, which are the mirror-image of and are circumferentially rotationally clock-wise off-set by 22.5° to the elongated circumferential side view of the eight curved notches and eight three-flat-sided teeth pattern 37A, 38A, 39A, 40A, 41A, 37B, 38B, 39B, 40B, 41B, 37C, 38C, 39C, 40C, 41C, 37D, 38D, 39D, 40D, 41D, 37E, 38E, 39E, 40E, 41E, 37F, 38F, 39F, 40F, 41F, 37G, 38G, 39G, 40G, 41G, 37H, 38H, 39H, 40H, 41H on the two-part cycle valve sleeve lower half upper patterned face 34B, as shown in FIG. 4. The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within, when a bi-directional longitudinal force, not shown in FIG. 6A, FIG. 6B, FIG. 6C, respectively, is applied along the centre-line axis of the cycle valve 53A, 53B, 53C, as described in FIG. 6A, FIG. 6B and FIG. 6C, respectively. This results in the cycle valve 53A, 53B, 53C to be longitudinally displaced and rotated 22.5° in a uni-directional clock-wise direction about the centre-line axis of and inside the two-part cycle valve sleeve 33A, as shown in FIG. 6A, FIG. 6B and FIG. 6C.

Figure 7:
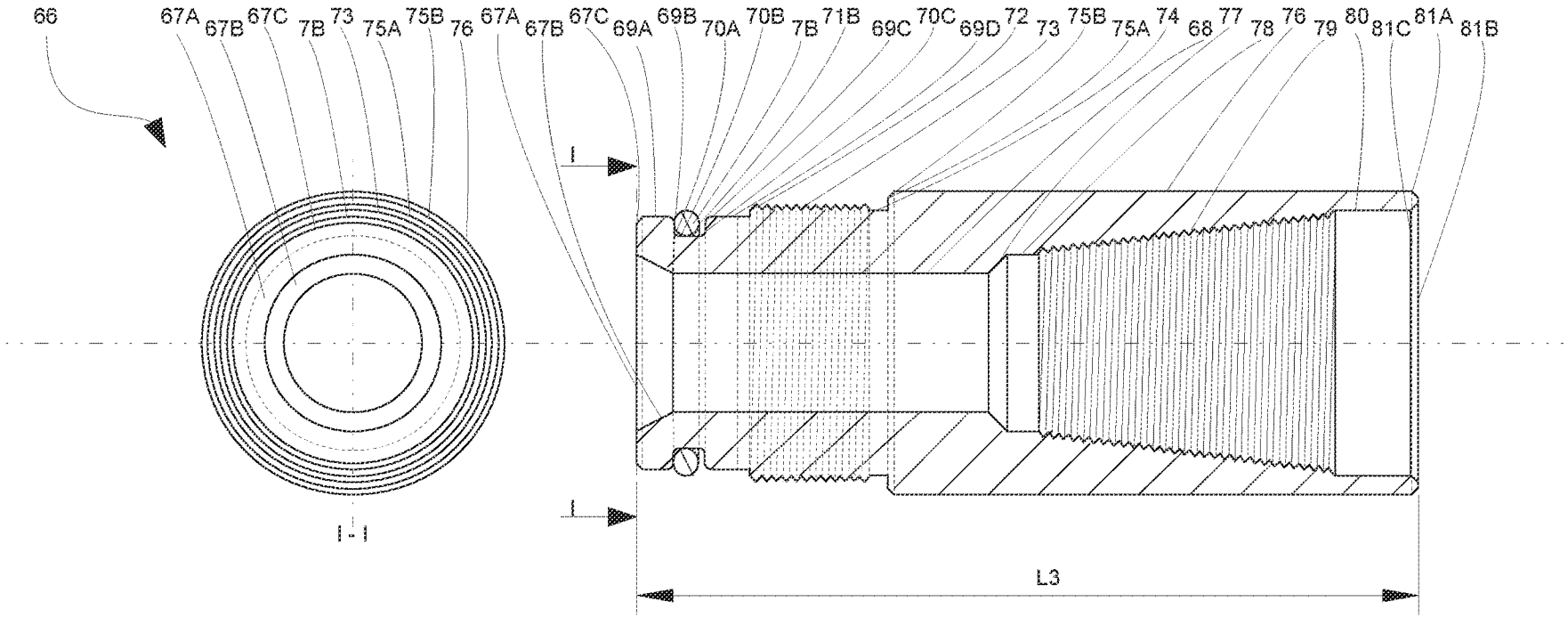
FIG. 7—Cross-sectional side view and lower end view I-I of the upper sub-assembly of the circulating downhole tool utilising a variable fluid pressure regulated cycle valve device shown in FIG. 1.

The cross-sectional side view and lower end view I-I of the upper sub-assembly 66 of the circulating downhole tool utilising a variable fluid pressure regulated cycle valve device 1, is shown in FIG. 7.

The upper sub-assembly 66 of the circulating downhole tool utilising a variable fluid pressure regulated cycle valve device 1, has an upper sub-assembly lower flat face 67A. The upper sub-assembly lower flat face 67A has an upper sub-assembly lower flat face countersunk hole 67B that is located centrally about the centre-line axis of the upper sub-assembly 66 of the circulating downhole tool utilising a variable fluid pressure regulated cycle valve device 1. The upper sub-assembly lower flat face countersunk hole 67B is interconnected to the upper sub-assembly lower hole 68 that is located centrally about the centre-line axis of the upper sub-assembly 66 of the circulating downhole tool utilising a variable fluid pressure regulated cycle valve device 1, as shown in FIG. 7. The upper sub-assembly lower flat face 67A also has an upper sub-assembly lower flat face outer chamfered edge 67C. The upper sub-assembly lower flat face outer chamfered edge 67C is interconnected to the upper sub-assembly lower outer surface 69A. The upper sub-assembly lower outer surface 69A has an upper sub-assembly lower outer surface radiused upper edge 69B. The upper sub-assembly lower outer surface radiused upper edge 69B is interconnected to the upper sub-assembly O-ring channel radiused lower edge 70A. The upper sub-assembly O-ring channel radiused lower edge 70A is interconnected to the upper sub-assembly O-ring channel 70B. The upper sub-assembly O-ring channel 70B is interconnected to the upper sub-assembly O-ring channel radiused upper edge 70C. The upper sub-assembly O-ring channel radiused upper edge 70C is interconnected to the upper sub-assembly upper outer surface radiused upper edge 69C. The upper sub-assembly upper outer surface radiused upper edge 69C is interconnected to the upper sub-assembly upper outer surface 69D. An upper sub-assembly O-ring 7B is located within the upper sub-assembly O-ring channel 70B. An upper sub-assembly O-ring gap 71B exists between the upper sub-assembly O-ring 7B and the upper sub-assembly O-ring channel radiused upper edge 70C to allow for the deformation of the upper sub-assembly O-ring 7B when the upper sub-assembly 66 is interconnected to the lower sub-assembly 2 of the circulating downhole tool utilizing a variable fluid pressure regulated cycle valve device 1, as shown in FIG. 1.

The upper sub-assembly upper outer surface 69D is interconnected to the upper sub-assembly stepped lower flat face 72. The upper sub-assembly stepped flat face 72 is perpendicular to the upper sub-assembly upper outer surface 69D. The upper sub-assembly parallel outer threaded section 73 interconnects the upper sub-assembly stepped flat face 72 to the upper sub-assembly intermediary outer surface 74. The upper sub-assembly intermediary outer surface 74 is interconnected to the upper sub-assembly stepped intermediary flat face 75A. The upper sub-assembly stepped intermediary flat face 75A is interconnected to the upper sub-assembly stepped intermediary flat face outer chamfered edge 75B. The upper sub-assembly upper outer surface 76 interconnects the upper sub-assembly stepped intermediary flat face outer chamfered edge 75B and the upper sub-assembly upper flat face outer chamfered edge 81A, as shown in FIG. 7. The upper sub-assembly upper flat face 81B has an upper sub-assembly upper flat face outer chamfered edge 81A and an upper sub-assembly upper flat face inner chamfered edge 81C. The upper sub-assembly upper flat face inner chamfered edge 81C is interconnected to the upper sub-assembly upper hole 80. The upper sub-assembly upper hole 80 is located centrally about the centre-line axis of the upper sub-assembly 66, as shown in FIG. 7. The upper sub-assembly upper hole 80 is interconnected to the upper sub-assembly tapered inner threaded section 79. The upper sub-assembly tapered inner threaded section 79 is interconnected to the upper sub-assembly intermediary hole 78. The upper sub-assembly tapered inner threaded section 79 and the interconnected upper sub-assembly intermediary hole 78 are located centrally about the centre-line axis of the upper sub-assembly 66. The upper sub-assembly intermediary hole 78 is interconnected to the upper sub-assembly intermediary countersunk hole 77. The upper sub-assembly intermediary countersunk hole 77 is interconnected to the upper sub-assembly lower hole 68, as shown in FIG. 7.

The upper sub-assembly lower hole 68, and the upper sub-assembly lower outer surface 69A, and the upper sub-assembly upper outer surface 69D, and the upper sub-assembly O-ring channel 70B, and the upper sub-assembly parallel outer threaded section 73, and the upper sub-assembly intermediary outer surface 74, and the upper sub-assembly upper outer surface 76, and the upper sub-assembly intermediary hole 78, and the upper sub-assembly upper hole 80, are all parallel to one another and to the centre-line axis of the upper sub-assembly 66, as shown in FIG. 7.

Figure 8:
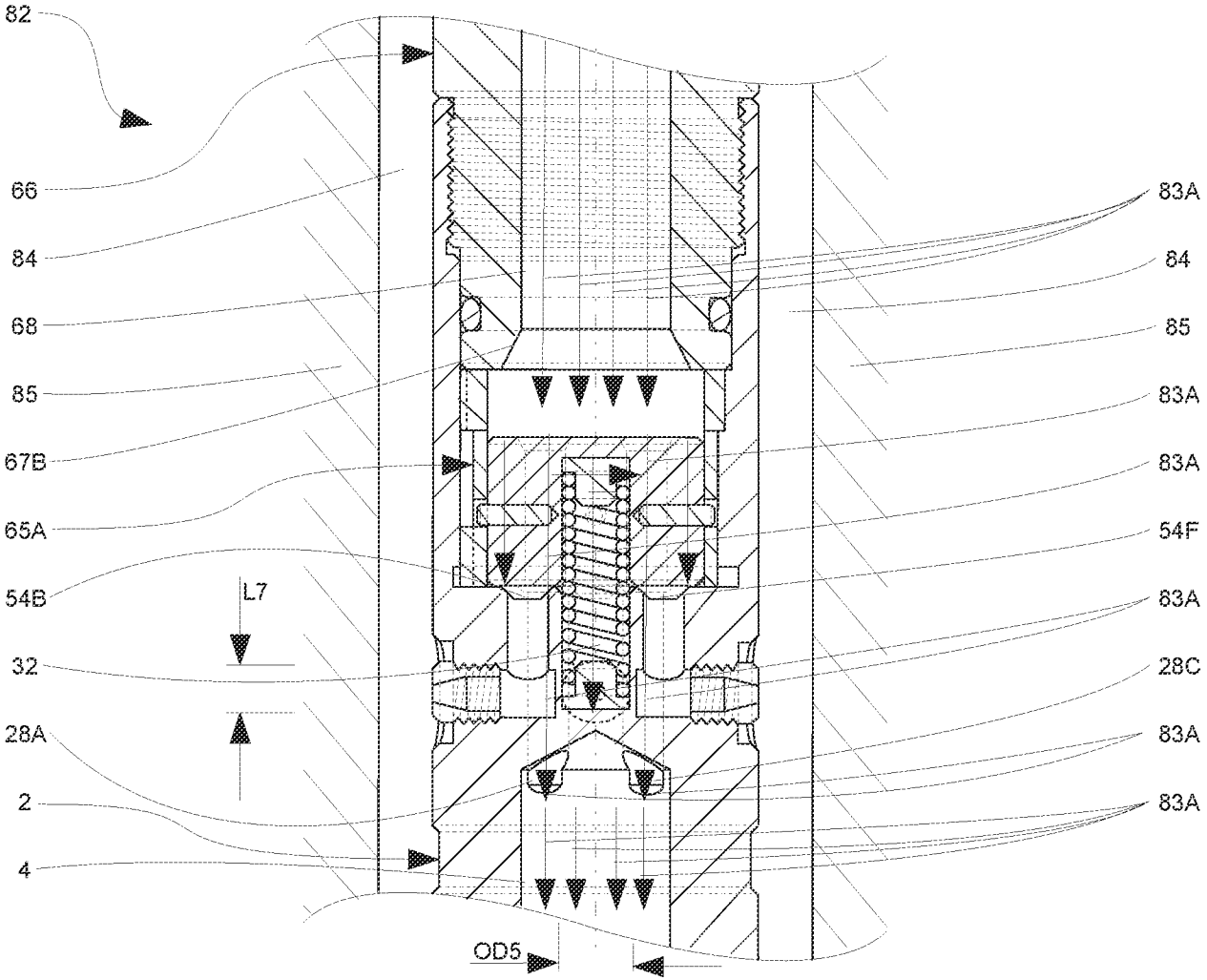
FIG. 8—Cross-sectional cutaway side view of the circulating downhole tool utilising a variable fluid pressure regulated cycle valve device operating in the through-flow remotely operated mode-of-operation whilst operating vertically in a wellbore formation and being supplied with high flow rate and high pressure drilling fluid.

FIG. 8 shows the cross-sectional cutaway side view of the circulating downhole tool utilising a variable fluid pressure regulated cycle valve device 82 operating in the through-flow remotely operated mode-of-operation whilst operating vertically in a wellbore formation 85 and being supplied with high flow rate and high pressure drilling fluid 83A.

FIG. 8 shows the circulating downhole tool utilising a variable fluid pressure regulated cycle valve device 82 being supplied with high flow rate and high pressure drilling fluid 83A and being directed by the cycle valve 53A, that is inserted longitudinally inside the two-part cycle valve sleeve 33A, as shown in FIG. 6A, and flowing through the cycle valve upper flat face countersunk holes 64B, 64D, 64F, 64H and the interconnected four cycle valve through holes 64A, 64C, 64E, 64G, respectively, and flowing into the in-line lower sub-assembly lower channel flat face countersunk holes 28B, 28D, 28F, 28H, respectively, and flowing through the interconnected lower sub-assembly lower channel holes 28A, 28C, 28E, 28G, respectively, and flowing into the lower sub-assembly lower flat face inner chamfered edge hole 4, and flowing into a section of the lower borehole assembly that could include a drilling bit, not shown in FIG. 8.

Figure 9:
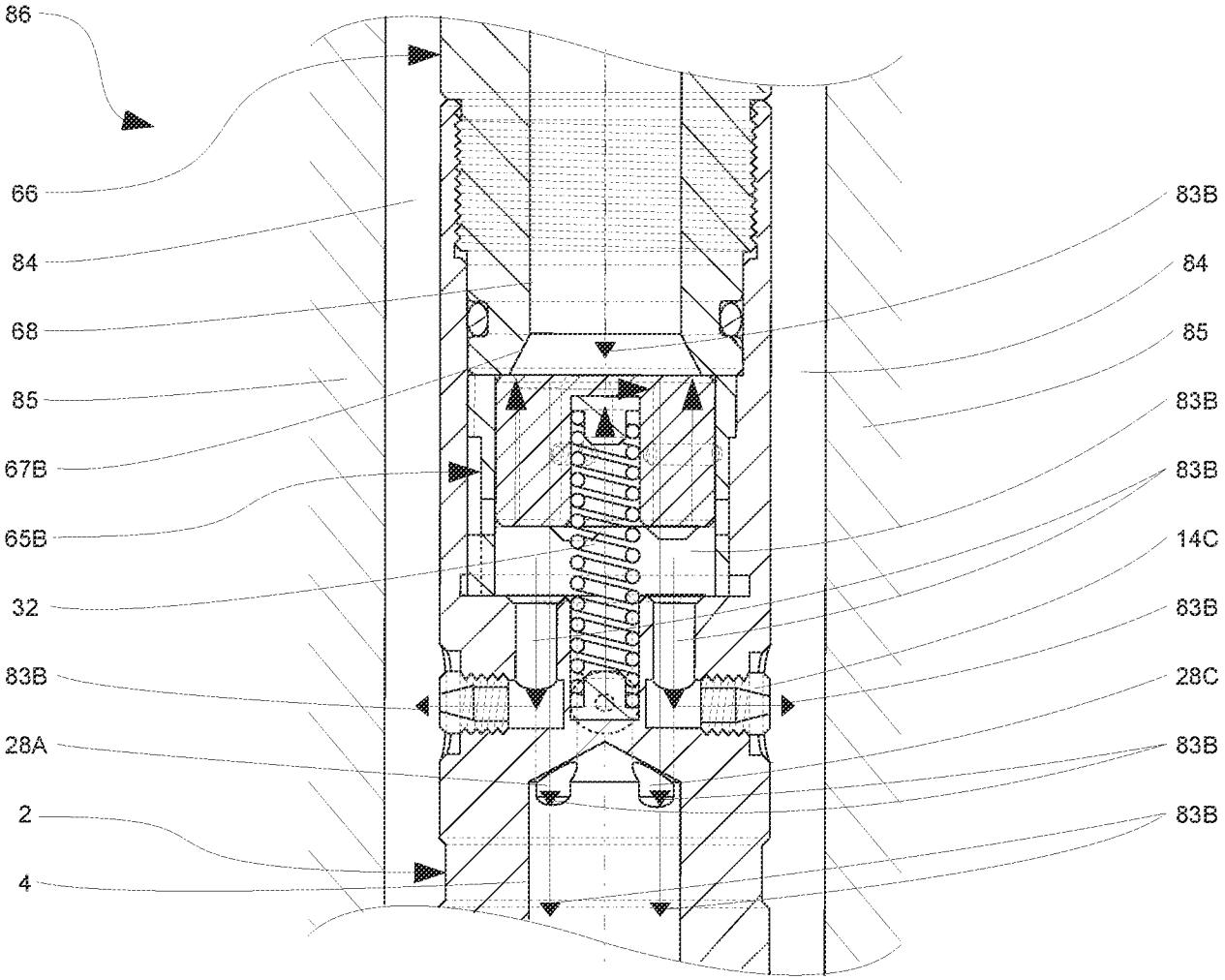
FIG. 9—Cross-sectional cutaway side view of the circulating downhole tool utilising a variable fluid pressure regulated cycle valve device operating in the intermediary remotely operated mode-of-operation whilst operating vertically in a wellbore formation and being supplied with low flow rate and low pressure drilling fluid.

When the circulating downhole tool utilising a variable fluid pressure regulated cycle valve device 82, as shown in FIG. 8, is lowered down the wellbore formation 85 to a pre-determined depth controlled by the operator of the drilling platform, not shown in FIG. 8, the operator of the drilling fluid pump on the drilling platform, not shown in FIG. 8, can at any time remotely operate a change in the mode-of-operation of the circulating downhole tool utilising a variable fluid pressure regulated cycle valve device 1, from the intermediary remotely operated mode-of-operation of the circulating downhole tool utilising a variable fluid pressure regulated cycle valve device 1, as shown in FIG. 1, the configuration of which will be described in more detail in the intermediary remotely operated mode-of-operation of the circulating downhole tool utilising a variable fluid pressure regulated cycle valve device 86, as shown in FIG. 9, to the through-flow remotely operated mode-of-operation of the circulating downhole tool utilising a variable fluid pressure regulated cycle valve device 82, as shown in FIG. 8.

The through-flow remotely operated mode-of-operation of the circulating downhole tool utilising a variable fluid pressure regulated cycle valve device 82, as shown in FIG. 8, can be accomplished by switching on the drilling fluid pump or increasing the drilling fluid pump flow rate and pressure above a pre-determined drilling fluid flow rate and pressure that will exceed the compression spring compression force characteristics including the spring force constant of the compression spring 32 housed within the circulating downhole tool utilising a variable fluid pressure regulated cycle valve device 82, as shown in FIG. 8.

The lower sub-assembly tapered outer threaded section 5 of the lower sub-assembly 2, as shown in FIG. 2, of the circulating downhole tool utilising a variable fluid pressure regulated cycle valve device 82, as shown in FIG. 8, will need to be interconnected to a lower borehole assembly tapered inner threaded section, not shown in FIG. 8. The lower borehole assembly tapered inner threaded section, not shown in FIG. 8, could be a section of the lower borehole assembly that could include a drilling bit, not shown in FIG. 8, that will be initially lowered by a drilling platform, not shown in FIG. 8, into the wellbore formation 85.

The upper sub-assembly tapered inner threaded section 79 of the upper sub-assembly 66, as shown in FIG. 7, of the circulating downhole tool utilising a variable fluid pressure regulated cycle valve device 82, as shown in FIG. 8, will need to be interconnected to an upper borehole assembly tapered inner threaded section, not shown in FIG. 8. The upper borehole assembly tapered inner threaded section, not shown in FIG. 8, could be a section of the upper borehole assembly that could include coiled tubing, not shown in FIG. 8, that will be uncoiled and lowered by a drilling platform, not shown in FIG. 8, into the wellbore formation 85.

The drilling fluid pump on the drilling platform, not shown in FIG. 8, will pump high flow rate and high pressure drilling fluid 83A into the section of the upper borehole assembly that could include coiled tubing, not shown in FIG. 8, that will be uncoiled and lowered by a drilling platform, not shown in FIG. 8, into the wellbore formation 85. The high flow rate and high pressure drilling fluid 83A will then flow into the interconnected upper-assembly 66 of the circulating downhole tool utilising a variable fluid pressure regulated cycle valve device 82.

FIG. 8 shows the high flow rate and high pressure drilling fluid 83A flowing through the upper sub-assembly lower hole 68 and through the interconnected upper sub-assembly lower flat face countersunk hole 67B. The high flow rate and high pressure drilling fluid 83A then flows onto and presses against the cycle valve upper flat face 58 of the cycle valve 53A that is inserted inside the two-part cycle valve sleeve 33A. The cycle valve 53A has been longitudinally displaced along the centre-line axis by the longitudinal force of the high flow rate and high pressure drilling fluid 83A that flows onto and presses against the cycle valve upper flat face 58 of the cycle valve 53A that is inserted inside the two-part cycle valve sleeve 33A, as shown in FIG. 6A and FIG. 8. This occurs as the high flow rate and high pressure drilling fluid 83A, as shown in FIG. 8, that flows onto and presses against the cycle valve upper flat face 58 of the cycle valve 53A that is inserted inside the two-part cycle valve sleeve 33A, as shown in FIG. 6A and FIG. 8, exceeds a pre-determined drilling fluid flow rate and pressure that exceeds the compression spring compression force characteristics including the spring force constant of the compression spring 32. This results in the compression of the compression spring 32, as shown in FIG. 8, as the compression spring centralising cap 31E that is located inside the cycle valve lower flat face central hole 56B and is pressed against the cycle valve lower flat face central hole flat face 56C, has been longitudinally displaced along the centre-line axis with the cycle valve 53A, towards the compression spring centralising cap 31A, that is inserted into the lower sub-assembly lower channel flat face central hole 29B and which presses against the lower sub-assembly lower channel flat face central hole flat face 29C, as shown in FIG. 8.

The cycle valve lower flat face 55 is in-line with the two-part cycle valve sleeve lower half lower flat face 34A and is pressing against the lower sub-assembly lower channel flat face 30, as shown in FIG. 8. FIG. 6A and FIG. 8 also show that the four cycle valve guide pins 59A, 60A, 61A, 62A are pressed against the two-part cycle valve sleeve lower half curved notches 37A, 37C, 37E, 37G, respectively, on the two-part cycle valve sleeve lower half upper patterned face 34B. The cycle valve 53A in FIG. 6A and FIG. 8 is orientated 0° about the centre-line axis and from the horizontal and vertical axes, as shown in FIG. 5A.

FIG. 5A shows that the four cycle valve truncated cone stoppers 54A, 54B, and 54C, 54D, and 54E, 54F, and 54G, 54H, are extensions located on the cycle valve lower flat face 55. FIG. 6A shows that the four cycle valve truncated cone stoppers 54A, 54B, and 54C, 54D, and 54E, 54F, and 54G, 54H are longitudinally displaced along the centre-line axis and to the left past the two-part cycle valve sleeve lower half lower flat face 34A. FIG. 8 shows that the two-part cycle valve sleeve lower half lower flat face 34A is pressed against the lower sub-assembly lower channel flat face 30. FIG. 8 also shows that the four cycle valve truncated cone stoppers 54A, 54B, and 54C, 54D, and 54E, 54F, and 54G, 54H are pressed against and are seated within the lower sub-assembly lower channel flat face countersunk holes 17A, 17B, 17C, 17D, respectively, and the interconnected lower sub-assembly lower channel holes 16A, 16B, 16C, 16D, respectively, which blocks the high flow rate and high pressure drilling fluid 83A from flowing through the lower sub-assembly lower channel flat face countersunk holes 17A, 17B, 17C, 17D, and the interconnected to the lower sub-assembly lower channel holes 16A, 16B, 16C, 16D, respectively, and the interconnected lower sub-assembly inner holes 15A, 15B, 15C, 15D, respectively, and the interconnected lower sub-assembly threaded nozzles 14A, 14B, 14C, 14D, respectively, as shown in FIG. 8. This occurs as the cycle valve 53A, as shown in FIG. 5A and FIG. 8, has its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, are all orientated 0° about the centre-line axis and from the horizontal and vertical axes of the lower end view of the cycle valve 53A of the circulating downhole tool utilising a variable fluid pressure regulated cycle valve device 82 shown in FIG. 8.

However, the high flow rate and high pressure drilling fluid 83A is able to flow freely through the cycle valve upper flat face countersunk holes 64B, 64D, 64F, 64H and the interconnected four cycle valve through holes 64A, 64C, 64E, 64G, respectively, as the lower end view of the cycle valve 53A, as shown in FIG. 5A, shows that the four cycle valve through holes 64A, 64C, 64E, 64G and the interconnected cycle valve upper flat face countersunk holes 64B, 64D, 64F, 64H, respectively, are rotationally separated by 45° about the centre-line axis and from the horizontal and vertical axes of the lower end view of the cycle valve 53A of the circulating downhole tool utilising a variable fluid pressure regulated cycle valve device 82, and to the four cycle valve guide pins 59A, 60A, 61A, 62A, and the four cycle valve guide pin holes 63A,63B, 63C, 63D, and the four cycle valve truncated cone stoppers 54A, 54B, and 54C, 54D, and 54E, 54F, and 54G, 54H. The high flow rate and high pressure drilling fluid 83A is then able to flow freely through the four cycle valve through holes 64A, 64C, 64E, 64G and into the in-line lower sub-assembly lower channel flat face countersunk holes 28B, 28D, 28F, 28H, respectively, on the lower sub-assembly lower channel flat face 30 of the lower sub-assembly 2, as shown in FIG. 8. The high flow rate and high pressure drilling fluid 83A is then able to flow freely into the interconnected lower sub-assembly lower channel holes 28A, 28C, 28E, 28G, respectively. The lower sub-assembly lower channel holes 28A, 28C, 28E, 28G are interconnected to and are drilled through the lower sub-assembly lower flat face inner chamfered edge hole cone 12 and into the lower sub-assembly lower flat face inner chamfered edge hole 4, as shown in FIG. 2 and FIG. 8. The high flow rate and high pressure drilling fluid 83A is then able to flow freely into the lower sub-assembly lower flat face inner chamfered edge hole 4 of the lower sub-assembly 2.

The lower sub-assembly tapered outer threaded section 5 of the lower sub-assembly 2, as shown in FIG. 2, of the circulating downhole tool utilising a variable fluid pressure regulated cycle valve device 82, as shown in FIG. 8, will need to be interconnected to a lower borehole assembly tapered inner threaded section, not shown in FIG. 8. The lower borehole assembly tapered inner threaded section, not shown in FIG. 8, could be a section of the lower borehole assembly that could include a drilling bit, not shown in FIG. 8, that will be initially lowered by a drilling platform, not shown in FIG. 8, into the wellbore formation 85. The high flow rate and high pressure drilling fluid 83A that is able to flow freely into the lower sub-assembly lower flat face inner chamfered edge hole 4 of the lower sub-assembly 2 could then flow into the section of the lower borehole assembly that could include a drilling bit, not shown in FIG. 8, so that the high flow rate and high pressure drilling fluid 83A keeps the drilling bit, not shown in FIG. 8, well lubricated for example.

When the circulating downhole tool utilising a variable fluid pressure regulated cycle valve device 82, as shown in FIG. 8, is lowered down the wellbore formation 85 to a pre-determined depth controlled by the operator of the drilling platform, not shown in FIG. 8, the operator of the drilling fluid pump on the drilling platform, not shown in FIG. 8, can at any time remotely operate a change in the mode-of-operation of the circulating downhole tool utilising a variable fluid pressure regulated cycle valve device 82, as shown in FIG. 8, from the through-flow remotely operated mode-of-operation of the circulating downhole tool utilising a variable fluid pressure regulated cycle valve device 82 shown in FIG. 8, to the intermediary remotely operated mode-of-operation of the circulating downhole tool utilising a variable fluid pressure regulated cycle valve device 86 shown in FIG. 9. This may be required when the operator of the drilling platform, not shown in FIG. 8, wants to transition the circulating downhole tool utilising a variable fluid pressure regulated cycle valve device 82 shown in FIG. 8, from having the high flow rate and high pressure drilling fluid 83A flowing into the lower sub-assembly lower flat face inner chamfered edge hole 4, as shown in FIG. 8, to keep the drilling bit, not shown in FIG. 8, well lubricated for example, to being used for other useful applications.

FIG. 9 shows the cross-sectional cutaway side view of the circulating downhole tool utilising a variable fluid pressure regulated cycle valve device 86 operating in the intermediary remotely operated mode-of-operation whilst operating vertically in a wellbore formation 85 and being supplied with low flow rate and low pressure drilling fluid 83B.

The intermediary remotely operated mode-of-operation of the circulating downhole tool utilising a variable fluid pressure regulated cycle valve device 86, as shown in FIG. 9, can be accomplished by momentarily either switching off the drilling fluid pump or decreasing the drilling fluid pump flow rate and pressure, not shown in FIG. 9, to produce low flow rate and low pressure drilling fluid 83B, as shown in FIG. 9, that is below a pre-determined drilling fluid flow rate and pressure that will not exceed the compression spring compression force characteristics including the spring force constant of the compression spring 32, and FIG. 9 shows the resultant effect on the circulating downhole tool utilising a variable fluid pressure regulated cycle valve device 86.

The lower sub-assembly tapered outer threaded section 5 of the lower sub-assembly 2, as shown in FIG. 2, of the circulating downhole tool utilising a variable fluid pressure regulated cycle valve device 86, as shown in FIG. 9, will need to be interconnected to a lower borehole assembly tapered inner threaded section, not shown in FIG. 9. The lower borehole assembly tapered inner threaded section, not shown in FIG. 9, could be a section of the lower borehole assembly that could include a drilling bit, not shown in FIG. 9, that will be initially lowered by a drilling platform, not shown in FIG. 9, into the wellbore formation 85.

The upper sub-assembly tapered inner threaded section 79 of the upper sub-assembly 66, as shown in FIG. 7, of the circulating downhole tool utilising a variable fluid pressure regulated cycle valve device 86, as shown in FIG. 9, will need to be interconnected to an upper borehole assembly tapered inner threaded section, not shown in FIG. 9. The upper borehole assembly tapered inner threaded section, not shown in FIG. 9, could be a section of the upper borehole assembly that could include coiled tubing, not shown in FIG. 9, that will be uncoiled and lowered by a drilling platform, not shown in FIG. 9, into the wellbore formation 85.

The drilling fluid pump on the drilling platform, not shown in FIG. 9, will pump low flow rate and low pressure drilling fluid 83B into the section of the upper borehole assembly that could include coiled tubing, not shown in FIG. 9, that will be uncoiled and lowered by a drilling platform, not shown in FIG. 9, into the wellbore formation 85. The low flow rate and low pressure drilling fluid 83B will then flow into the interconnected upper-assembly 66 of the circulating downhole tool utilising a variable fluid pressure regulated cycle valve device 86. FIG. 9 shows the low flow rate and low pressure drilling fluid 83B then flowing through the upper sub-assembly lower hole 68 and through the interconnected upper sub-assembly lower flat face countersunk hole 67B. The low flow rate and low pressure drilling fluid 83B then flows onto and presses against the cycle valve upper flat face 58 of the cycle valve 53A that is inserted inside the two-part cycle valve sleeve 33A.

FIG. 9, FIG. 6B and FIG. 5B shows the cycle valve 53B is inserted longitudinally inside the two-part cycle valve sleeve 33A, as shown in FIG. 3A. The cycle valve 53B is shown in FIG. 9 to have been longitudinally displaced upwards along the centre-line axis, from the cycle valve 53A position shown in FIG. 6A and FIG. 8, along the centre-line axis and which initially results in the four cycle valve guide pins 59A, 60A, 61A, 62A to slide along the two-part cycle valve sleeve lower half short flat-sided teeth 38A, 38C, 38E, 38G, respectively. This occurs as the low flow rate and low pressure drilling fluid 83B, as shown in FIG. 9, that flows onto and presses against the cycle valve upper flat face 58 of the cycle valve 53B that is inserted inside the two-part cycle valve sleeve 33A, as shown in FIG. 6B and FIG. 9, is below a pre-determined drilling fluid flow rate and pressure that will not exceed the compression spring compression force characteristics including the spring force constant of the compression spring 32. This causes the compression spring 32 to expand and exert a longitudinal force along the centre-line axis of the cycle valve 53B. The resulting expansion of the compression spring 32, as shown in FIG. 9, results in the compression spring centralising cap 31E that is located inside the cycle valve lower flat face central hole 56B and is pressed against the cycle valve lower flat face central hole flat face 56C, to be longitudinally displaced along the centre-line axis with the cycle valve 53B, and away from the compression spring centralising cap 31A, that is inserted into the lower sub-assembly lower channel flat face central hole 29B and which presses against the lower sub-assembly lower channel flat face central hole flat face 29C, as shown in FIG. 9.

The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within when the cycle valve 53B has a longitudinal force applied to it by the expanding compression spring 32, that results in the cycle valve 53B to be longitudinally displaced and rotated 22.5° in an uni-directional clock-wise direction about the centre-line axis of and inside the two-part cycle valve sleeve 33A. As the cycle valve 53B continues to have a longitudinal force applied to it by the expanding compression spring 32 along the centre-line axis, this results in the four cycle valve guide pins 59A, 60A, 61A, 62A to press against and then slide along the two-part cycle valve sleeve upper half long diagonal flat-sided teeth 42A, 42C, 42E, 42G, respectively, and towards the two-part cycle valve sleeve upper half curved notches 43A, 43C, 43E, 43G, respectively. The sliding action of the four cycle valve guide pins 59A, 60A, 61A, 62A along the two-part cycle valve sleeve upper half long diagonal flat-sided teeth 42A, 42C, 42E, 42G, respectively, results in the uni-directional 22.5° rotational clock-wise motion of the interconnected cycle valve 53B about the centre-line axis and from the horizontal and vertical axes, as shown in FIG. 5B, until the four cycle valve guide pins 59A, 60A, 61A, 62A are stopped by and are pressed against the two-part cycle valve sleeve upper half curved notches 43A, 43C, 43E, 43G, respectively, as shown in FIG. 6B.

The cycle valve 53B shown in FIG. 9, is now longitudinally displaced along the centre-line axis so that the cycle valve lower flat face 55 is longitudinally off-set to the two-part cycle valve sleeve lower half lower flat face 34A, and the cycle valve upper flat face 58 is shown to be resting and pressed against the upper sub-assembly lower flat face 67A. The cycle valve 53B and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5B and FIG. 6B and FIG. 9, have been rotationally orientated 22.5° clockwise about the centre-line axis and from the horizontal and vertical axes, from the cycle valve 53A and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H and its four cycle valve through holes 64A, 64C, 64E, 64G and its interconnected cycle valve upper flat face countersunk holes 64B, 64D, 64F, 64H, respectively, as shown in FIG. 5A and FIG. 6A and FIG. 8.

The low flow rate and low pressure drilling fluid 83B is able to flow freely through the cycle valve upper flat face countersunk holes 64B, 64D, 64F, 64H and the interconnected four cycle valve through holes 64A, 64C, 64E, 64G, as shown in FIG. 6B and FIG. 9. The low flow rate and low pressure drilling fluid 83B is also able to flow freely through the lower sub-assembly lower channel flat face countersunk holes 17A, 17B, 17C, 17D, and the interconnected to the lower sub-assembly lower channel holes 16A, 16B, 16C, 16D, respectively, and the interconnected lower sub-assembly inner holes 15A, 15B, 15C, 15D, respectively, and the interconnected lower sub-assembly threaded nozzles 14A, 14B, 14C, 14D. The low flow rate and low pressure drilling fluid 83B is shown in FIG. 9 to be radially sprayed at low flow rate and low pressure out of the lower sub-assembly threaded nozzles 14A, 14B, 14C, 14D and into the annulus 84.

It should be noted that the size of the arrows in FIG. 9 representing the low flow rate and low pressure drilling fluid 83B are smaller in scale and are less numerous than the size and number of the arrows in FIG. 8 representing the high flow rate and high pressure drilling fluid 83A, in order to graphically represent the difference between the low flow rate and low pressure drilling fluid 83B and the high flow rate and high pressure drilling fluid 83A.

FIG. 9 also shows that the low flow rate and low pressure drilling fluid 83B is also able to flow freely through the in-line lower sub-assembly lower channel flat face countersunk holes 28B, 28D, 28F, 28H on the lower sub-assembly lower channel flat face 30 of the lower sub-assembly 2. The low flow rate and low pressure drilling fluid 83B is then able to flow freely into the interconnected lower sub-assembly lower channel holes 28A, 28C, 28E, 28G, respectively, and into the lower sub-assembly lower flat face inner chamfered edge hole 4 of the lower sub-assembly 2.

The lower sub-assembly tapered outer threaded section 5 of the lower sub-assembly 2, as shown in FIG. 2 and FIG. 9, of the circulating downhole tool utilising a variable fluid pressure regulated cycle valve device 86, as shown in FIG. 9, will need to be interconnected to a lower borehole assembly tapered inner threaded section, not shown in FIG. 9. The lower borehole assembly tapered inner threaded section, not shown in FIG. 9, could be a section of the lower borehole assembly that could include a drilling bit, not shown in FIG. 9, that will be initially lowered by a drilling platform, not shown in FIG. 9, into the wellbore formation 85. The low flow rate and low pressure drilling fluid 83B that is able to flow freely into the lower sub-assembly lower flat face inner chamfered edge hole 4 of the lower sub-assembly 2 could then flow into the section of the lower borehole assembly that could include a drilling bit, not shown in FIG. 9, so that the low flow rate and low pressure drilling fluid 83B keeps the drilling bit, not shown in FIG. 9, lubricated, for example.

The circulating downhole tool utilising a variable fluid pressure regulated cycle valve device 86 shown in FIG. 9, could be described as being an intermediary remotely operated mode-of-operation of the circulating downhole tool utilising a variable fluid pressure regulated cycle valve device 1 shown in FIG. 1, where the low flow rate and low pressure drilling fluid 83B, as shown in FIG. 9, is below a pre-determined drilling fluid flow rate and pressure that will not exceed the compression spring compression force characteristics including the spring force constant of the compression spring 32, and FIG. 9 shows the resultant effect on the circulating downhole tool utilising a variable fluid pressure regulated cycle valve device 86.

Figure 10:
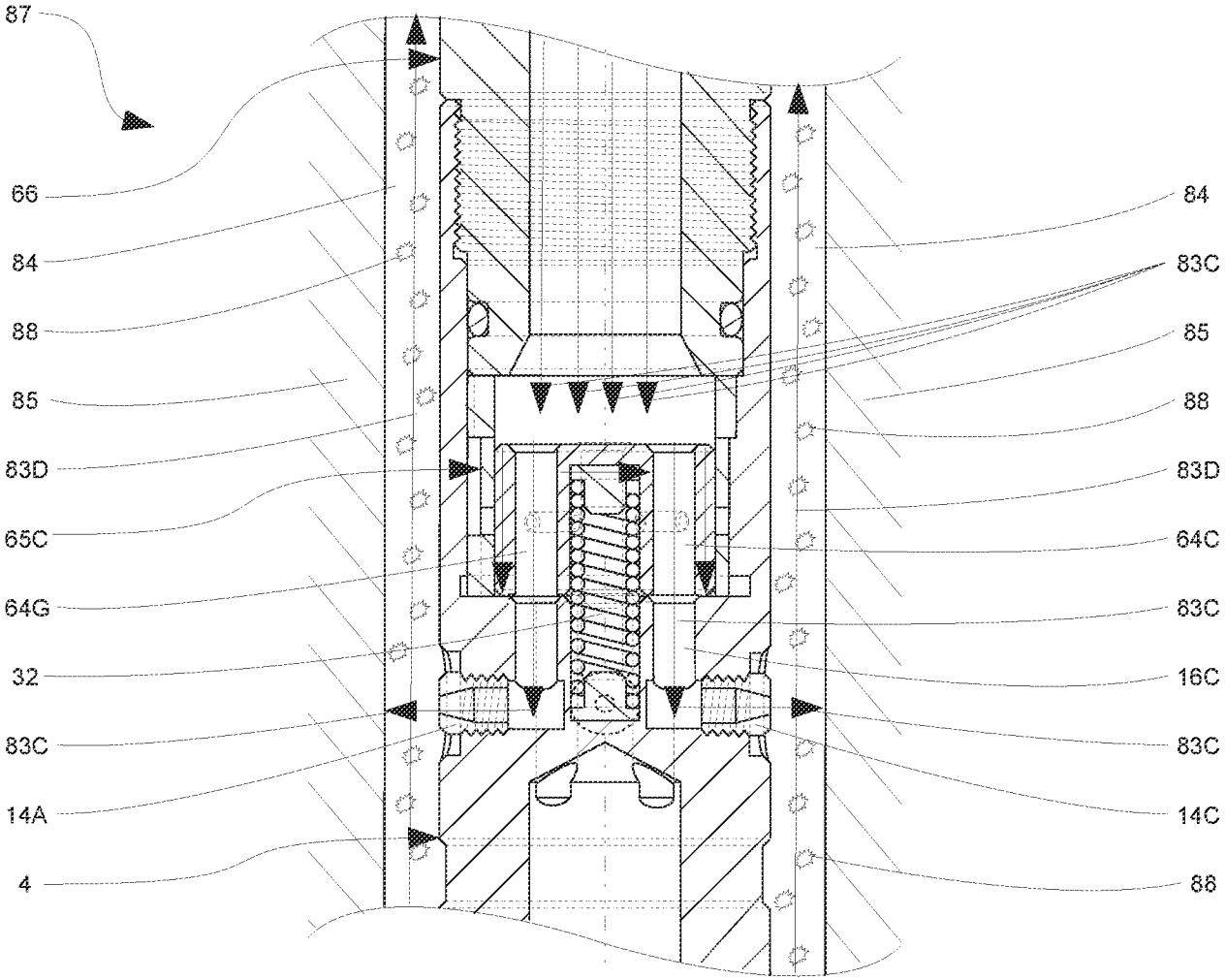
FIG. 10—Cross-sectional cutaway side view of the circulating downhole tool utilising a variable fluid pressure regulated cycle valve device operating in the circulatory remotely operated mode-of-operation whilst operating vertically in a wellbore formation and being supplied with high flow rate and high pressure drilling fluid.

FIG. 10 shows the cross-sectional cutaway side view of the circulating downhole tool utilising a variable fluid pressure regulated cycle valve device 87 operating in the circulatory remotely operated mode-of-operation whilst operating vertically in a wellbore formation 85 and being supplied with high flow rate and high pressure drilling fluid 83C.

When the circulating downhole tool utilising a variable fluid pressure regulated cycle valve device 87, as shown in FIG. 10, is lowered down the wellbore formation 85 to a pre-determined depth controlled by the operator of the drilling platform, the operator of the drilling fluid pump on the drilling platform, not shown in FIG. 10, can at any time remotely operate and change the mode-of-operation of the circulating downhole tool utilising a variable fluid pressure regulated cycle valve device 1, as shown in FIG. 1, from the intermediary remotely operated mode-of-operation of the circulating downhole tool utilising a variable fluid pressure regulated cycle valve device 86, as shown in FIG. 9, to the circulatory remotely operated mode-of-operation of the circulating downhole tool utilising a variable fluid pressure regulated cycle valve device 87, as shown in FIG. 10. The circulatory remotely operated mode-of-operation of the circulating downhole tool utilising a variable fluid pressure regulated cycle valve device, as shown in FIG. 10, can be accomplished when the drill fluid pump is switched back on or the drilling fluid pump flow rate and pressure are increased again, not shown in FIG. 10, to produce high flow rate and high pressure drilling fluid 83C that is above a pre-determined drilling fluid flow rate and pressure that will exceed the compression spring compression force characteristics including the spring force constant of the compression spring 32. FIG. 10 shows the resultant circulatory remotely operated mode-of-operation of the circulating downhole tool utilising a variable fluid pressure regulated cycle valve device 87.

The lower sub-assembly tapered outer threaded section 5 of the lower sub-assembly 2, as shown in FIG. 2, of the circulating downhole tool utilising a variable fluid pressure regulated cycle valve device 87, as shown in FIG. 10, will need to be interconnected to a lower borehole assembly tapered inner threaded section, not shown in FIG. 10.

The lower borehole assembly tapered inner threaded section, not shown in FIG. 10, could be a section of the lower borehole assembly that could include a drilling bit, not shown in FIG. 10, that will be initially lowered by a drilling platform, not shown in FIG. 10, into the wellbore formation 85.

The upper sub-assembly tapered inner threaded section 79 of the upper sub-assembly 66, as shown in FIG. 7, of the circulating downhole tool utilising a variable fluid pressure regulated cycle valve device 87, as shown in FIG. 10, will need to be interconnected to an upper borehole assembly tapered inner threaded section, not shown in FIG. 10. The upper borehole assembly tapered inner threaded section, not shown in FIG. 10, could be a section of the upper borehole assembly that could include coiled tubing, not shown in FIG. 10, that will be uncoiled and lowered by a drilling platform, not shown in FIG. 10, into the wellbore formation 85.

The drilling fluid pump on the drilling platform, not shown in FIG. 10, will pump high flow rate and high pressure drilling fluid 83C into the section of the upper borehole assembly that could include coiled tubing, not shown in FIG. 10, that will be uncoiled and lowered by a drilling platform, not shown in FIG. 10, into the wellbore formation 85. The high flow rate and high pressure drilling fluid 83C will then flow into the interconnected upper-assembly 66 of the circulating downhole tool utilising a variable fluid pressure regulated cycle valve device 87, as shown in FIG. 10.

FIG. 10 shows the high flow rate and high pressure drilling fluid 83C flowing through the upper sub-assembly lower hole 68 and through the interconnected upper sub-assembly lower flat face countersunk hole 67B. The high flow rate and high pressure drilling fluid 83C then flows onto and presses against the cycle valve upper flat face 58 of the cycle valve 53C that is inserted inside the two-part cycle valve sleeve 33A.

FIG. 10, FIG. 6C and FIG. 5C shows the cycle valve 53C is inserted longitudinally inside the two-part cycle valve sleeve 33A, as shown in FIG. 3A. The cycle valve 53C is shown in FIG. 10 to have been longitudinally displaced downwards along the centre-line axis, from the cycle valve 53B position shown in FIG. 6B and FIG. 9, along the centre-line axis and which initially results in the four cycle valve guide pins 59A, 60A, 61A, 62A to initially slide along the two-part cycle valve sleeve upper half short flat-sided teeth 44A, 44C, 44E, 44G, respectively. This occurs as the high flow rate and high pressure drilling fluid 83C, as shown in FIG. 10, that flows onto and presses against the cycle valve upper flat face 58 of the cycle valve 53C that is inserted inside the two-part cycle valve sleeve 33A, as shown in FIG. 6C and FIG. 10, exceeds a pre-determined drilling fluid flow rate and pressure that will exceed the compression spring compression force characteristics including the spring force constant of the compression spring 32. This results in the compression of the compression spring 32, as shown in FIG. 10, as the compression spring centralising cap 31E that is located inside the cycle valve lower flat face central hole 56B and is pressed against the cycle valve lower flat face central hole flat face 56C, has been longitudinally displaced along the centre-line axis with the cycle valve 53C, towards the compression spring centralising cap 31A, that is inserted into the lower sub-assembly lower channel flat face central hole 29B and which presses against the lower sub-assembly lower channel flat face central hole flat face 29C, as shown in FIG. 10.

The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within when the cycle valve 53C has a longitudinal force applied to it by the high flow rate and high pressure drilling fluid 83C, that results in the cycle valve 53C to be longitudinally displaced and rotated 22.5° in an uni-directional clock-wise direction about the centre-line axis of and inside the two-part cycle valve sleeve 33A.

As the cycle valve 53C continues to be longitudinally displaced downwards by the longitudinal force applied to it by the high flow rate and high pressure drilling fluid 83C, as shown in FIG. 10, along the centre-line axis, this results in the four cycle valve guide pins 59A, 60A, 61A, 62A to press against and then slide along the two-part cycle valve sleeve lower half long diagonal flat-sided teeth 41A, 41C, 41E, 41G, respectively, and towards the two-part cycle valve sleeve lower half curved notches 37B, 37D, 37F, 37H, respectively. The sliding action of the four cycle valve guide pins 59A, 60A, 61A, 62A along the two-part cycle valve sleeve lower half long diagonal flat-sided teeth 41A, 41C, 41E, 41G, respectively, results in the uni-directional 22.5° rotational clock-wise motion of the interconnected cycle valve 53C about the centre-line axis and from the horizontal and vertical axes, as shown in FIG. 5C, until the four cycle valve guide pins 59A, 60A, 61A, 62A are stopped by and are pressed against the two-part cycle valve sleeve lower half curved notches 37B, 37D, 37F, 37H, respectively, as shown in FIG. 6C and FIG. 10. It should be noted that the cycle valve 53C is longitudinally displaced downwards along the centre-line axis so that the cycle valve lower flat face 55 is in-line with the two-part cycle valve sleeve lower half lower flat face 34A. The cycle valve 53C shown in FIG. 10 is therefore in the same longitudinal position along the centre-line axis inside the two-part cycle valve sleeve 33A, as the cycle valve 53A shown in FIG. 8.

However, the cycle valve 53C and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5C and FIG. 6C and FIG. 10, are rotationally orientated 45° clockwise about the centre-line axis and from the horizontal and vertical axes, from the cycle valve 53A and its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, and its four cycle valve through holes 64A, 64C, 64E, 64G, and its interconnected cycle valve upper flat face countersunk holes 64B, 64D, 64F, 64H, respectively, as shown in FIG. 5A and FIG. 6A and FIG. 8.

FIG. 5C shows that the four cycle valve truncated cone stoppers 54A, 54B, and 54C, 54D, and 54E, 54F, and 54G, 54H, are extensions located on the cycle valve lower flat face 55. FIG. 6C shows that the four cycle valve truncated cone stoppers 54A, 54B, and 54C, 54D, and 54E, 54F, and 54G, 54H are longitudinally displaced along the centre-line axis and to the left past the two-part cycle valve sleeve lower half lower flat face 34A. FIG. 10 shows that the two-part cycle valve sleeve lower half lower flat face 34A is pressed against the lower sub-assembly lower channel flat face 30. FIG. 10 also shows that the four cycle valve truncated cone stoppers 54A, 54B, and 54C, 54D, and 54E, 54F, and 54G, 54H are pressed against and are seated within the lower sub-assembly lower channel flat face countersunk holes 28B, 28D, 28F, 28H, and the interconnected lower sub-assembly lower channel holes 28A, 28C, 28E, 28G, respectively, which blocks the high flow rate and high pressure drilling fluid 83C from flowing through the lower sub-assembly lower channel flat face countersunk holes 28B, 28D, 28F, 28H, and the interconnected lower sub-assembly lower channel holes 28A, 28C, 28E, 28G, respectively. The lower sub-assembly lower channel holes 28A, 28C, 28E, 28G are interconnected to and are drilled through the lower sub-assembly lower flat face inner chamfered edge hole cone 12 and into the lower sub-assembly lower flat face inner chamfered edge hole 4, as shown in FIG. 2 and FIG. 10. This occurs as the cycle valve 53C, as shown in FIG. 5C and FIG. 10, has its four cycle valve guide pins 59A, 60A, 61A, 62A, and its four cycle valve guide pin holes 63A, 63B, 63C, 63D, and its four cycle valve truncated cone stoppers 54A, 54B, and 54C, 54D, and 54E, 54F, and 54G, 54H, are all orientated 45° about the centre-line axis and from the horizontal and vertical axes of the lower end view of the cycle valve 53C of the circulating downhole tool utilizing a variable fluid pressure regulated cycle valve device 87 shown in FIG. 10. However, the high flow rate and high pressure drilling fluid 83C is able to flow freely through the cycle valve upper flat face countersunk holes 64B, 64D, 64F, 64H and the interconnected four cycle valve through holes 64A, 64C, 64E, 64G, as the lower end view of the cycle valve 53C, as shown in FIG. 5C, shows that the four cycle valve through holes 64A, 64C, 64E, 64G and the interconnected cycle valve upper flat face countersunk holes 64B, 64D, 64F, 64H, respectively, are rotationally separated by 45° about the centre-line axis and from the horizontal and vertical axes of the lower end view of the cycle valve 53C of the circulating downhole tool utilising a variable fluid pressure regulated cycle valve device 87, and to the four cycle valve guide pins 59A, 60A, 61A, 62A, and the four cycle valve guide pin holes 63A,63B, 63C, 63D, and the four cycle valve truncated cone stoppers 54A, 54B, and 54C, 54D, and 54E, 54F, and 54G, 54H. The high flow rate and high pressure drilling fluid 83C is then able to flow freely through the four cycle valve through holes 64A, 64C, 64E, 64G and into the in-line lower sub-assembly lower channel flat face countersunk holes 17A, 17B, 17C, 17D, respectively, on the lower sub-assembly lower channel flat face 30 of the lower sub-assembly 2, as shown in FIG. 10. The high flow rate and high pressure drilling fluid 83C is then able to flow freely into the interconnected lower sub-assembly lower channel holes 16A, 16B, 16C, 16D, respectively, and into the interconnected lower sub-assembly inner holes 15A, 15B, 15C, 15D, respectively, and into the interconnected lower sub-assembly threaded nozzles 14A, 14B, 14C, 14D that are releaseably and securely threaded to the lower sub-assembly tapped intermediary holes 13E, 13F, 13G, 13H, respectively.

The high flow rate and high pressure drilling fluid 83C is shown in FIG. 10 to be ejected radially from the lower sub-assembly threaded nozzles 14A, 14B, 14C, 14D that are located equidistantly and are rotationally separated by 90° about the centre-line axis to one another around the lower sub-assembly upper outer surface 11B, as shown in FIG. 2 and FIG. 10.

It should be noted that the size of the arrows in FIG. 10 representing the high flow rate and high pressure drilling fluid 83C are larger in scale and are more numerous than the size and number of the arrows in FIG. 9 representing the low flow rate and low pressure drilling fluid 83B, in order to graphically represent the difference between the high flow rate and high pressure drilling fluid 83C and the low flow rate and low pressure drilling fluid 83B.

The high flow rate and high pressure drilling fluid 83C that will be injected into the annulus 84 will have the effect of increasing the annular velocity of the annulus drilling fluid 83D, so enhancing the effective cuttings transport removal 88 from the drill bit, not shown in FIG. 10, and returning along the annulus 84 to the surface, not shown in FIG. 10.

The high flow rate and high pressure drilling fluid 83C that will be injected into the annulus 84 could also be used to effectively counter loss of circulation, which occurs when the high flow rate and high pressure drilling fluid 83C flows into the wellbore formation 85 instead of returning along the annulus 84 as annulus drilling fluid 83D to the surface, by deploying or spotting remediation the high flow rate and high pressure drilling fluid 83C known as lost-circulation material LCM into the wellbore formation 85. The high flow rate and high pressure drilling fluid 83C that will be injected into the annulus 84 could also be used for wellbore clean-up operations, as the increased annulus drilling fluid 83D flow rate could be accomplished by opening annulus drilling fluid 83D flow paths above small hole internal diameter flow restricting annular sections or large outer diameter borehole assembly string components, not shown in FIG. 10, and by bypassing smaller annular sections, not shown in FIG. 10, which beneficially would allow the maximum volume flow rate of annulus drilling fluid 83D to be directed along the annulus 84, which would boost the annulus drilling fluid 83D annular velocity for more effective wellbore clean-up above the circulating downhole tool utilising a variable fluid pressure regulated cycle valve device 87 location whilst lowering the high flow rate and high pressure drilling fluid 83C pump pressure, not shown in FIG. 10.

The high flow rate and high pressure drilling fluid 83C that will be injected into the annulus 84 could also be used for reducing equivalent circulating density (ECD) window considerations at the bottom of the wellbore formation 85, and this could be achieved by using the circulatory remotely operated mode-of-operation of the circulating downhole tool utilising a variable fluid pressure regulated cycle valve device 87, as shown in FIG. 10. By having the circulating downhole tool utilising a variable fluid pressure regulated cycle valve device 87 above the lower bore hole assembly BHA, not shown in FIG. 10, the lower BHA would be by-passed which would reduce the high flow rate and high pressure drilling fluid 83C pump requirements, not shown in FIG. 10, which would beneficially increase the high flow rate and high pressure drilling fluid 83C pumps reliability and operating hours, not shown in FIG. 10.

The high flow rate and high pressure drilling fluid 83C that will be injected into the annulus 84 could also be used for blowout preventer BOP stack jetting, as the circulatory remotely operated mode-of-operation of the circulating downhole tool utilising a variable fluid pressure regulated cycle valve device 87, as shown in FIG. 10, would also be beneficial by being used to hydroblast any BOP cavities or subsea wellheads by dislodging debris in the BOP stack, not shown in FIG. 10.

The high flow rate and high pressure drilling fluid 83C that will be injected into the annulus 84 could also be used during liner running, not shown in FIG. 10, where the circulatory remotely operated mode-of-operation of the circulating downhole tool utilising a variable fluid pressure regulated cycle valve device 87, as shown in FIG. 10, would also be beneficial by being used with auto fill float equipment, not shown in FIG. 10, by establishing two avenues of high flow rate and high pressure drilling fluid 83C communication between the BHA pipe interior, not shown in FIG. 10, and the annulus 84, so reducing the surge pressure in the annulus 84.

The lower sub-assembly tapered outer threaded section 5 of the lower sub-assembly 2, as shown in FIG. 2, of the circulating downhole tool utilising a variable fluid pressure regulated cycle valve device 82, as shown in FIG. 8, will need to be interconnected to a lower borehole assembly tapered inner threaded section, not shown in FIG. 8. The lower borehole assembly tapered inner threaded section, not shown in FIG. 8, could be a section of the lower borehole assembly that could include a drilling bit, not shown in FIG. 8, that will be initially lowered by a drilling platform, not shown in FIG. 8, into the wellbore formation 85.

When the circulating downhole tool utilising a variable fluid pressure regulated cycle valve device 82, 86, 87, as shown in FIG. 8, FIG. 9, FIG. 10, respectively, is lowered down the wellbore formation 85 to a pre-determined depth controlled by the operator of the drilling platform, not shown in FIG. 8, FIG. 9, FIG. 10, the operator of the drilling fluid pump on the drilling platform, not shown in FIG. 8, FIG. 9, FIG. 10, can at any time remotely operate a change in the mode-of-operation of the circulating downhole tool utilising a variable fluid pressure regulated cycle valve device 82, 86, 87, as shown in FIG. 8, FIG. 9, FIG. 10, respectively.

The through-flow remotely operated mode-of-operation of the circulating downhole tool utilising a variable fluid pressure regulated cycle valve device 82, as shown in FIG. 8, 10 can be accomplished by switching on the drilling fluid pump or increasing the drilling fluid pump flow rate and pressure, not shown in FIG. 8, to produce the high flow rate and high pressure drilling fluid 83A, that exceeds a pre-determined drilling fluid flow rate and pressure that exceeds the compression spring compression force characteristics including the spring force constant of the compression spring 32 housed within the circulating downhole tool utilising a variable fluid pressure regulated cycle valve device 82, as shown in FIG. 8.

The intermediary remotely operated mode-of-operation of the circulating downhole tool utilising a variable fluid pressure regulated cycle valve device 86 shown in FIG. 9, can be accomplished by the operator by momentarily either switching off the drilling fluid pump or decreasing the drilling fluid pump flow rate and pressure, not shown in FIG. 9, to produce low flow rate and low pressure drilling fluid 83B, that does not exceed a pre-determined drilling fluid flow rate and pressure that does not exceeds the compression spring compression force characteristics including the spring force constant of the compression spring 32 housed within the circulating downhole tool utilising a variable fluid pressure regulated cycle valve device 86, as shown in FIG. 9.

The circulatory remotely operated mode-of-operation of the circulating downhole tool utilising a variable fluid pressure regulated cycle valve device 87, as shown in FIG. 10, can be accomplished by switching on again the drilling fluid pump or increasing the drilling fluid pump flow rate and pressure, not shown in FIG. 10, to produce the high flow rate and high pressure drilling fluid 83C, that exceeds a pre-determined drilling fluid flow rate and pressure that exceeds the compression spring compression force characteristics including the spring force constant of the compression spring 32 housed within the circulating downhole tool utilising a variable fluid pressure regulated cycle valve device 87, as shown in FIG. 10.

The bi-directional longitudinal movement and uni-directional 22.5° rotational clock-wise cyclical step movement of the cycle valve 53A, 53B, 53C along the centre-line axis inside the two-part cycle valve sleeve 33A, as shown in FIG. 6A, 6B, 6C, respectively, when a bi-directional longitudinal force produced by either the high flow rate and high pressure drilling fluid 83A, as shown in FIG. 8, or by either the expanding compression spring 32, as shown in FIG. 9, or by either the high flow rate and high pressure drilling fluid 83C, as shown in FIG. 10, is applied along the centre-line axis of the cycle valve 53A, 53B, 53C, as described in FIG. 8, FIG. 9 and FIG. 10, respectively, is designed to be repeatable for many thousands of cyclical movements of the cycle valve 53A, 53B, 53C over the life-time of the circulating downhole tool utilising a variable fluid pressure regulated cycle valve device 82, 86, 87 shown in FIG. 8, FIG. 9, FIG. 10, respectively.

The cyclical movements of the cycle valve 53A, 53B, 53C along the centre-line axis inside the two-part cycle valve sleeve 33A, as shown in FIG. 6A, 6B, 6C, respectively, will occur due to the eight curved notches and eight three-flat-sided teeth pattern 42A, 43A, 44A, 45A, 46A, 42B, 43B, 44B, 45B, 46B, 42C, 43C, 44C, 45C, 46C, 42D, 43D, 44D, 45D, 46D, 42E, 43E, 44E, 45E, 46E, 42F, 43F, 44F, 45F, 46F, 42G, 43G, 44G, 45G, 46G, 42H, 43H, 44H, 45H, 46H on the two-part cycle valve sleeve upper half lower patterned face 51B, which are the mirror-image of and are circumferentially rotationally clock-wise off-set by 22.5° to the elongated circumferential side view of the eight curved notches and eight three-flat-sided teeth pattern 37A, 38A, 39A, 40A, 41A, 37B, 38B, 39B, 40B, 41B, 37C, 38C, 39C, 40C, 41C, 37D, 38D, 39D, 40D, 41D, 37E, 38E, 39E, 40E, 41E, 37F, 38F, 39F, 40F, 41F, 37G, 38G, 39G, 40G, 41G, 37H, 38H, 39H, 40H, 41H on the two-part cycle valve sleeve lower half upper patterned face 34B, as shown in FIG. 4. The four cycle valve guide pins 59A, 60A, 61A, 62A are constrained to travel within the two-part cycle valve sleeve separation gap 52 between the two-part cycle valve sleeve lower half upper patterned face 34B and the two-part cycle valve sleeve upper half lower patterned face 51B, as shown in FIG. 4. In-effect, the two-part cycle valve sleeve separation gap 52 acts as a patterned cam groove in which the four cycle valve guide pins 59A, 60A, 61A, 62A are constrained to travel uni-directionally within, when a bi-directional longitudinal force produced by either the high flow rate and high pressure drilling fluid 83A, as shown in FIG. 8, or by either the expanding compression spring 32, as shown in FIG. 9, or by either the high flow rate and high pressure drilling fluid 83C, as shown in FIG. 10, is applied along the along the centre-line axis of the cycle valve 53A, 53B, 53C, as described in FIG. 8, FIG. 9 and FIG. 10, respectively. This results in the cycle valve 53A, 53B, 53C to be longitudinally displaced and rotated 22.5° in cyclical steps in a uni-directional clock-wise direction about the centre-line axis of and inside the two-part cycle valve sleeve 33A, as shown in FIG. 6A, FIG. 8 and FIG. 6B, FIG. 9 and FIG. 6C, FIG. 10, respectively.

As an example, the circulating downhole tool utilising a variable fluid pressure regulated cycle valve device 1, shown in FIG. 1, has an estimated length L1=11.500 inches and has an estimated outer diameter OD1=2.125 inches.

The lower sub-assembly 2, shown in FIG. 2, of the circulating downhole tool utilising a variable fluid pressure regulated cycle valve device 1, shown in FIG. 1, has an estimated length of L2=8.000 inches, and could be manufactured from 17-4 PH stainless steel.

The upper assembly 66, shown in FIG. 7, of the circulating downhole tool utilising a variable fluid pressure regulated cycle valve device 1, shown in FIG. 1, has an estimated length L3=5.000 inches, and could be manufactured from 17-4 PH stainless steel.

The two-part cycle valve sleeve 33A, shown in FIG. 3A and FIG. 3B, of the circulating downhole tool utilising a variable fluid pressure regulated cycle valve device 1, shown in FIG. 1, has an estimated outer diameter OD2=1.495 inches, and has an estimated inner diameter ID1=1.380 inches, and has an estimated height H1=1.640 inches, and has an estimated length L4=1.375 inches, and an estimated stepped length SL1=1.000 inches, and could be manufactured from alloy bronze CA104.

The two-part cycle valve sleeve 33A, shown in FIG. 3A and FIG. 4, of the circulating downhole tool utilising a variable fluid pressure regulated cycle valve device 1, shown in FIG. 1, has a two-part cycle valve sleeve separation gap 52 between the two-part cycle valve sleeve lower half upper patterned face 34B and the two-part cycle valve sleeve upper half lower patterned face 51B, that has an estimated patterned width P1=0.504 inches and an estimated 22.5° cyclical step pattern length PL=0.270 inches, and has an outer circumference OC of the two-part cycle valve sleeve lower half outer surface 35A, equal to sixteen times the cyclical step length, OC=PL1×16=0.270 inches×16=4.320 inches.

The cycle valve 53A, 53B, 53C of the circulating downhole tool utilising a variable fluid pressure regulated cycle valve device 1, shown in FIG. 5A, FIG. 5B, FIG. 5C, has an estimated outer diameter OD3=1.370 inches, and has an estimated length L5=1.000 inches, and the four cycle valve through holes 64A, 64C, 64E, 64G have an estimated internal diameter ID2=0.25 inches, and could be manufactured from 17-4 PH stainless steel.

The four cycle valve guide pins 59A, 60A, 61A, 62A of the circulating downhole tool utilising a variable fluid pressure regulated cycle valve device 1, shown in FIG. 6A, FIG. 6B, FIG. 6C, have an estimated length L6=0.435 inches long, and have an estimated outer diameter OD4=0.125 inches, and could be manufactured from centreless ground 17-4 PH stainless steel bar.

The compression spring centralising caps 31A, 31B of the circulating downhole tool utilising a variable fluid pressure regulated cycle valve device 1, shown in FIG. 1, have an estimated outer diameter OD5=0.490 inches, and have an estimated length L7=0.280 inches long, and could be manufactured from Polytetrafluoroethane plastic.

The lower sub-assembly tapered outer threaded section 5 and the upper sub-assembly tapered inner threaded section 79 can use American Macaroni Mining Tubing thread types.

The upper sub-assembly parallel outer threaded section 73 that is screwed into the lower sub-assembly upper flat face inner chamfered edge tapped hole 26 can use Stub ACME imperial thread types.

The circulating downhole tool utilising a variable fluid pressure regulated cycle valve device 1, shown in FIG. 1, has an estimated total mass of 4 kg.

A number of applications of the invention have been taught above and, on the basis of these, the skilled person will be aware of developments of these applications and many others applications all falling within the spirit and scope of the invention.

Whilst endeavouring in the foregoing specification to draw attention to those features of the invention believed to be of particular importance, it should be understood that the applicant claims protection in respect of any patentable feature or combination of features referred to herein, and/or shown in FIG. 1, FIG. 2, FIG. 3A, FIG. 3B, FIG. 4, FIG. 5A, FIG. 5B, FIG. 5C, FIG. 6A, FIG. 6B, FIG. 6C, FIG. 7, FIG. 8, FIG. 9 and FIG. 10 whether or not particular emphasis has been placed thereon.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as disclosed in any aspect, example, claim or embodiment of this disclosure, and a machine-readable storage storing such a program. Still further, embodiments of the present disclosure may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims, including with equivalence.

The invention claimed is:

1. A circulating downhole tool for selectively diverting fluid to one of: below the circulating downhole tool; or into an annulus between the circulating downhole tool and a wellbore;

wherein the tool comprises a cycle valve device that is cyclable utilising a change in pressure above and/or below a pre-determined fluid pressure to trigger the cycle valve device to vary fluid flow diversion cyclically between below the tool and the annulus;

wherein the cycle valve device comprises a plurality of axial through holes;

wherein the tool comprises a plurality of channel holes comprising a first set of channel holes in fluid communication with a region below the circulating downhole tool and a second set of channel holes in fluid communication with one or more side ports;

wherein the tool is configured to selectively open and close the one or more side ports by rotational movement of the cycle valve device about a centre-line axis of the tool, the rotational movement being responsive to a longitudinal movement of at least a portion of the cycle valve device, the longitudinal movement being associated with or triggered by a change in fluid flow or pressure by turning on or off a pump, wherein the rotation of the cycle valve device is configured to selectively align the plurality of axial through holes with the first and/or second set of channel holes; and wherein the tool is configured to be remotely operated from surface by an operator to allow selective and unlimited activation of the tool without having to be tripped or pulled out of the wellbore.

2. The tool of claim 1, wherein each of the plurality of channel holes is countersunk;

wherein the cycle valve device comprises a plurality of extensions located on a lower face thereof;

wherein the plurality of extensions are configured to seat within the countersunk first set of channel holes or second set of channel holes to block fluid flow therethrough when the plurality of axial through holes are aligned with the other of the first and second set of channel holes.

3. The tool of claim 2, wherein the extensions each comprise a truncated cone.

4. The tool of claim 1, comprising a length of less than 50 cm.

5. The tool of claim 1, wherein the cycle valve device comprises a variable fluid pressure regulated cycle valve device with a continuous circumferential patterned cam groove for cyclical relative rotation in response to cyclical longitudinal movement, the cyclical relative rotation configured to cause a cyclic opening and closing of the one or more side ports thereby allowing the tool to be endlessly cyclable between configurations for diverting fluid respectively into either below the circulating tool or the annulus; and wherein the patterned cam groove is unidirectional such that the relative rotation is in a single rotational direction.

6. The tool claim 1, wherein the tool is configured to be cycled between three modes of operation: a through-flow mode of operation whereby all fluid is diverted to below the circulating tool;

a circulatory mode of operation whereby all fluid is diverted to the annulus; and an intermediary mode of operation whereby a portion of fluid flow is diverted to below the circulating tool and a portion of fluid flow is simultaneously diverted to the annulus.

7. The tool of claim 1, wherein the longitudinal length of the tool is 30 cm or less; and wherein the tool is configured to operate above milling or jetting tools in a Bottom Hole Assembly.

8. The tool of claim 1; wherein the tool is configured to be cycled to a configuration whereby fluid flow is prevented, both to the annulus and to below the circulating tool.

9. The tool of claim 1, wherein the tool comprises a maximised internal diameter with a flow area of at least 0.71 cm2 or more to enable a high drilling fluid velocity and turbulent flow in the annulus for efficient drilling debris removal to the surface when operating in a circulatory mode-of-operation.

10. The tool of claim 1, wherein the tool is configured to be immune to variations in temperature, pressure, drilling mud type and density, and operating wellbore angle.

11. The tool of claim 1, wherein the tool is configured to be operable and/or activatable by a fluid selected from one or more of: a drilling fluid; nitrogen; an injection fluid; a stimulation fluid; and an acid; and wherein the tool is designed to be Nitrogen and drilling fluid compatible so that either can be delivered to the circulating downhole tool.

12. A downhole assembly comprising the tool of claim 1.

* * * * *